US010584928B2

(12) United States Patent
Shipley et al.

(10) Patent No.: US 10,584,928 B2
(45) Date of Patent: Mar. 10, 2020

(54) CASED TELESCOPED AMMUNITION FIREARM WITH TRANSLATING CHAMBER

(71) Applicant: AAI Corporation, Hunt Valley, MD (US)

(72) Inventors: Paul Andrew Shipley, Millers, MD (US); Joshua Stephen Ruck, Baltimore, MD (US); Gregory Paul Habiak, Bryn Mawr, PA (US); George Ronald Christ, Lutherville, MD (US); Brandon Scott Recchia, Parkton, MD (US); Mark Allen Siemsen, Lamar, CO (US); Benjamin Tyler Cole, Baltimore, MD (US); Kevin Michael Ayotte, Baltimore, MD (US)

(73) Assignee: AAI Corporation, Hunt Valley, MD (US)

( * ) Notice: Subject to any disclaimer, the term of this patent is extended or adjusted under 35 U.S.C. 154(b) by 0 days.

(21) Appl. No.: 16/044,377

(22) Filed: Jul. 24, 2018

(65) Prior Publication Data

US 2019/0049201 A1 Feb. 14, 2019

Related U.S. Application Data

(60) Provisional application No. 62/536,445, filed on Jul. 24, 2017, provisional application No. 62/536,448,
(Continued)

(51) Int. Cl.
*F41A 3/34* (2006.01)
*F41A 9/45* (2006.01)
(Continued)

(52) U.S. Cl.
CPC *F41A 3/34* (2013.01); *F41A 3/10* (2013.01); *F41A 3/26* (2013.01); *F41A 3/30* (2013.01);
(Continued)

(58) Field of Classification Search
CPC ..... F41A 5/18; F41A 5/24; F41A 3/32; F41A 3/12; F41A 3/10; F41A 3/14; F41A 3/16;
(Continued)

(56) References Cited

U.S. PATENT DOCUMENTS 2,397,963 A * 4/1946 Harvey ..... F41A 5/24 89/179
3,114,290 A * 12/1963 Harvey ..... F42B 5/18 89/26
(Continued)

FOREIGN PATENT DOCUMENTS

DE 9200505 4/1992
DE 9201632 4/1992
(Continued)

OTHER PUBLICATIONS

"ARES-Olin AIWS", Gun Wiki, Random powered by Wikia, Year designed: 1987, <<http://guns.wikia.com/wiki/ARES-Olin_AIWS>> article accessed Jul. 31, 2018, 4 pages.

*Primary Examiner* — John Cooper
(74) *Attorney, Agent, or Firm* — BainwoodHuang

(57) ABSTRACT

A weapon for firing cased telescoped (CT) ammunition includes a barrel, a chamber member and a carrier assembly. The chamber member defines a chamber for a CT round for firing, and translates between a firing position aligned with the barrel and an ejection/loading position. The chamber member is spring-biased toward the firing position. The carrier assembly carries the firing pin and (1) performs a recoil in which a carrier and rammer move rearward from a battery position to bring the next CT round into a ramming position and to move the chamber member from the firing position to the ejection/loading position, and (2) performs a counter-recoil to return to the battery position and cause the rammer to push the next CT round into the chamber. The
(Continued)

chamber member is released for biased return to the firing position for a next firing cycle.

13 Claims, 58 Drawing Sheets

Related U.S. Application Data filed on Jul. 24, 2017, provisional application No. 62/536,451, filed on Jul. 24, 2017.

(51) Int. Cl.

| | |
|---|---|
| ***F41A 3/26*** | (2006.01) |
| ***F41A 9/23*** | (2006.01) |
| ***F41A 3/30*** | (2006.01) |
| ***F41A 3/10*** | (2006.01) |
| ***F41A 21/12*** | (2006.01) |
| *F42B 5/045* | (2006.01) |

(52) U.S. Cl.
CPC *F41A 9/23* (2013.01); *F41A 9/45* (2013.01); *F41A 21/12* (2013.01); *F42B 5/045* (2013.01)

(58) Field of Classification Search
CPC ..... F41A 3/26; F41A 3/28; F41A 3/30; F41A 3/34; F41A 9/66; F41A 9/67; F41A 9/75; F41A 15/14; F41A 21/12; F42B 5/045
USPC ..... 89/155
See application file for complete search history.

(56) References Cited

U.S. PATENT DOCUMENTS

| | | | | | |
|---|---|---|---|---|---|
| 3,345,770 | A * | 10/1967 | Scanlon, Jr. | F41A 9/65 | 42/18 |
| 3,738,223 | A * | 6/1973 | Post | F41A 3/74 | 89/26 |
| 3,738,224 | A * | 6/1973 | Post | F41A 3/12 | 89/26 |
| 4,265,043 | A * | 5/1981 | Rowlands | F41A 15/14 | 42/25 |
| 4,487,103 | A | 12/1984 | Atchisson | | |
| 4,872,391 | A * | 10/1989 | Stoner | F41A 9/42 | 89/155 |
| 4,895,064 | A * | 1/1990 | Marzocco | F41A 3/54 | 42/25 |
| 5,117,735 | A | 6/1992 | Flashkes | | |
| 5,447,092 | A * | 9/1995 | Dobbins | F41A 3/46 | 42/16 |
| 6,637,310 | B2 | 10/2003 | Borgwarth | | |
| 7,137,217 | B2 * | 11/2006 | Olson | F41A 5/02 | 42/15 |
| 7,886,470 | B1 * | 2/2011 | Doiron | F41A 3/46 | 42/16 |
| 8,776,419 | B2 | 7/2014 | Obermeit | | |
| 8,807,039 | B2 | 8/2014 | Carpenter et al. | | |
| 8,869,672 | B2 | 10/2014 | Smith | | |
| 9,267,772 | B2 | 2/2016 | Carpenter et al. | | |
| 9,638,484 | B1 * | 5/2017 | Friend | F41A 11/02 | |
| 2003/0056639 | A1 * | 3/2003 | Giza | F41A 3/54 | 89/1.701 |
| 2005/0262750 | A1 | 12/2005 | Olson et al. | | |
| 2006/0156606 | A1 * | 7/2006 | Robinson | F41A 15/12 | 42/7 |
| 2015/0308759 | A1 * | 10/2015 | Fellows | F41A 19/25 | 42/16 |
| 2017/0328689 | A1 | 11/2017 | Dindl | | |
| 2017/0328690 | A1 * | 11/2017 | Dindl | F41A 15/12 | |
| 2018/0066925 | A1 | 3/2018 | Skowron et al. | | |

FOREIGN PATENT DOCUMENTS

| | | |
|---|---|---|
| RU | 2201573 | 3/2003 |
| WO | 2017197415 A2 | 11/2017 |

* cited by examiner

1. Battery
Slide Position at
Cartridge ignition

2. Recoil Stroke
a. Chamber Indexed; Rammer
Spring Cocked; then
Released by Chamber Cam b. Rammer Stroke:
Cartridge stripped
from magazine c. Max Travel
2 inch overtravel provided
To reduce felt recoil 1. Battery
Slide Position at
Cartridge ignition 2. Recoil Stroke
Chamber Indexed; Rammer
Retracted; Max travel of 5"

3. Counter Recoil Stroke
a. Rammer Stroke:
Cartridge stripped
from magazine b. Chamber Index

CASED TELESCOPED AMMUNITION FIREARM WITH TRANSLATING CHAMBER

CROSS REFERENCE TO RELATED APPLICATIONS

The present application claims priority to the following United States Provisional Patent Applications filed on Jul. 24, 2017, the disclosures of which are hereby included by reference herein:

a) U.S. Provisional Patent Application No. 62/536,445, b) U.S. Provisional Patent Application No. 62/536,448, and c) U.S. Provisional Patent Application No. 62/536,451

STATEMENT OF GOVERNMENT RIGHTS

The invention was made with government support under W15QKN-12-9-0001/DOTC-14-01-INIT524 MOD11 awarded by the US Army. The government has certain rights in the invention.

BACKGROUND

The present invention is related to the field of firearms, and in particular to firearms such as carbines firing cased telescoped (CT) ammunition.

As it is generally known, most traditional firearm ammunition cartridges are constructed using a metal shell casing (e.g. a brass casing). The metal casing of a traditional cartridge typically contains some amount of propellant (e.g. gunpowder, smokeless powder, etc.) in a rearward portion of the cartridge that is sometimes referred to as the cartridge "body". The metal casing of a traditional casing also holds a projectile in a frontward portion of the cartridge that is sometimes referred to as the cartridge "neck". Traditional metal cartridge cases typically have a tapered shape, in which a relatively wider diameter body steps down to a relatively smaller diameter neck. When a traditional metal case cartridge is fired, the propellant contained in the metal casing is ignited. Gases resulting from the burning of the propellant pressurize and expand the metal casing against the wall of the chamber, and push against the base of the brass casing, causing the projectile to be expelled from the front of the cartridge and through the barrel of the firearm.

In contrast to traditional metal case cartridges, cased telescoped (CT) ammunition cartridges completely encase the propellant and the projectile within a cylindrical shell that is made of polymer. By eliminating the relatively heavy metal casing used in traditional metal case ammunition, CT ammunition provides a significant reduction in ammunition weight, enabling relatively larger numbers of rounds to be carried per unit weight, e.g. by infantry soldiers.

SUMMARY

A weapon for firing cased telescoped (CT) ammunition is disclosed, the weapon including a barrel, a chamber member and a carrier assembly. The chamber member defines a chamber for a CT round for firing, and translates between a firing position aligned with the barrel and an ejection/loading position. The chamber member is spring-biased toward the firing position. The carrier assembly carries the firing pin and (1) performs a recoil in which a carrier and rammer move rearward from a battery position to bring the next CT round into a ramming position and to move the chamber member from the firing position to the ejection/loading position, and (2) performs a counter-recoil to return to the battery position and cause the rammer to push the next CT round into the chamber. The chamber member is released for biased return to the firing position for a next firing cycle.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DETAILED DESCRIPTION

Figure 1:
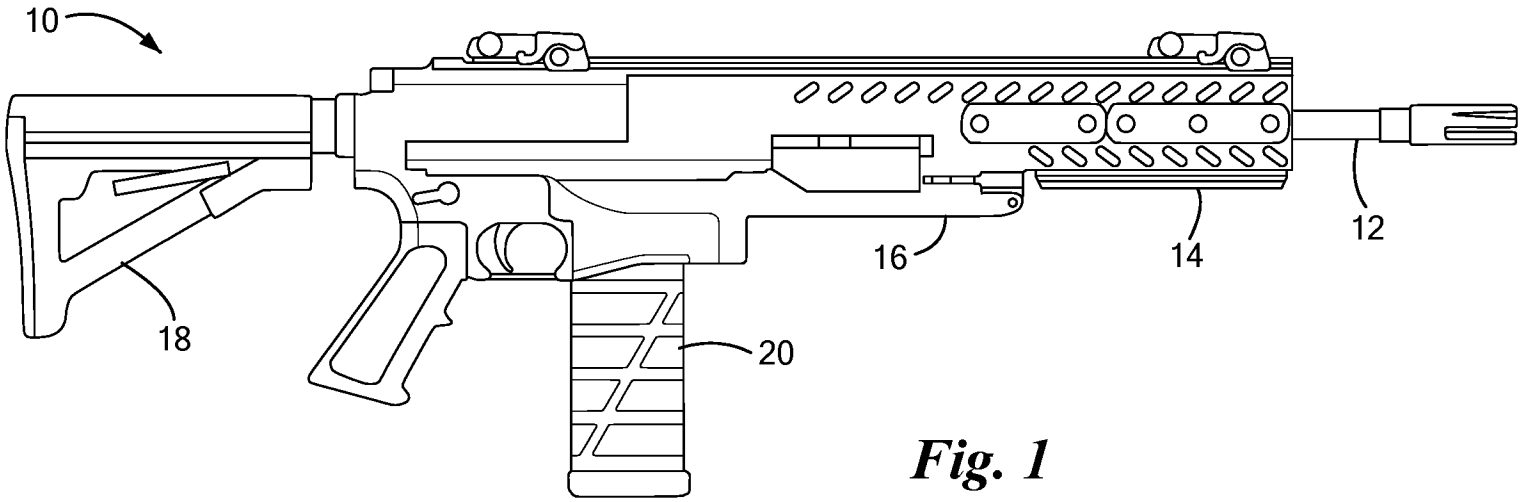
FIG. 1 is a side elevation view of a carbine.
Figure 2:
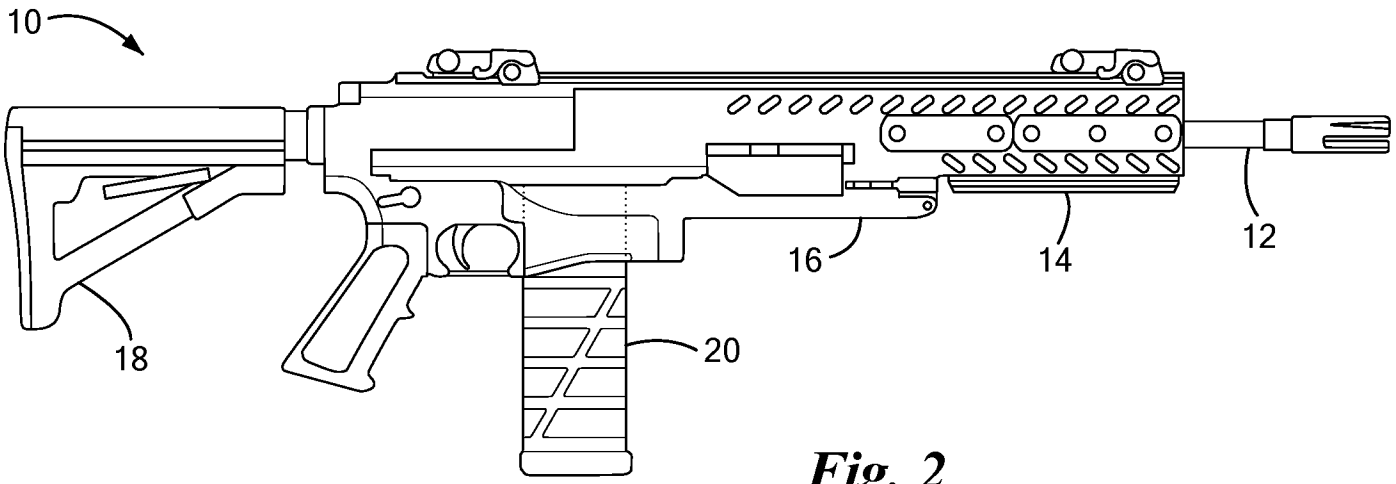
FIG. 2 is a side elevation view of a carbine with internal structure revealed.
Figure 3:
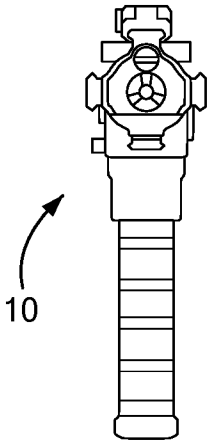
FIG. 3 is a front elevation view of a carbine.

FIGS. 1-3 show a carbine 10 according to one embodiment. FIG. 1 is a fully exterior view in which the following major components are visible:

Barrel 12

Upper receiver 14

Lower receiver 16

Buttstock 18

Magazine 20

FIG. 2 shows a view of the carbine 10 similar to that of FIG. 1.

FIG. 3 is a front elevation view of the carbine 10.

Figure 4:
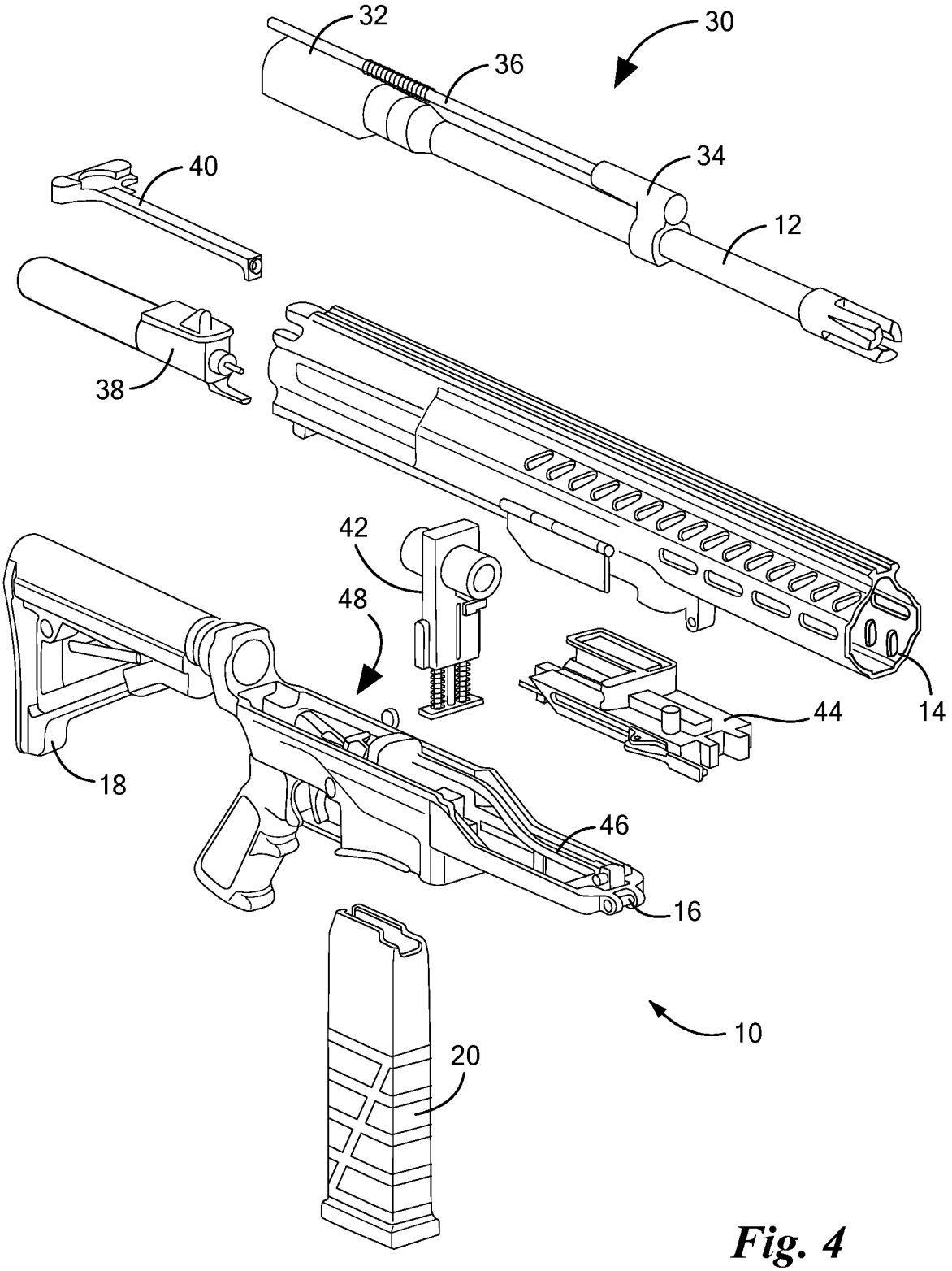
FIG. 4 is a perspective exploded view of a carbine.

FIG. 4 is an exploded view of the carbine 10 showing additional details. The barrel 10 is part of a barrel assembly 30 also including a barrel extension 32, gas block 34, and gas piston 36. The upper receiver 14 houses a carrier assembly 38 and a charging handle 40. The lower receiver 16 houses a chamber assembly 42, ejector assembly 44, slide 46 and trigger group 48, and includes a downward-facing magazine well for receiving the magazine 20. The lower receiver 16 is also attached to the buttstock 18, which includes an internal buffer and drive spring of the type generally known in the art.

FIGS. 5-20 show more detailed arrangement and structural detail of the components of the carbine 10.

Figure 5:
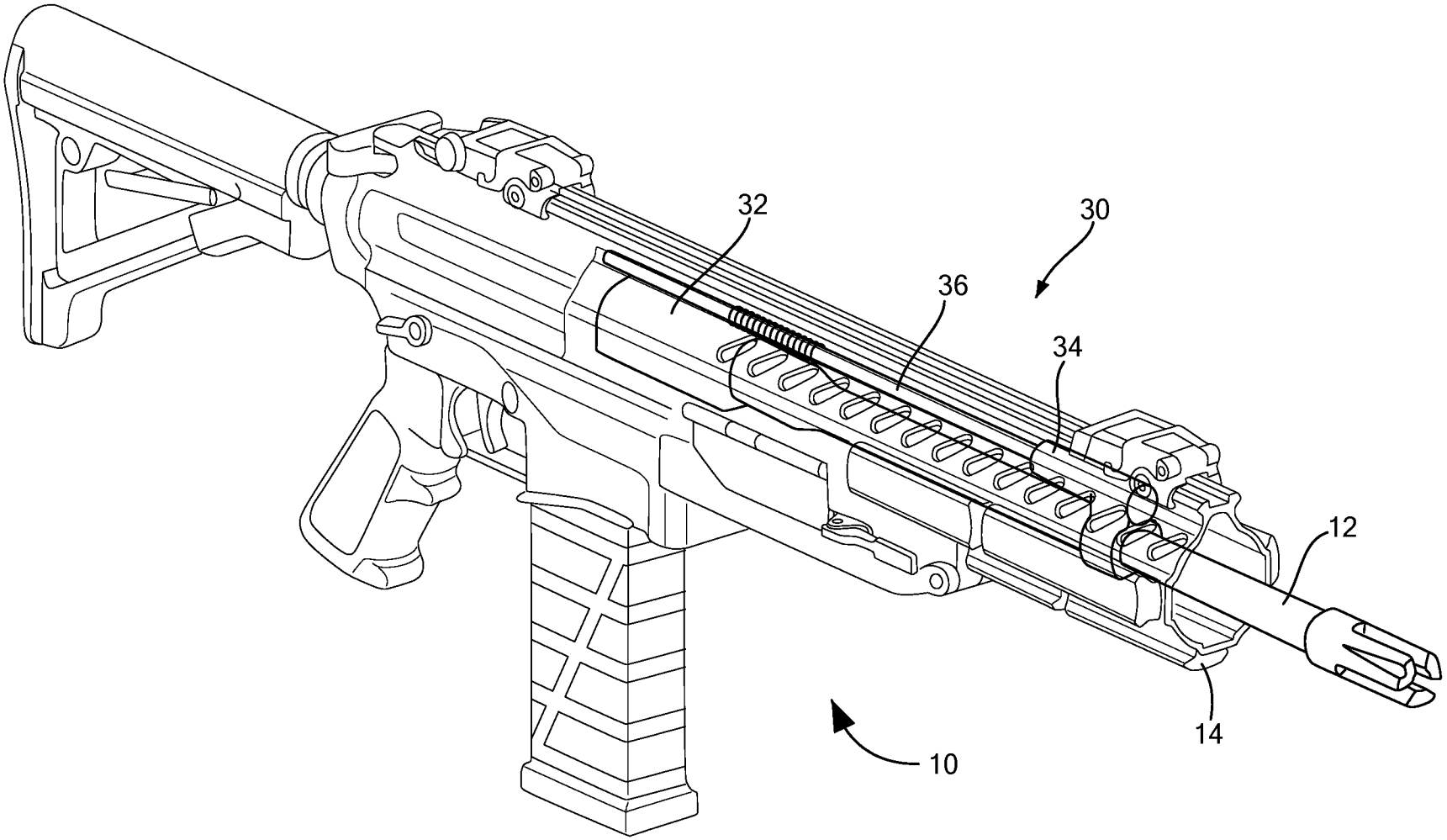
FIG. 5 is a perspective view of a carbine highlighting a barrel group.

FIG. 5 shows the barrel assembly 30 in place within the carbine 10, specifically within the upper receiver 14. The barrel extension 32 and barrel 12 are machined steel components connected together. In one embodiment, a rear end of the barrel 12 is screwed into a forward end of the barrel extension 32, and chordal pins are used to inhibit any loosening of the screw attachment during operation. FIG. 5 also shows the gas block 34 and gas piston 36.

Figure 6:
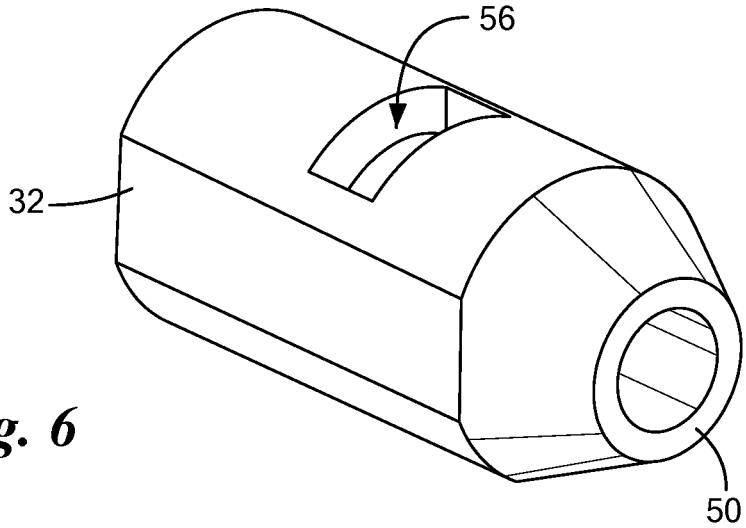
FIGS. 6-8 are views of a barrel extension.
Figure 7:
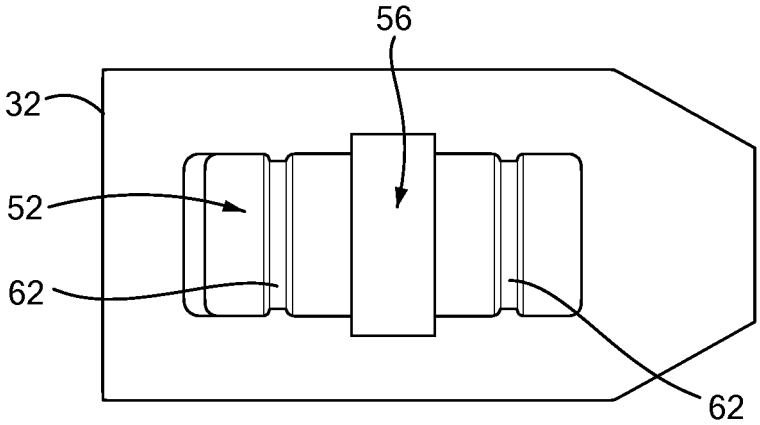
Figure 8:
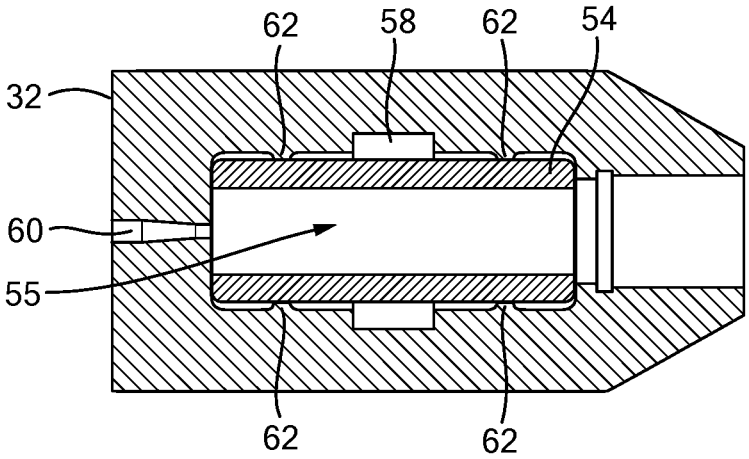

FIGS. 6-8 shows details of the barrel extension 32. In the illustrated embodiment it has an elongated, roughly cylindrical shape that is open along its bottom. A front circular face 50 mates with a corresponding surface of the barrel 12 (FIG. 5). The roughly cylindrical shape defines an interior chamber cavity 52 for receiving a cylindrical chamber member 54, as shown in the cutaway view of FIG. 8 and described more below. The chamber member 54 defines a cylindrical firing chamber 55, which is also referred to as simply the "chamber" herein. The barrel extension 32 also has a rectangular opening 56 to allow passage of an upper part of a chamber carrier 58 that holds the chamber member 54, as also described more below. Also shown in FIG. 8 is a conical firing pin opening 60 for receiving a firing pin carried by the carrier assembly 38 (FIG. 5). As seen in FIGS. 7-8, the interior surface of the barrel extension 32 includes machined ribs 62 whose function is to hold the chamber member 54 in a position of precise alignment with the barrel 12, specifically to align the cylindrical chamber 55 with the bore of the barrel 12 to ensure that a fired round enters the barrel 12 smoothly and in alignment with the barrel axis. Additional details regarding functions of the barrel extension 32 are provided below.

Figure 9:
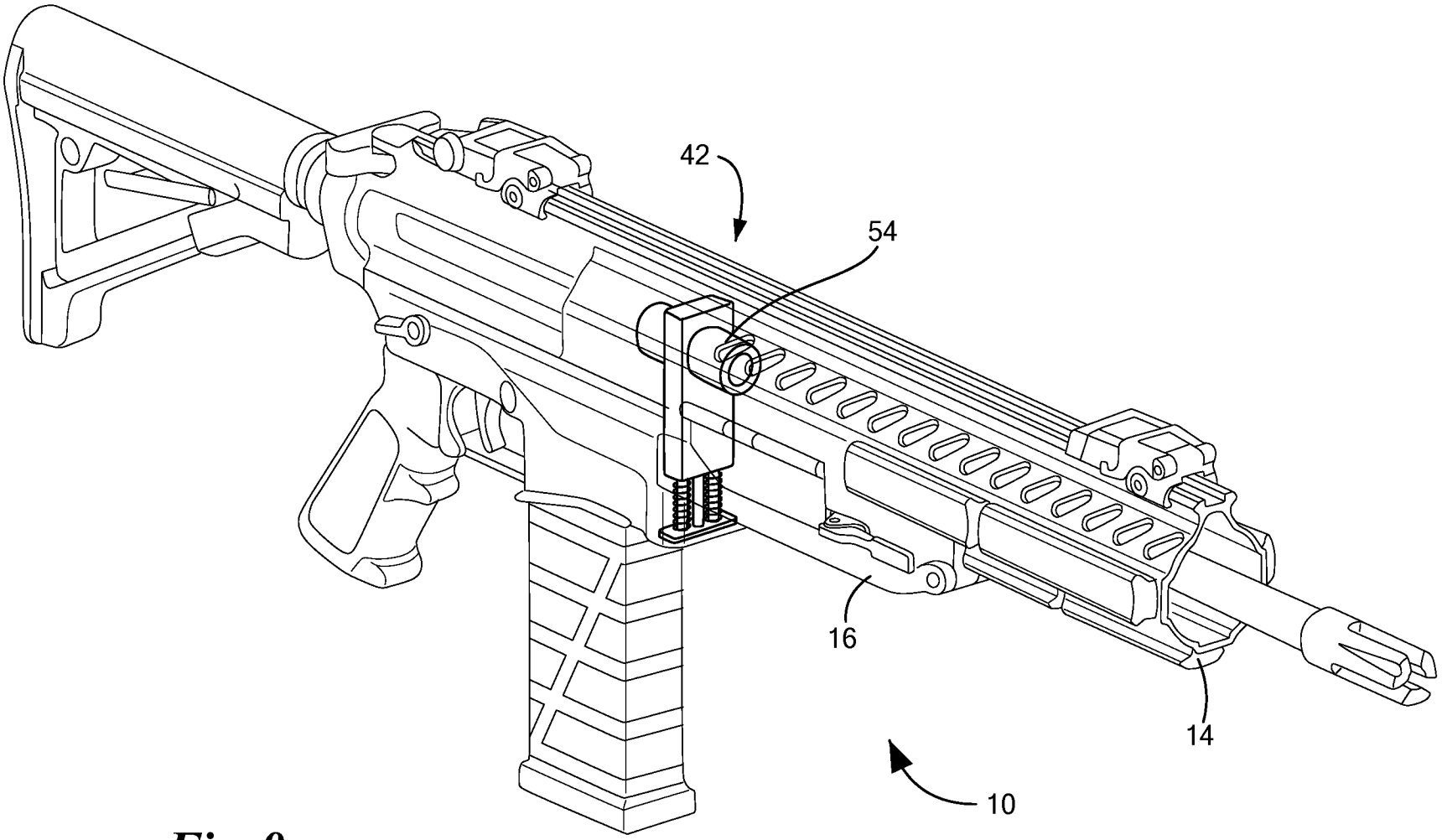
FIG. 9 is a perspective view of a carbine highlighting a chamber carrier assembly.

FIG. 9 shows the chamber assembly 42 in place within the carbine 10. The chamber assembly 42 rests within the lower receiver 16, with an upper portion including the chamber member 54 extending upwardly into the barrel extension 32 (not shown) within the upper receiver 14.

Figure 10:
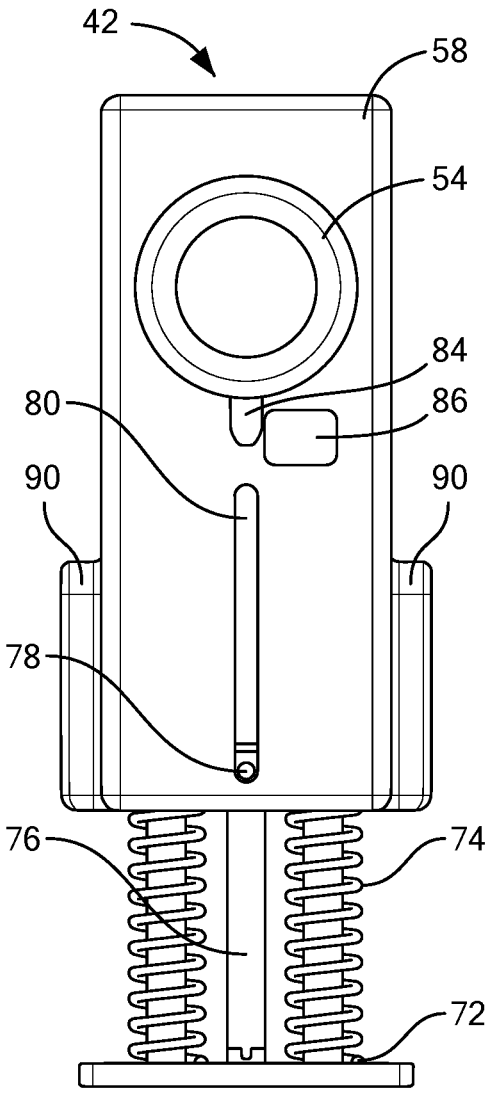
FIGS. 10-12 are views of the chamber carrier assembly and components thereof.
Figure 11:
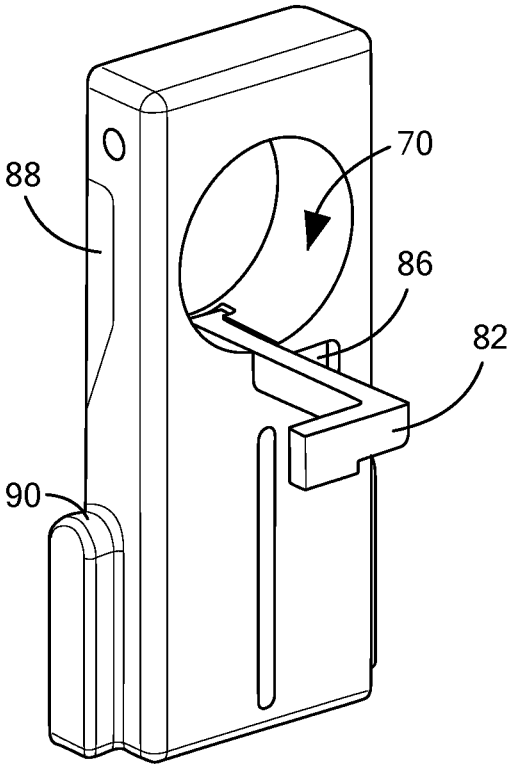
Figure 12:
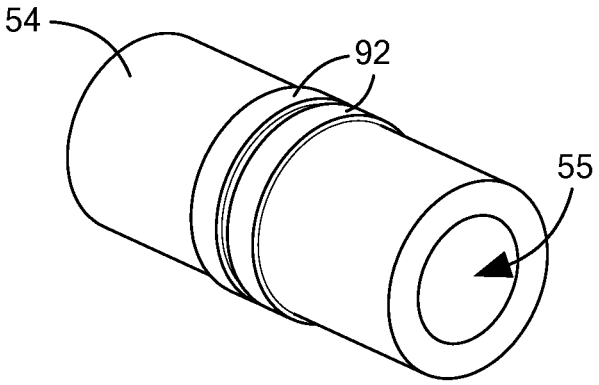

FIGS. 10-12 show additional detail of the chamber assembly 42. The chamber member 54 is retained within a circular bore 70 of the rectangular-shaped chamber carrier 58. The assembly is anchored within the lower receiver 16 by a base plate 72, coupled to the chamber carrier 58 by springs 74 and a spring retention rod 76 whose upper end 78 is captured in a spring retention slot 80 of the chamber carrier 58. The springs 74 bias the chamber carrier 58 upwardly, providing for movement of the chamber member 54 into a firing position at a certain point in the firing cycle as described more below. A front round stop 82 resides within a keyway 84 at the bottom of the bore 70. The chamber carrier 58 also includes a chamber carrier catch cutout 86, a sear link cam indentation 88 providing camming for a separate sear link (not shown), and slide cam shoulders 90 that engage the slide 46 (FIG. 4) for counter-bias downward movement of the chamber carrier 58 into an ejection/loading position, as also described more below. As shown in FIG. 12, the chamber member 54 includes two annular protrusions 92 that provide for precise positioning of the chamber member 54 in the chamber carrier 58.

Figure 13:
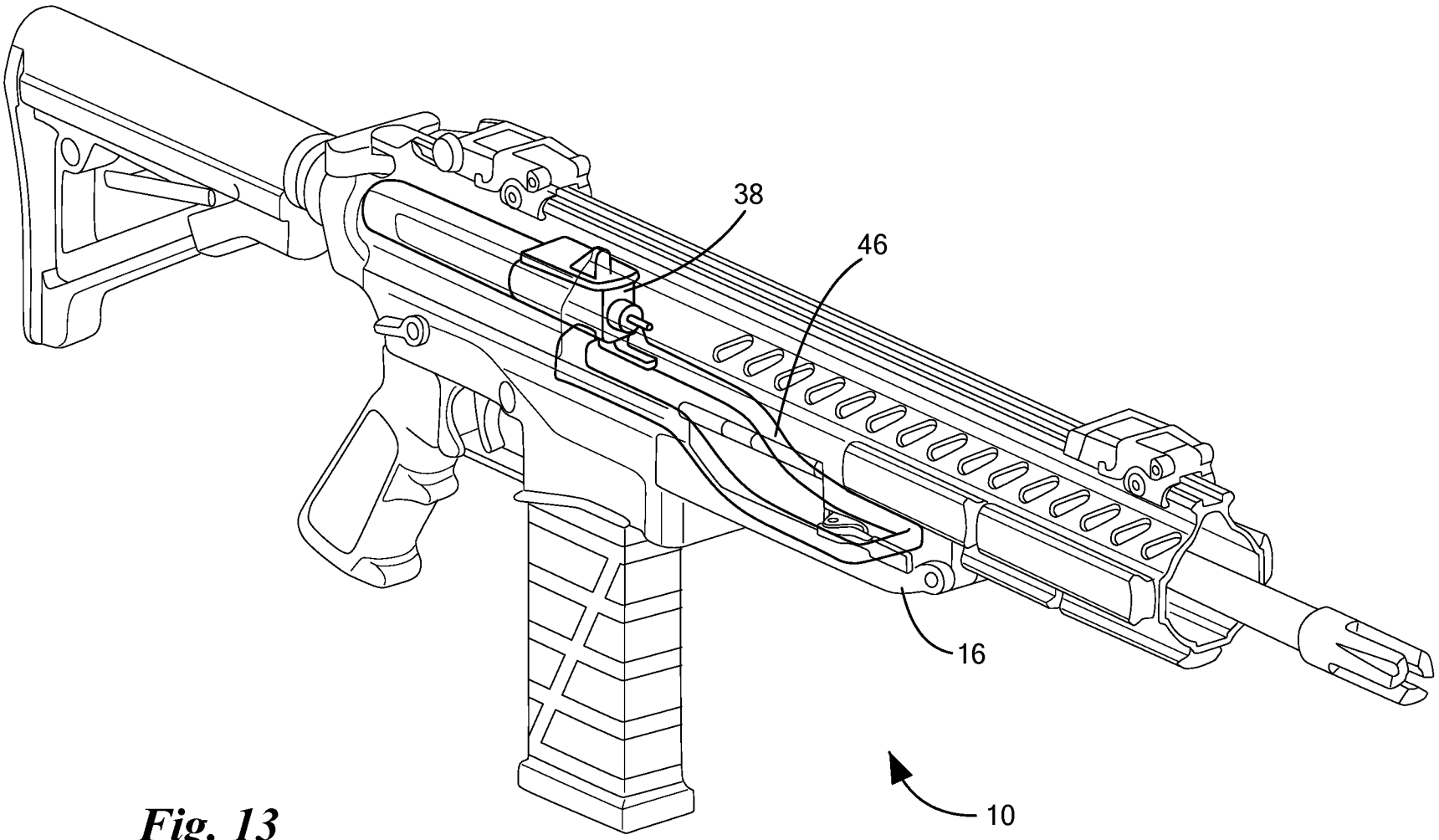
FIG. 13 is a perspective view of a carbine highlighting a carrier assembly and slide.

FIG. 13 shows the carrier assembly 38 and slide 46 within the carbine 10. These two components are mated together by a friction connection and move together in a reciprocating manner in operation, as described more below. Among other things, the carrier assembly 38 carries the firing pin and a fixed rammer that performs push-through loading and ejection, and the slide 46 actuates the chamber carrier 58 to move the chamber member 54 between the firing position and ejection/loading position, as described more below.

Figure 14:
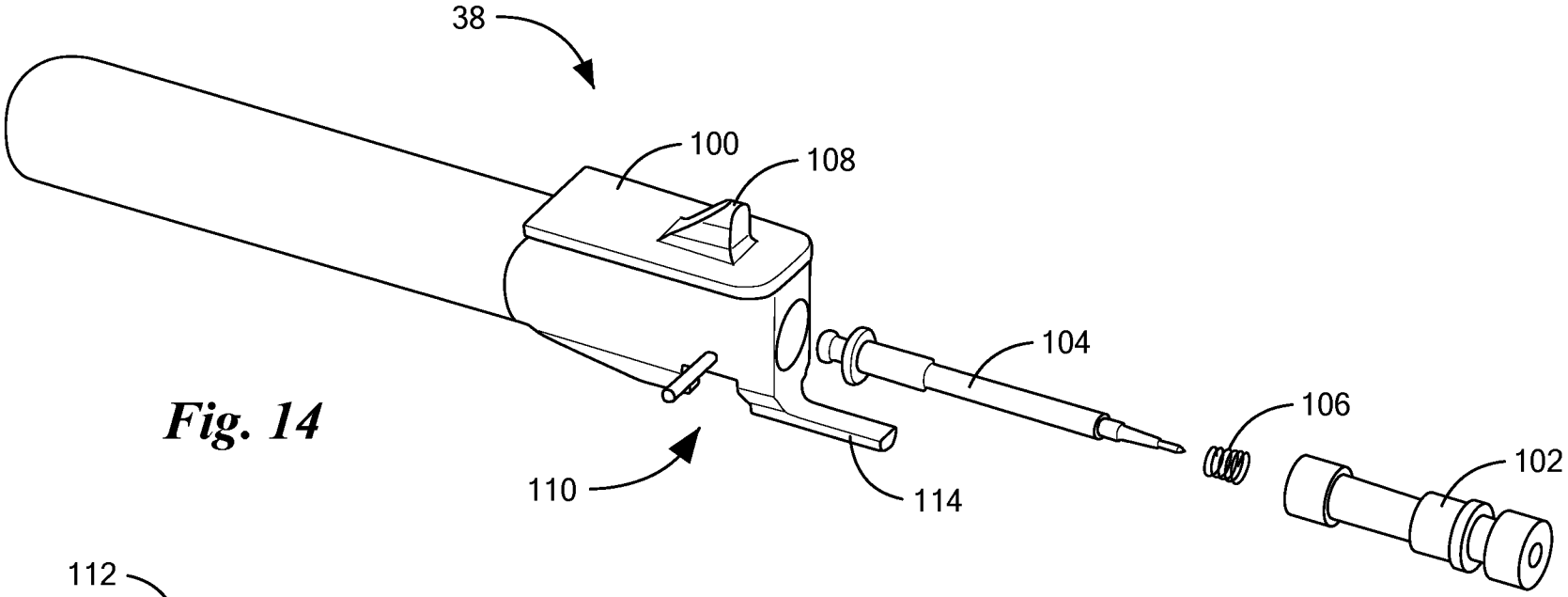
FIG. 14 is a perspective exploded view of the carrier assembly.
Figure 15:
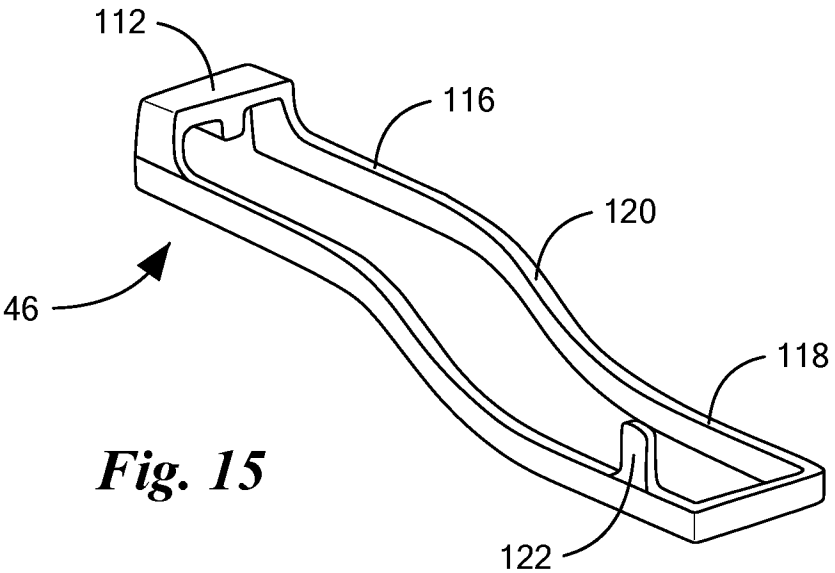
FIG. 15 is a perspective view of the slide.

FIGS. 14-15 show details of the carrier assembly 38 and slide 46. The carrier assembly 38 includes a machined carrier 100, a firing pin protrusion 102, firing pin 104, and firing pin return spring 106. The carrier 100 has a piston interface boss 108 and a bottom-facing notch 110 for receiving a rear end 112 of the slide 46, as well as a forward-facing, foot-like protrusion referred to as a rammer 114. The slide 46 has a generally S-shaped profile, with relatively flat rear and forward portions 116, 118 separated by a sloping intermediate portion 120. It also includes an upward-facing clearing rod reset boss 122.

Figure 16:
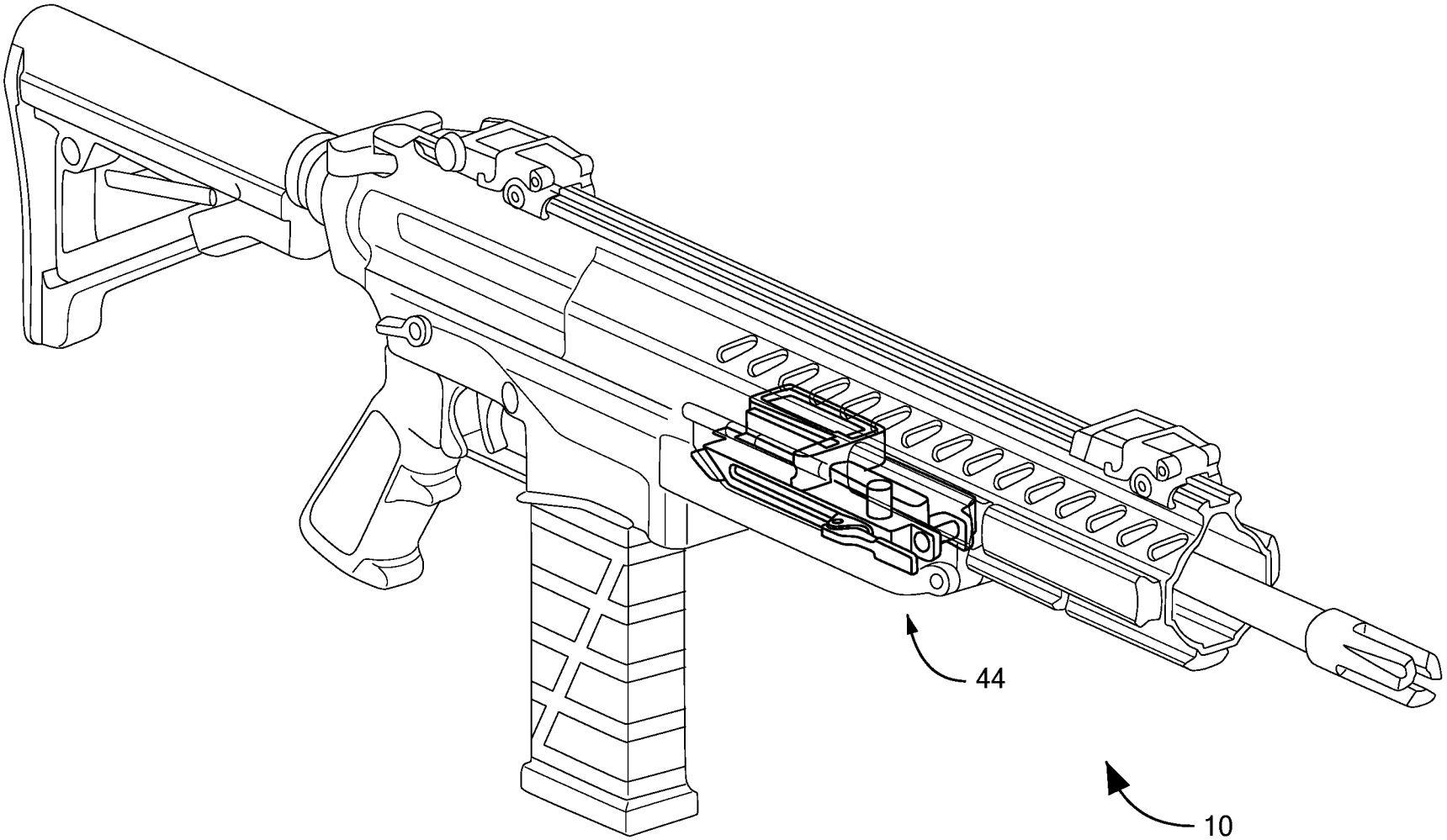
FIG. 16 is a perspective view of a carbine highlighting an ejector assembly.

FIG. 16 shows the ejector assembly 44 within the carbine 10.

Figure 17:
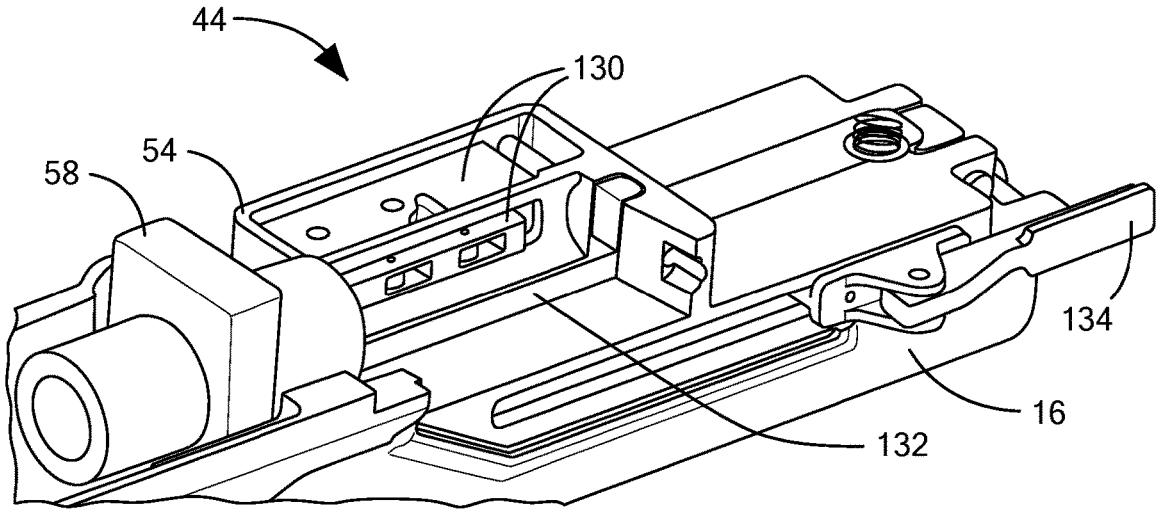
FIGS. 17-18 are views of the ejector assembly.
Figure 18:
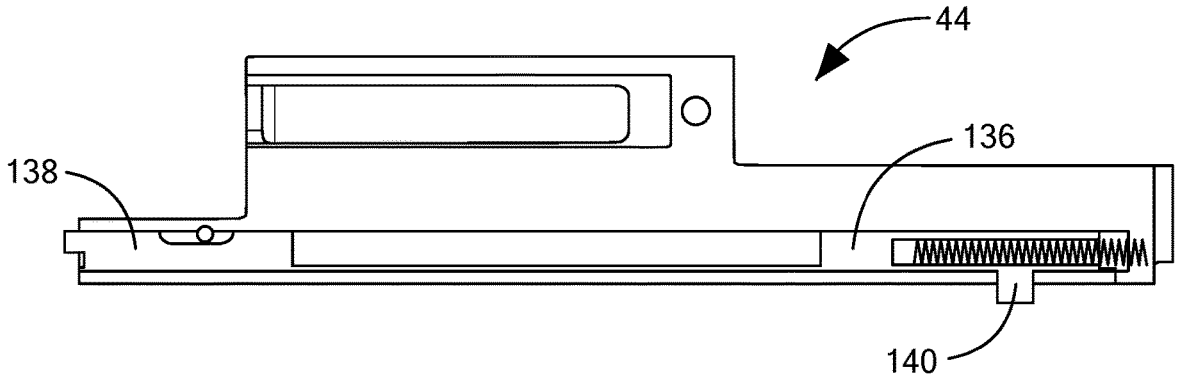

FIGS. 17-18 show certain details of the ejector assembly 44. It includes an ejector 130 and a clearing rod mechanism with a clearing rod 132 and clearing handle 134. As shown in FIG. 18, the ejector assembly 44 also includes a spring-loaded chamber carrier catch 136 that functions to latch the chamber carrier 58 in the ejection/loading position as described more below. The chamber carrier catch 136 has an end protrusion 138 that engages the carrier catch cutout 86 (FIGS. 10-11), as well as a forward protrusion 140 that is engaged by the slide 46 to hold the chamber carrier 58 in the ejection/loading position throughout a certain part of the operating cycle as also described more below.

Figure 19:
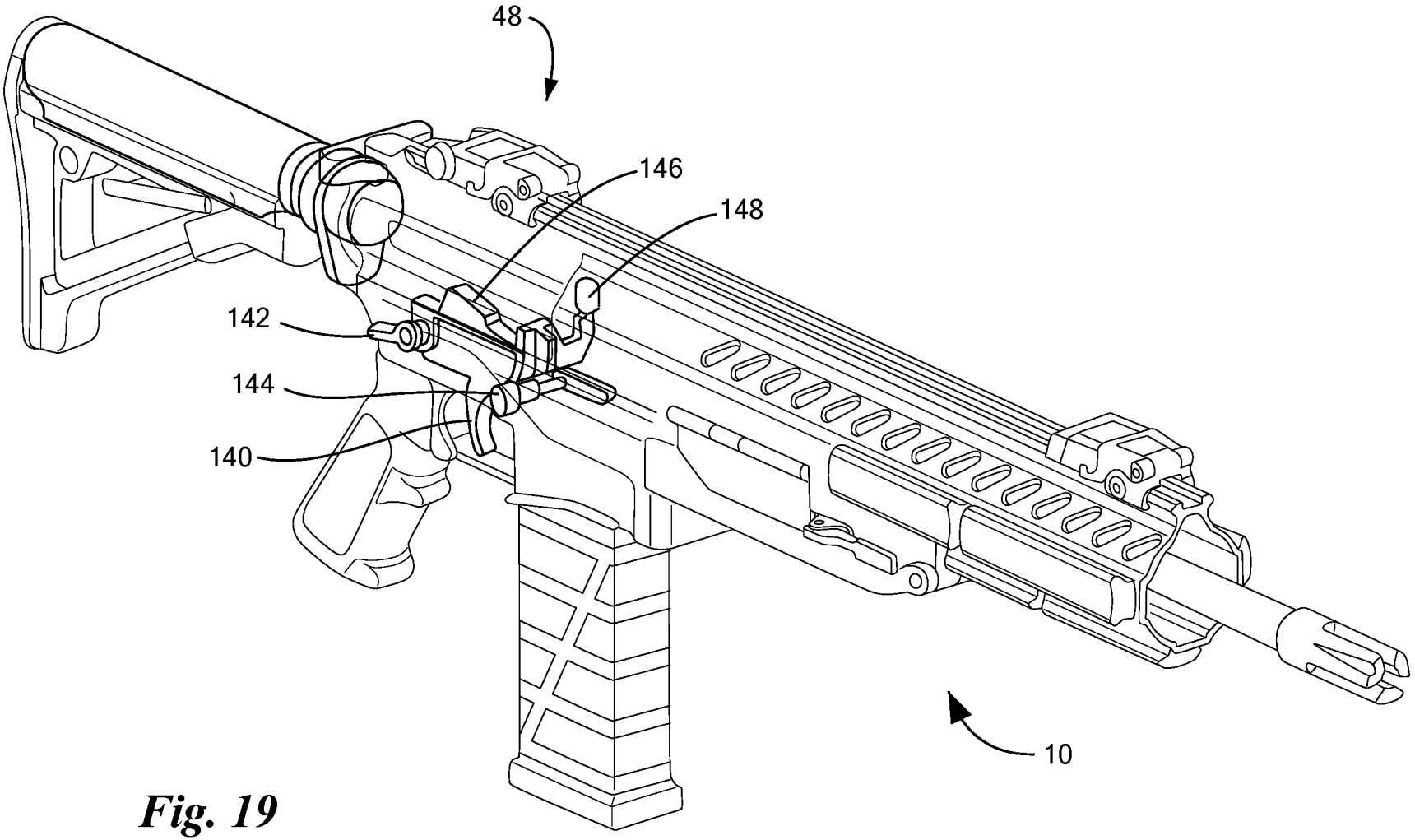
FIG. 19 is a perspective view of a carbine highlighting a trigger group and buffer.

FIG. 19 shows the trigger group 48 within the carbine 10. External components include a trigger 140, mode selector 142, and magazine release 144. Internal components include a hammer 146 and carrier catch 148.

Figure 20:
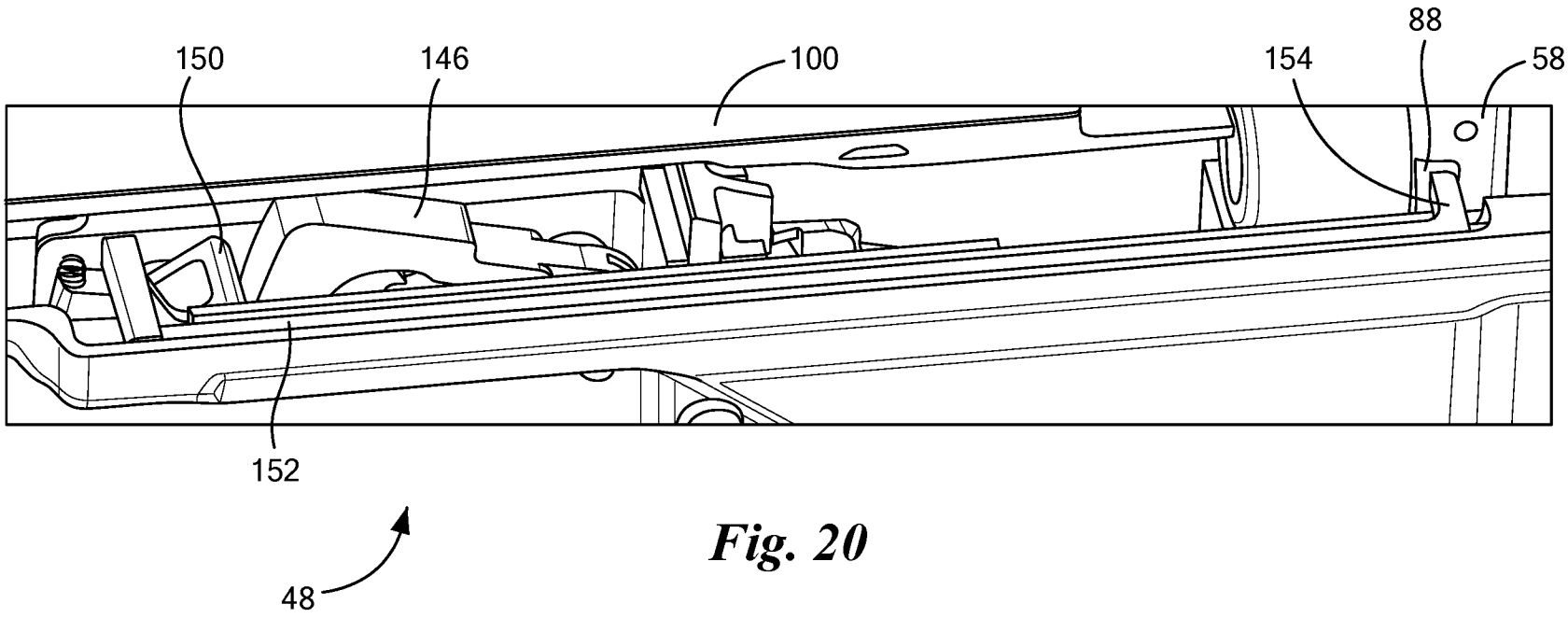
FIG. 20 is a view of a sear link and related components.

FIG. 20 shows the trigger group 48 and related structure in more detail. A spring-biased hammer 146 is engaged by a spring-biased full auto sear 150, which in turn is engaged by a full-auto-sear (FAS) link 152 having a forward portion 154 that engages the sear link cam indentation 88 of the chamber carrier 58. In operation, when the chamber carrier 58 is in the downward ejection/loading position as shown, the FAS link 152 is moved forward (rightward in FIG. 20) and allows the FAS 150 to engage the hammer 146, preventing it from releasing. When the chamber carrier 58 is in the upward firing position (described more below), the FAS link 152 is moved rearward (leftward in FIG. 20) and pushes the FAS 150 away from the hammer 146, enabling the hammer to be released based on depression of the trigger 140.

FIGS. 21-26 are used to describe basic operation of the carbine 10.

Figure 21:
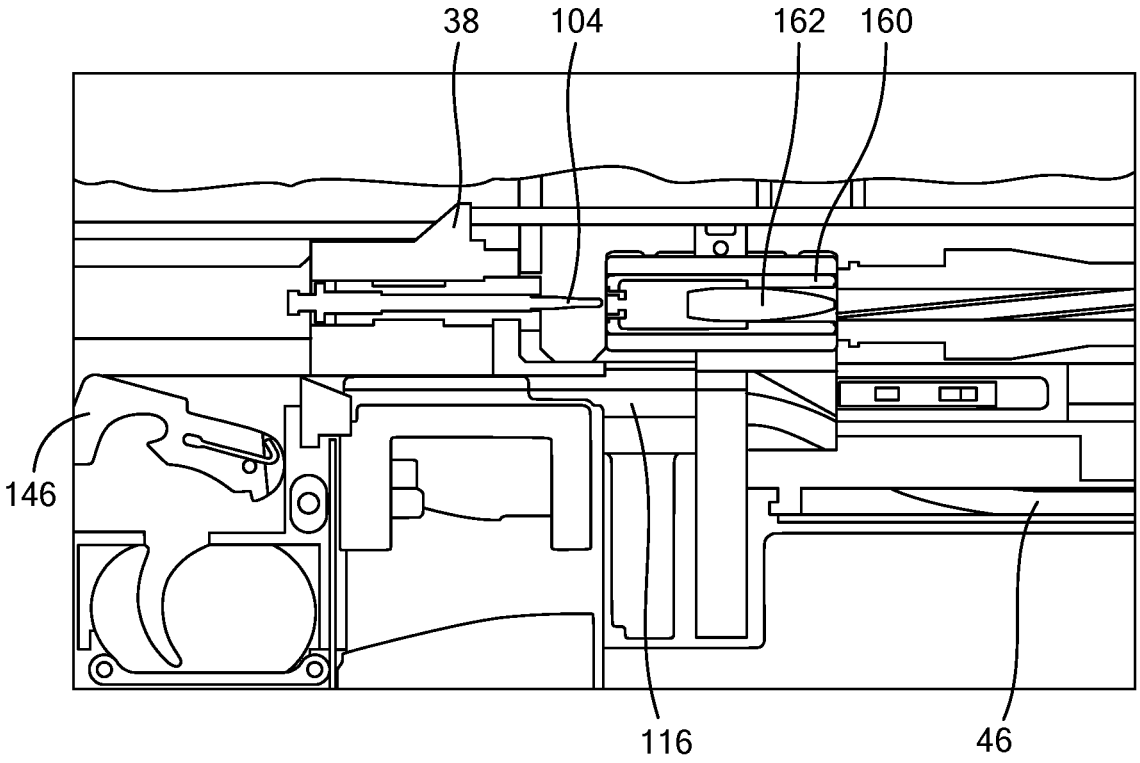
FIGS. 21-26 are side internal views illustrating operation of the carbine.

FIG. 21 shows an initial state in which a cartridge 160 is chambered and the chamber member 54 is in the firing position, within the chamber cavity 52 of the barrel extension 32 (FIGS. 6-8). The hammer 146 is cocked, and the carrier assembly 38 is in a battery position against the rear face of the barrel extension 32, with the tip of the firing pin 104 adjacent to a primer of the cartridge 160. The slide 46 is completely forward (rightward in these figures), so that its rear portion 116 clears the cam shoulders 90 of the chamber carrier 58 (not visible in FIG. 21), enabling the chamber carrier 58 to be urged completely upward into the firing position.

When the trigger is pulled (or, in full auto mode, based on action of the FAS link 152 as described above), the hammer 146 is released, which strikes the firing pin 104 and ignites the primer to fire the cartridge 160. As the slug 162 exits the barrel 12, gas in the barrel 12 pushes the gas piston 36 rearward. The carrier assembly 38 recoils, pulling the slide 46 rearward and cocking the hammer 146.

Figure 22:
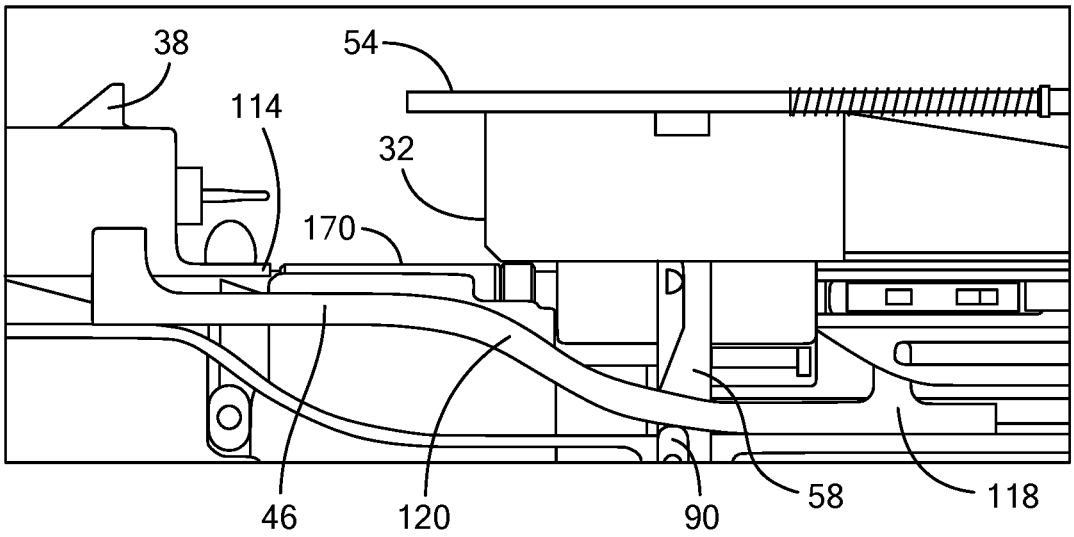

FIG. 22 shows the end of recoil, when the slide assembly 38 is at its farthest rearward travel. The sloped portion 120 of the slide 46 has pushed downwardly on the cam shoulders 90 to lower the chamber carrier 58, bringing the chamber member 54 into the ejection/loading position in which it is aligned with a next CT cartridge 170 which is the topmost round in the magazine. The next CT cartridge 170 has its upper edge aligned with the rammer 114. It will be appreciated that at this instant the spring within the buttstock 18 has maximal compression and urges the carrier assembly 38 forward, starting counter-recoil.

Figure 23:
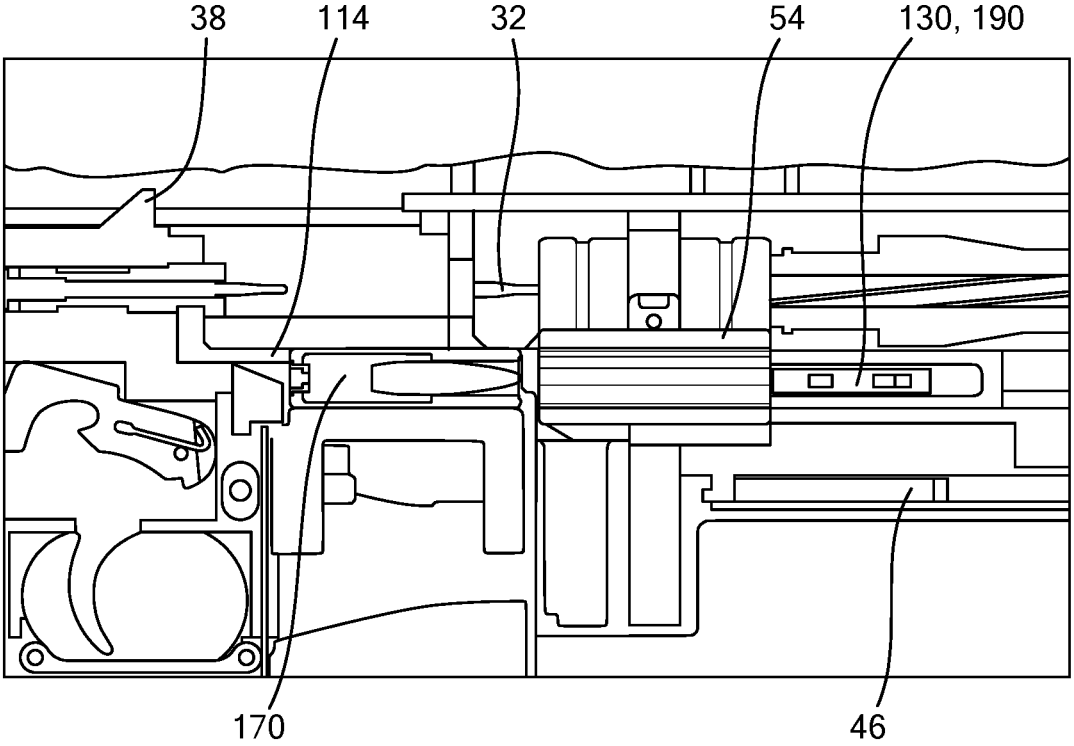
Figure 24:
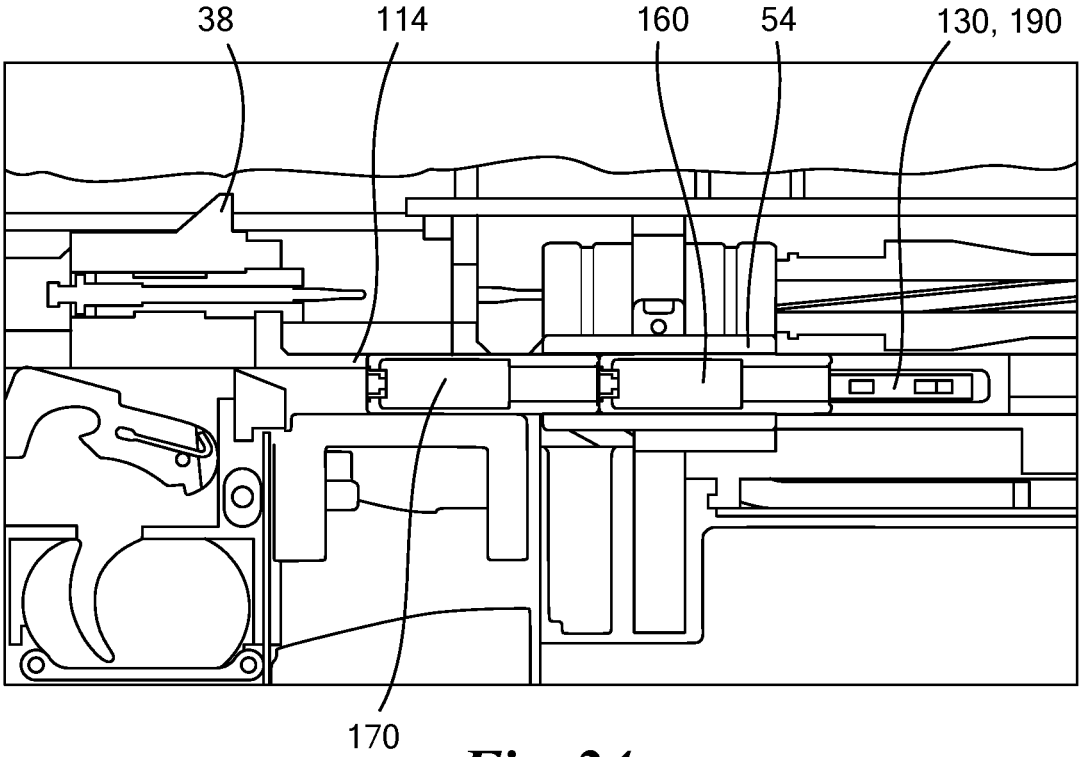
Figure 25:
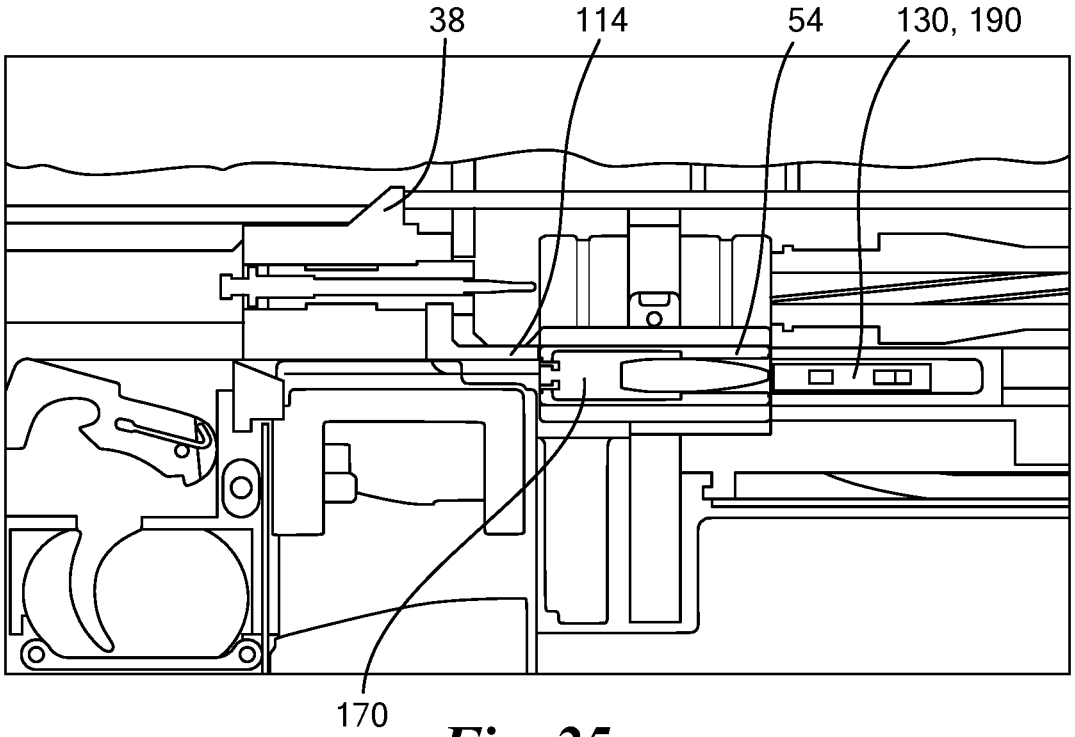

FIGS. 23-25 illustrate counter-recoil, during which the carrier assembly 38 moves forward to return to the battery position for firing a next round. Throughout counter-recoil, the rammer 114 pushes against the rear of the next CT round 170, pushing it into the chamber member 54. This has the effect of loading the next CT round 170 into the chamber 55 while simultaneously ejecting the just-fired "spent" CT round 160 when present (omitted in FIG. 23) by pushing it out the front of the chamber member 54. Action of the ejector 130 on the spent cartridge 160 is described more below. Also throughout counter-recoil, the chamber carrier catch 136 (FIG. 18) engages the chamber carrier catch cutout 86 (FIGS. 10-11) to hold the chamber carrier 58 in the downward ejection/loading position.

Figure 26:
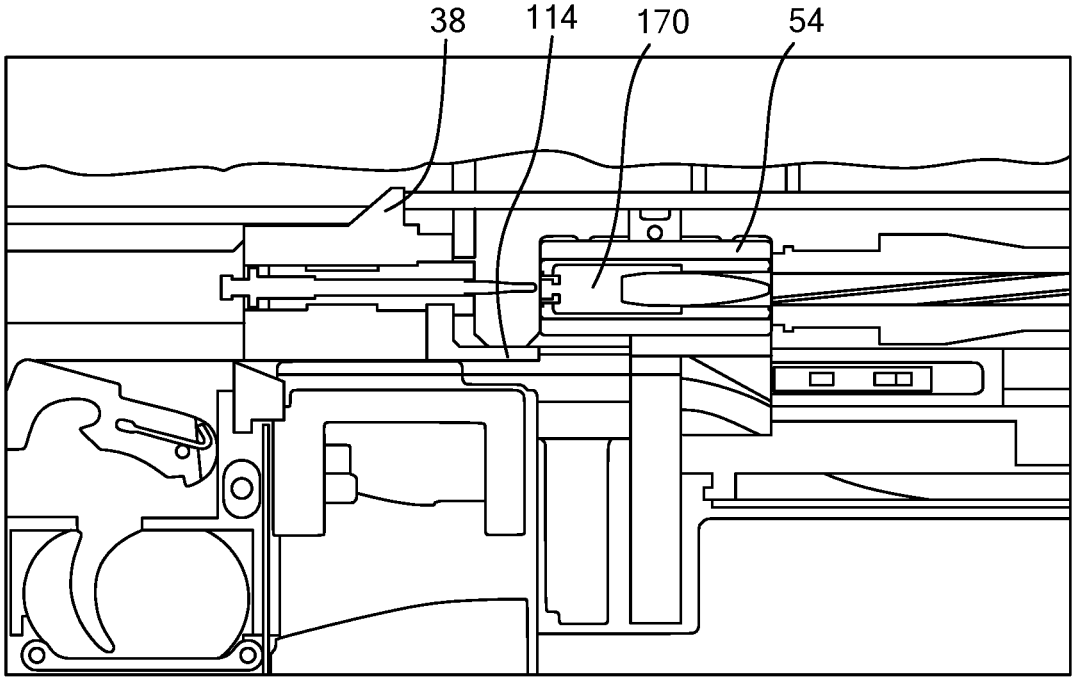

FIG. 26 shows the very end of counter-recoil in which the carrier assembly 38 has returned to the battery position. A feature on the slide 46 has hit the forward protrusion 140 of the chamber carrier catch 136 (FIG. 18) to urge it slightly rearward, allowing the chamber carrier 58 to return upward to the firing position by action of the springs 74 (FIG. 10). The carbine 10 is ready to fire the chambered next CT round 170.

Figure 27:
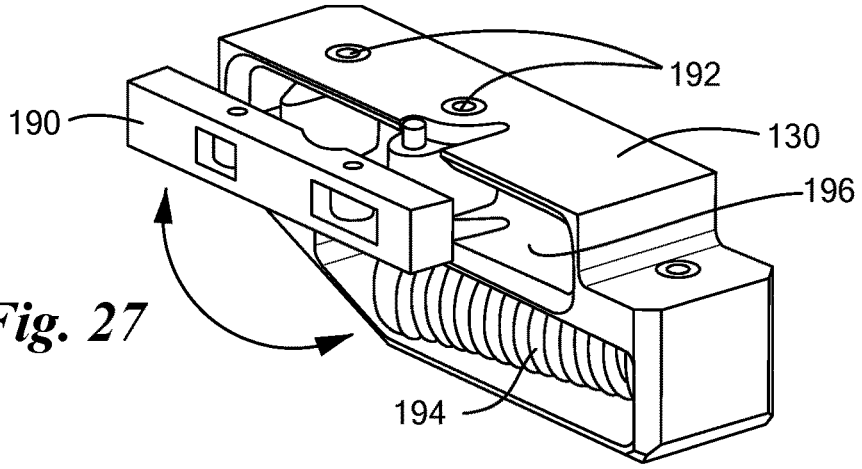
FIG. 27 is a perspective view of an ejector.

FIG. 27 shows the ejector 130, which performs an ejection function as well as a first round stop function. The ejector 130 includes a horizontal bar 190 mounted on two pivots 192 for swiveling movement under a spring load provided by a pivoting spring 194. During operation, the bar 190 travels in an arc as indicated, beginning in a rearward position (upper left in FIG. 27), traveling through the illustrated midway position, and ending in a forward position (lower right in FIG. 27) in which it is nestled within the cavity 196, before returning to the rearward position by spring action. Referring back to FIG. 23, at the start of ramming the bar 190 abuts the front of the chamber member 54 in the ejection/loading position, providing a stop for a cartridge that has been pushed into the chamber 55 (not shown in FIG. 23). As ramming progresses (FIG. 24), the cartridge 160 being ejected pushes against the bar 190, rotating it outward and forward. Once the bar 190 has rotated completely forward and becomes recessed within the cavity 196, the cartridge 160 begins to slide past it, and the spring-loaded bar 190 now exerts an outward force on the cartridge 160. As the bar 190 arcs back to its initial position, it pushes the exiting cartridge 160 out of the ejector assembly 44, ejecting the cartridge from the carbine 10.

Figure 28:
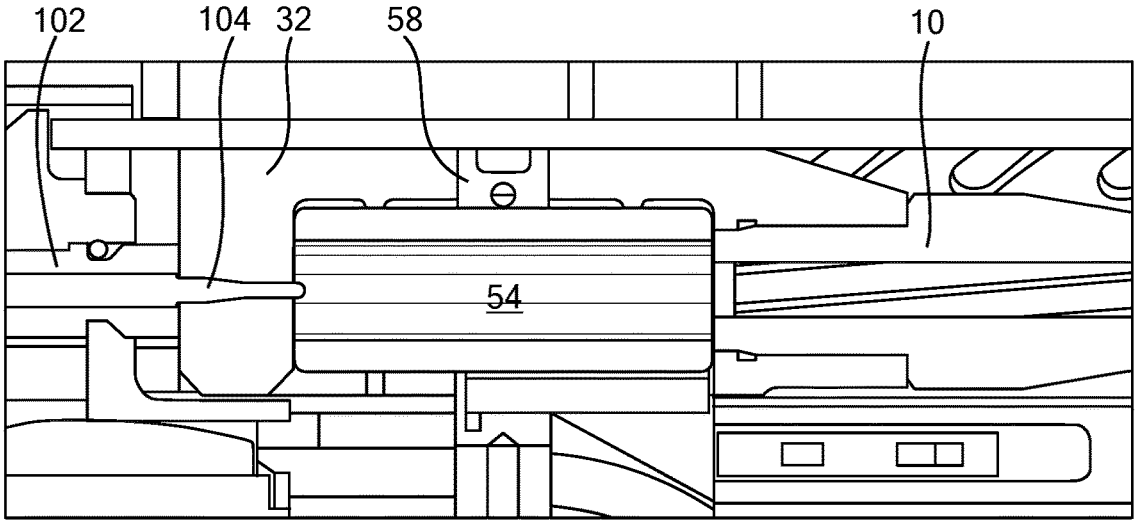
FIGS. 28-29 are side internal views illustrating function of a barrel extension.
Figure 29:
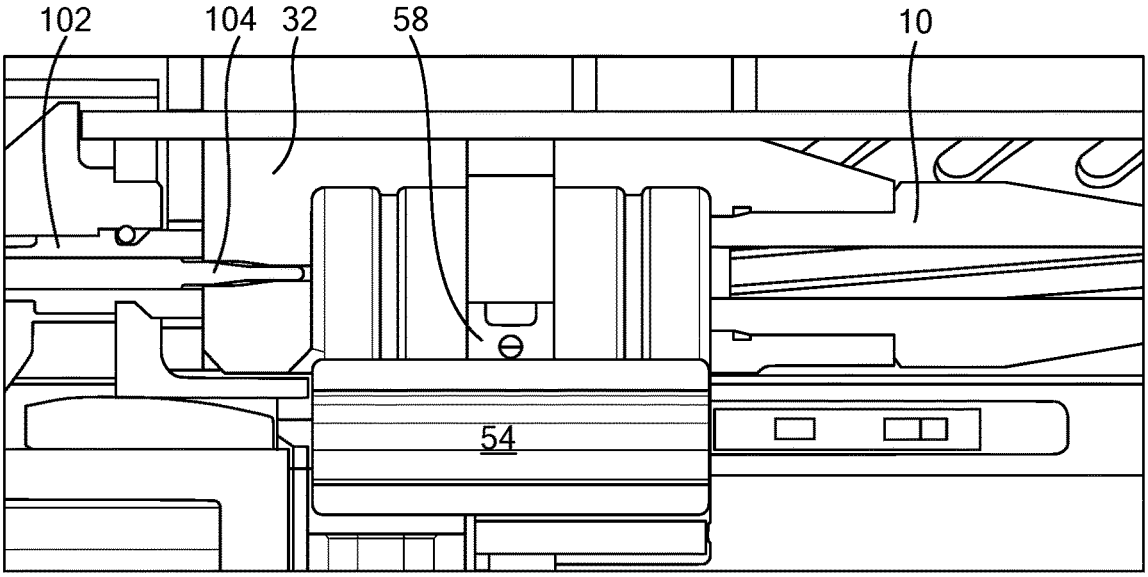

FIGS. 28-29 illustrate functionality of the barrel extension 32. Generally, it aligns the chamber member 54 to the barrel 12 and firing pin 104 via tightly controlled diametrical ribs 62, as described above. The springs 74 of the chamber assembly 42 provide upward pressure, keeping the chamber member 54 in place. The barrel extension 32 also inhibits lateral and axial motion of the chamber member 54 and chamber carrier 58 during ramming. Additionally, it controls protrusion of the firing pin 104 (in combination with the protrusion insert 102), sets headspace (in combination with the barrel 10), and guides the gas piston 36 (with the upper receiver 14).

Figure 30:
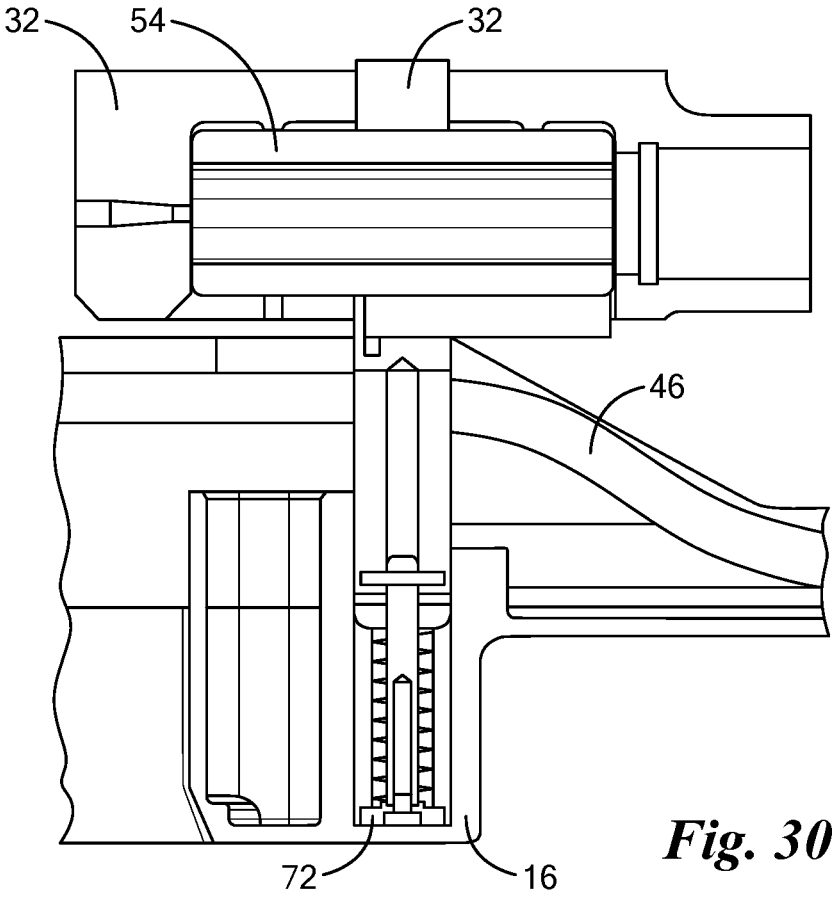
FIGS. 30-31 are side internal views illustrating chamber carrier movement in response to motion of a slide.
Figure 31:
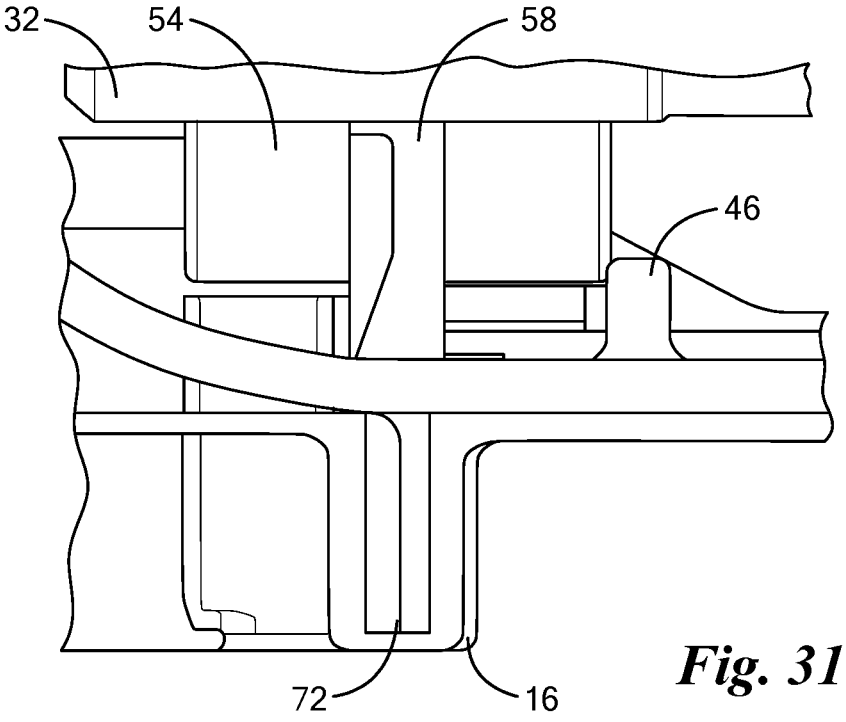

FIGS. 30 and 31 illustrate additional details regarding retention of the chamber carrier 58. It is axially and laterally controlled in the barrel extension 32. It is vertically controlled at its top by the slide 46, the camber carrier catch 136 (not shown) or the chamber member 54 in the barrel extension 32 depending on the phase of operation (recoiling, ramming, or firing). It is vertically controlled at its bottom by the base plate 72 and the lower receiver 16.

Figure 32:
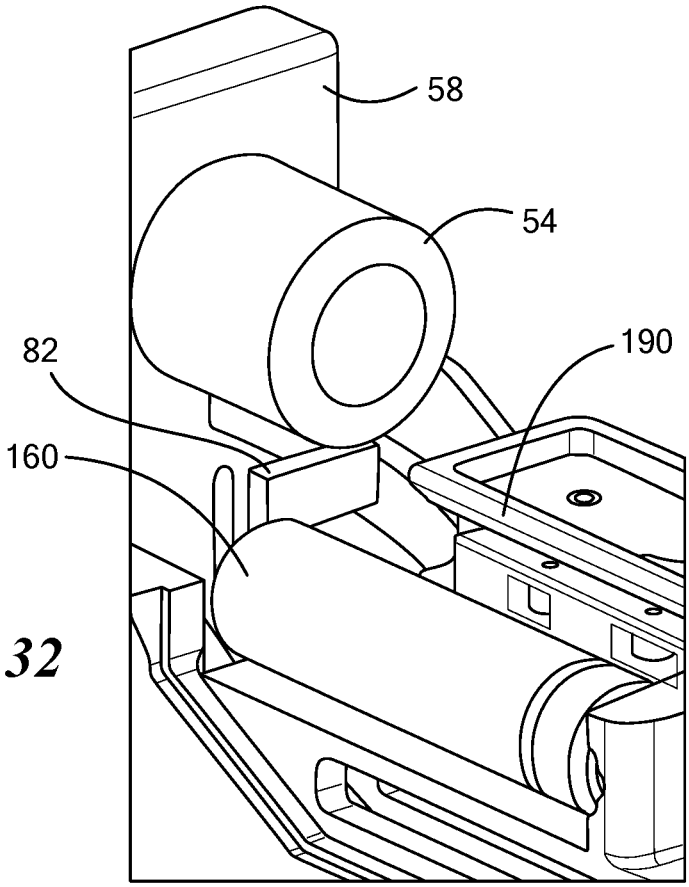
FIG. 32 is a perspective view of a front round stop and related structure.
Figure 33:
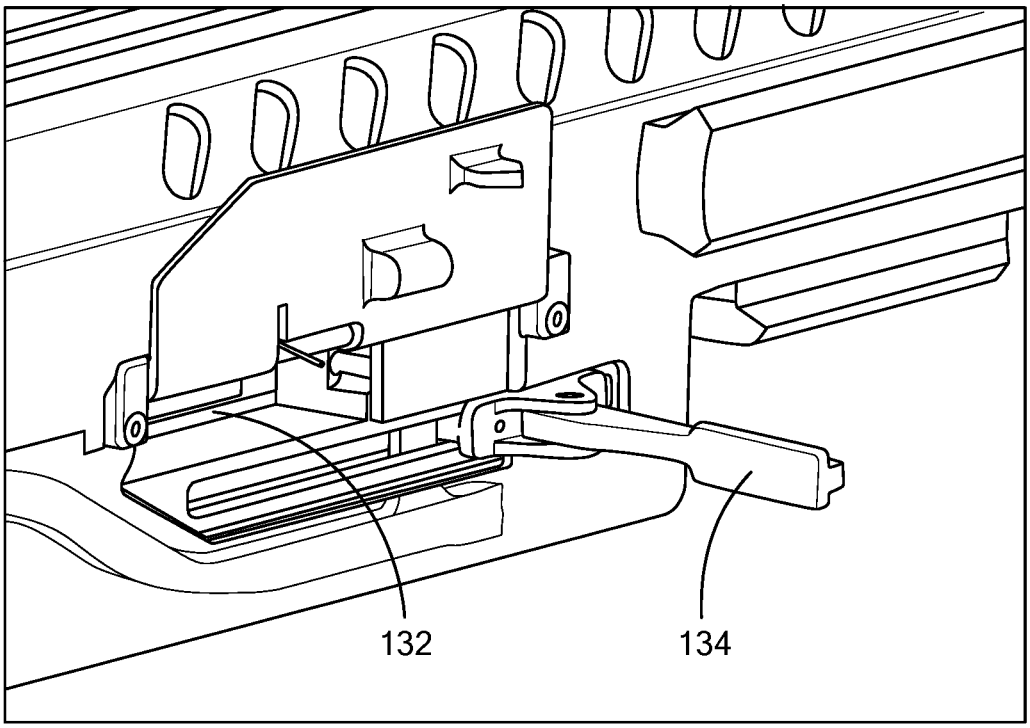
FIGS. 33-36 are perspective views of an ejector assembly showing a clearing rod in operation.

FIG. 32 illustrates function of the front round stop 82. When the chamber member 54 is in the illustrated upward firing position, the front round stop 82 prevents rearward motion of a spent cartridge 160 that is being ejected by outward motion of the ejector bar 190, which is explained above. This prevents the weapon from jamming due to the spent cartridge 160 backing under a lowering chamber member 54 if ejection fails.

Figure 34:
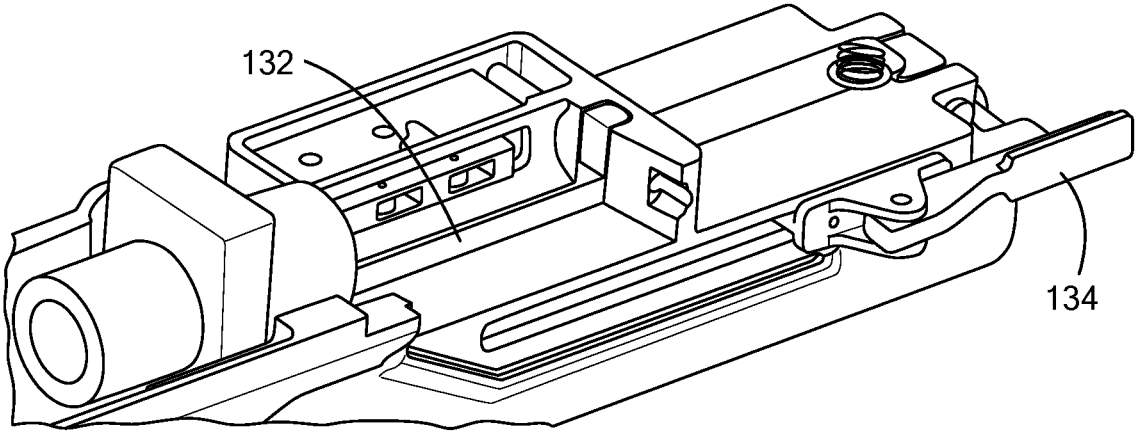
Figure 35:
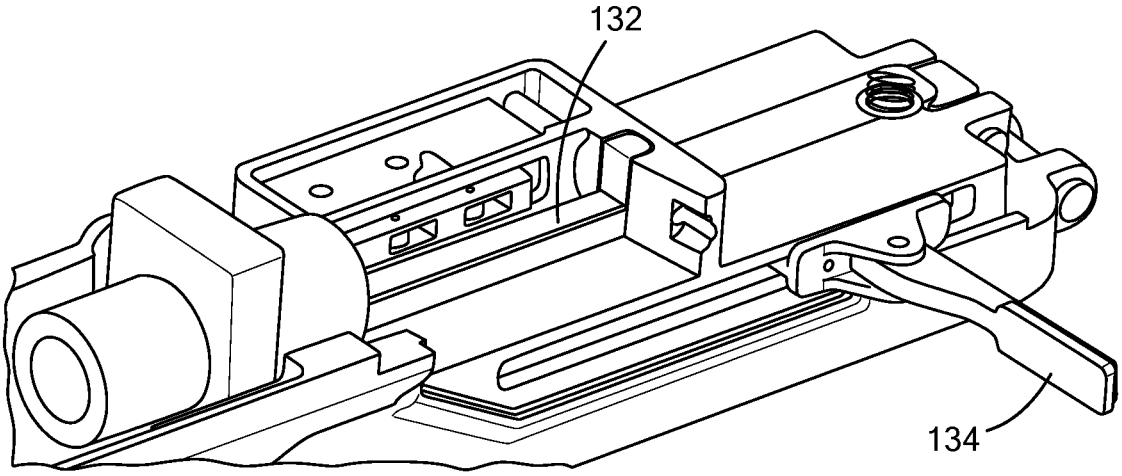
Figure 36:
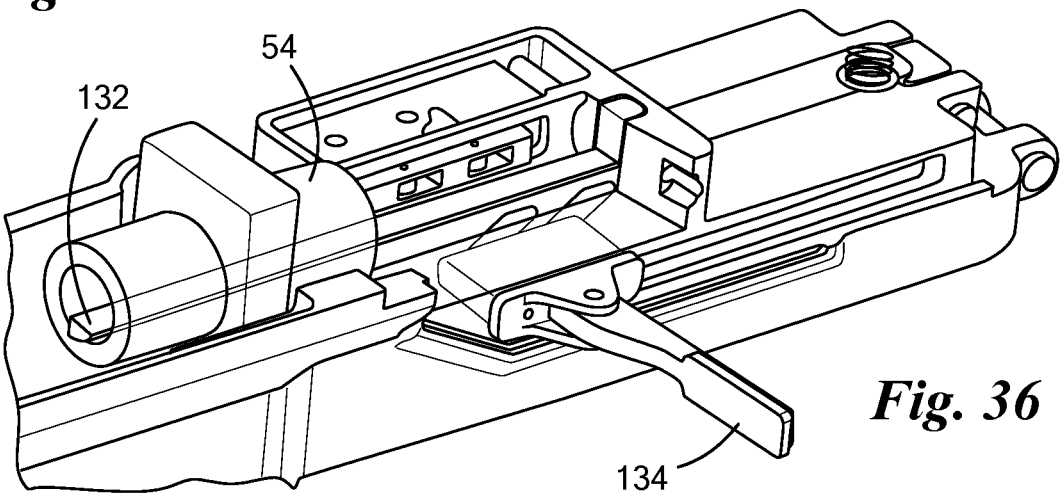
Figure 37:
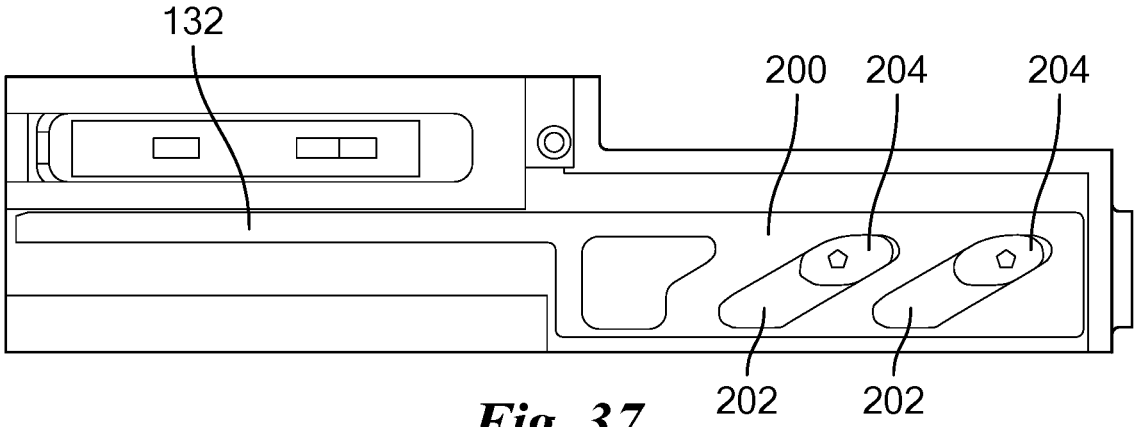
FIGS. 37-40 are side internal views of the ejector assembly showing the clearing rod in operation.
Figure 38:
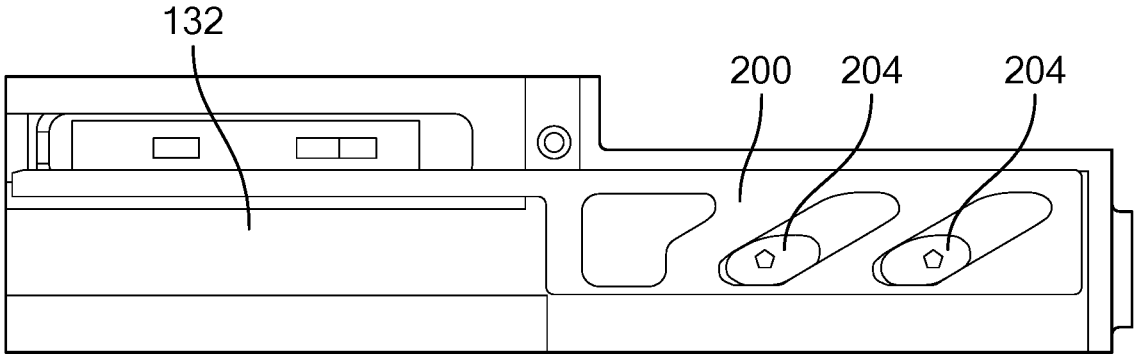
Figure 39:
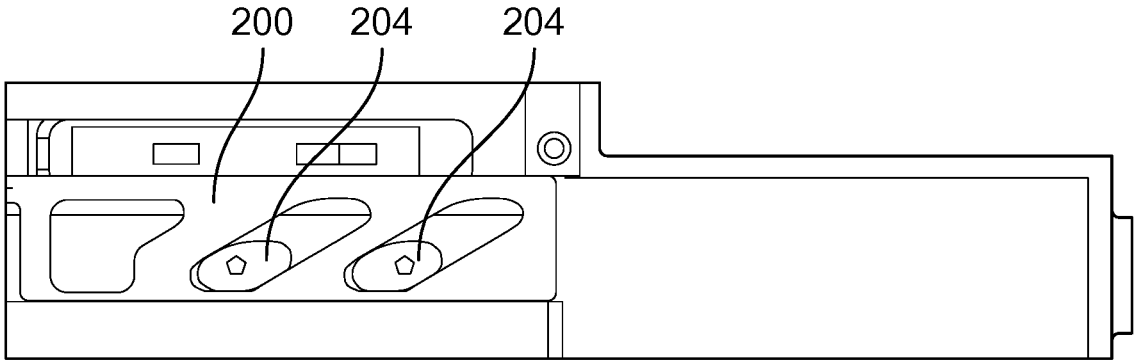
Figure 40:
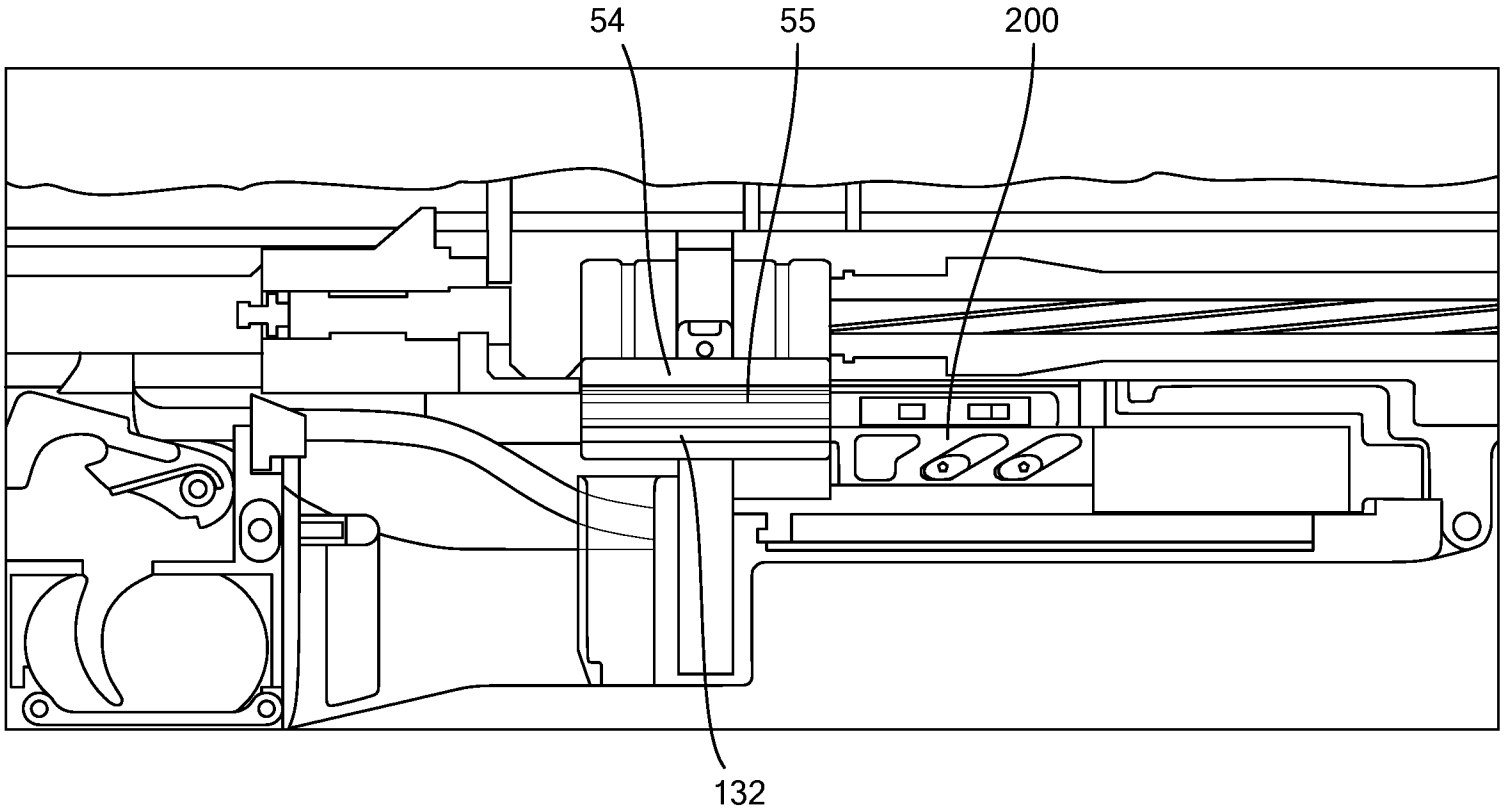

FIGS. 33-40 describe operation of the clearing rod components of the ejector assembly 44, including the clearing rod 132 and clearing handle 134. FIGS. 34-36 show externals, while FIGS. 37-40 show internals. First, the clearing handle 134 is rotated outward, then pulled rearward toward the operator, to the position shown in FIG. 36. In that position as shown, the clearing rod 132 has been pulled completely through the chamber member 54, pushing out any spent or unfired cartridge in the rearward direction. FIGS. 37-39 show that the clearing rod 132 is an extension of a member 200 having slanted openings 202 that ride on cams 204, which are secured to the same slide-like member to which the clearing handle 134 is mounted. FIG. 37 illustrates a stowed position, corresponding to FIG. 34. When the clearing handle 134 is pulled rearward, the first movement of the member 200 is upward, bringing the clearing rod 132 into alignment with the chamber 55 (FIG. 40). Then the cams 204 contact the lower-right surfaces adjacent the openings 202 (FIGS. 38-39) and drag the member 200 rearward.

Figure 41:
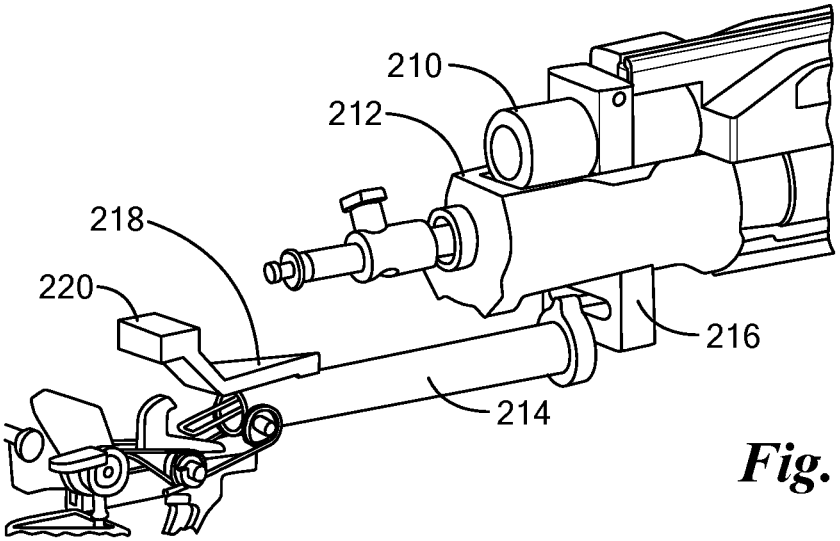
FIGS. 41-43 are perspective views of a rotational drive mechanism for controlling linear chamber carrier movement.
Figure 42:
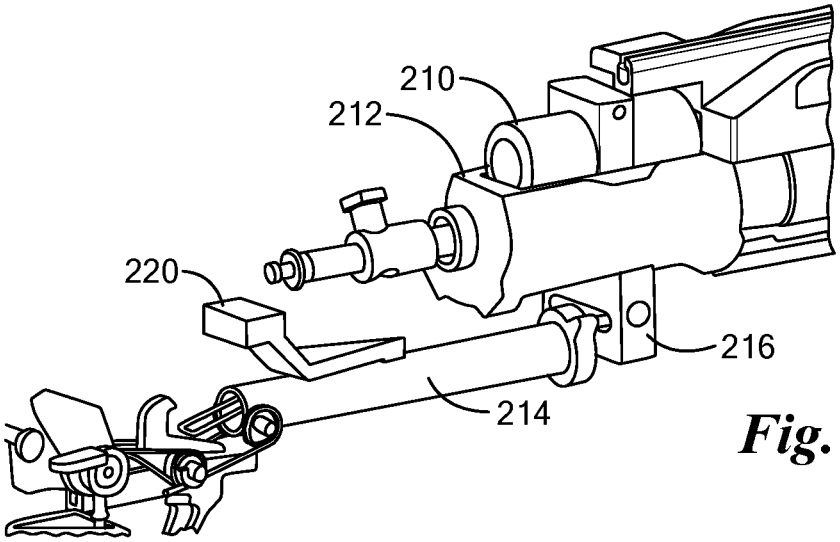
Figure 43:
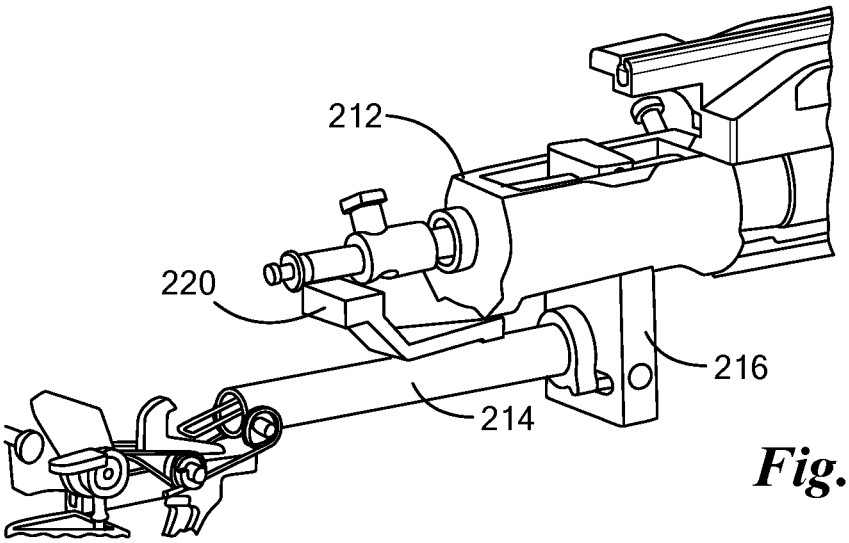
Figure 44:
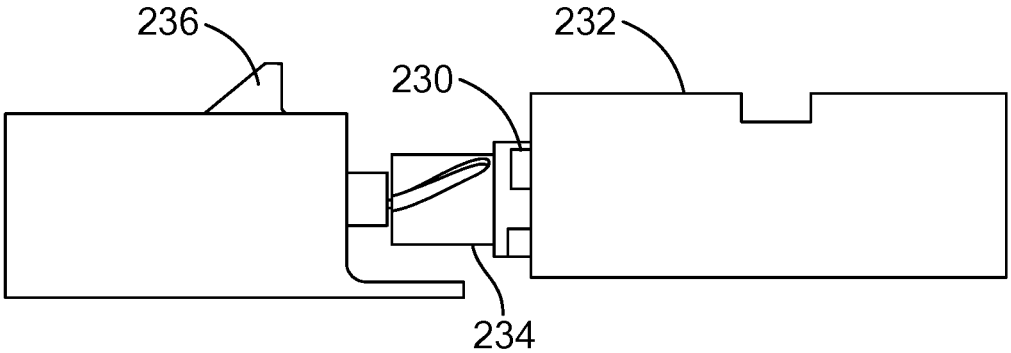
FIGS. 44-50 are views illustrating a first headspace reduction technique.

FIGS. 41-43 describe an alternative arrangement for vertical movement of a chamber member 210. In the arrangement, the chamber member 210 is moved downwardly from an ejection/loading position (FIG. 41) to a firing position within a barrel extension 212 (FIG. 43). One end of a rotating shaft 214 engages a slotted opening of the chamber carrier 216. The shaft 214 has an arcuate groove (not shown) into which a corresponding foot member 218 of a carrier 220 is disposed. Linear movement of the carrier 220 during operation causes corresponding rotational movement of the shaft 214. The progression of FIGS. 41-43 shows counter-recoil, during which the carrier 220 is moving forward. The shaft 214 rotates to the right as shown, moving the chamber carrier 216 downward. It will be appreciated that during recoil the movement is exactly the opposite, bringing the chamber member 210 from the firing position to the ejection/loading position. One difference between this arrangement and that described above is the fully direct relationship between the linear position of the carrier 220 and the vertical position of the chamber member 210—there are no separate springs or latches as in the above arrangement. This direct mechanical linkage necessitates use of a disconnecting rammer, i.e., a rammer whose forward motion stops at the instant shown in FIG. 41 and then disconnects from the carrier 220 to permit the carrier 220 to continue forward and drive the chamber 210 downward. In the contrasting arrangement described above, the carrier 100 and rammer 114 stop together, and the return of the chamber member 54 to the firing position is achieved by the springs 74 upon release of the chamber carrier catch 136.

FIGS. 44-52 illustrate a first technique for controlling/reducing "headspace", which is empty space adjacent to the front and/or rear of a chambered cartridge.

Figure 45:
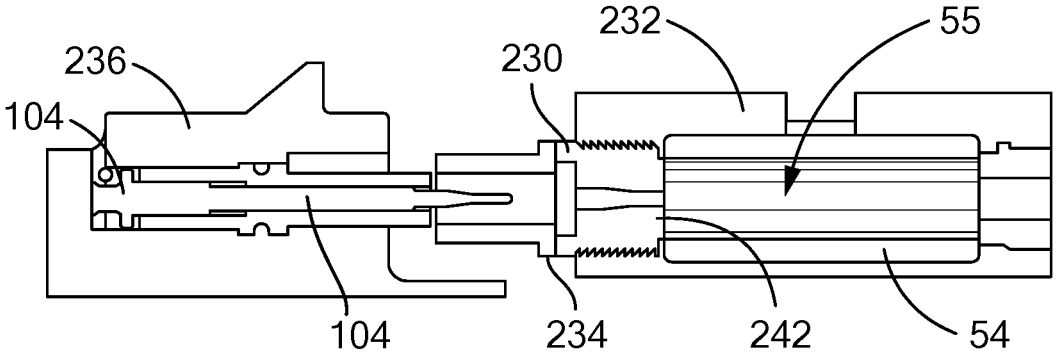
Figure 46:
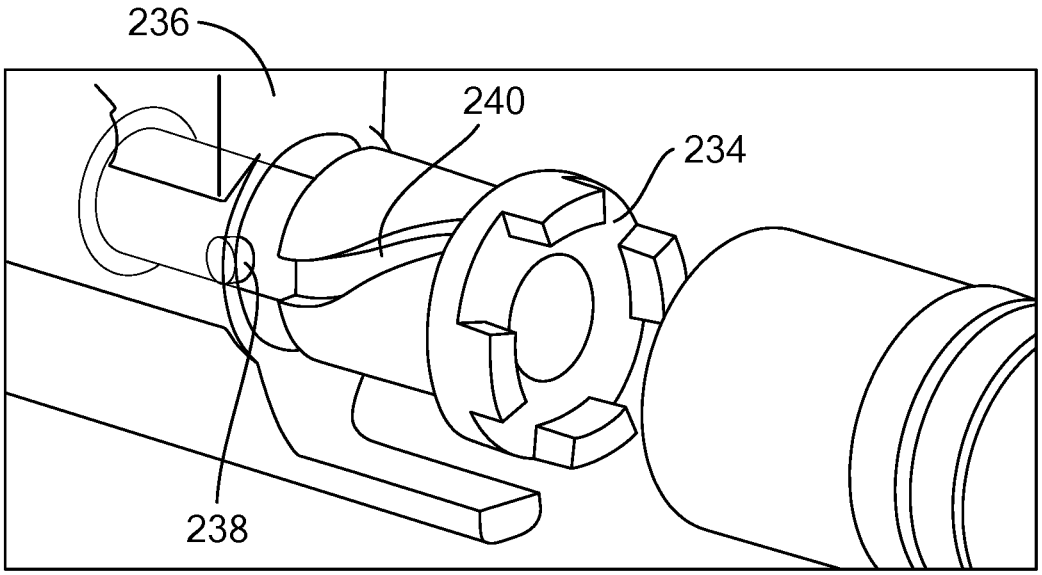
Figure 47:
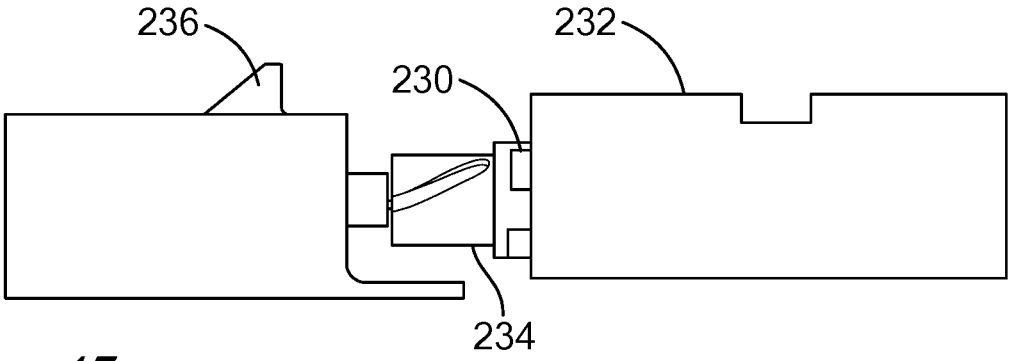
Figure 48:
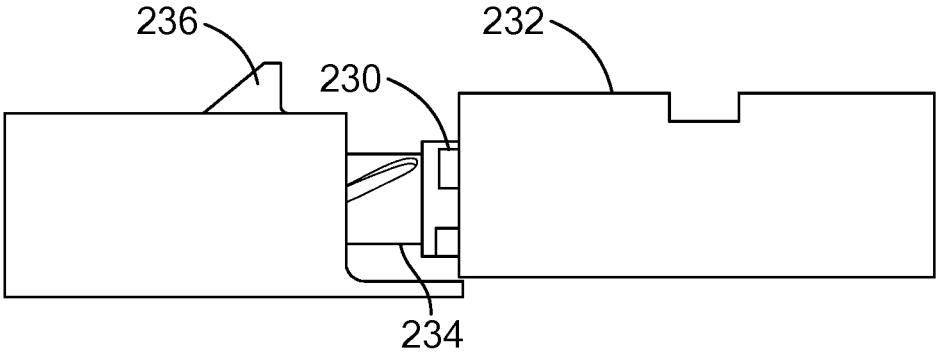
Figure 49:
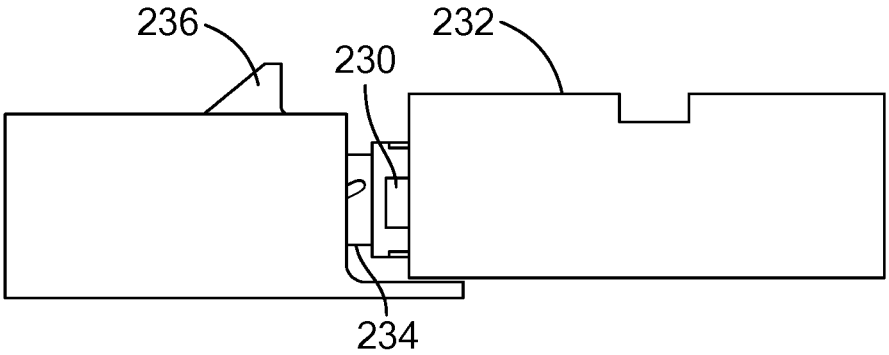
Figure 50:
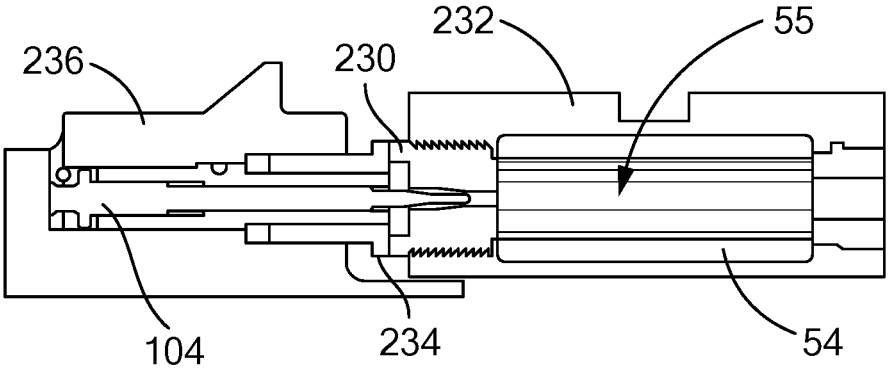

FIGS. 44-50 illustrate a first headspace reduction technique. A cylindrical breech 230 is screwed into the rear of the barrel extension 232, and mates with a breech actuator 234 via interlocking lugs as shown. As best seen in FIG. 46, the carrier 236 has an inward-facing boss 238 that engages with a corresponding arcuate groove 240 of the breech actuator 234. In operation, as the carrier 236 moves forward in counter-recoil, this camming of the boss 238 and groove 240 cause the breech actuator 234 to rotate. As best seen in FIG. 45, the breech 230 has a slight raised portion 242 whose diameter is equal to that of the chamber 55 (inner diameter of chamber member 54). Rotation of the breech 230 moves this portion 242 into the rear end of the chamber 55, closing any headspace at the ends of a chambered cartridge (not shown). FIGS. 47-50 illustrate three points in the recoil movement, with FIG. 50 illustrating the final (battery) position in cutaway.

Figure 51:
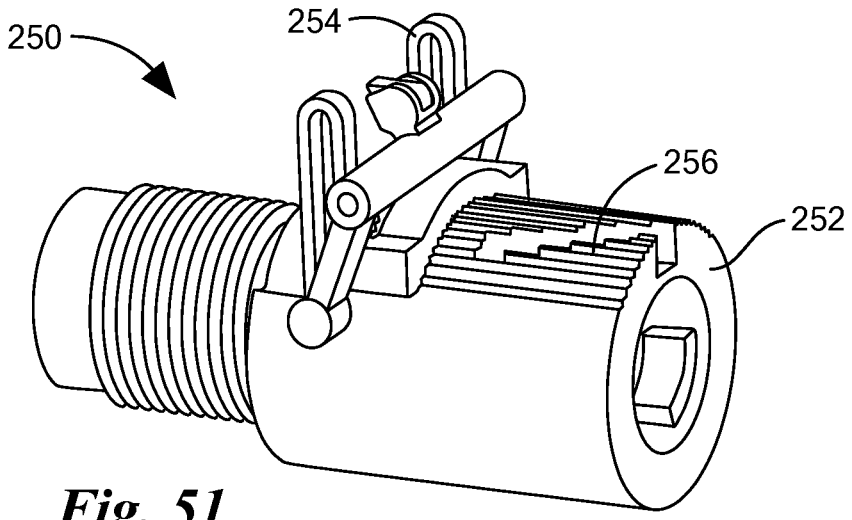
FIGS. 51-58 are views illustrating a second headspace reduction technique.
Figure 52:
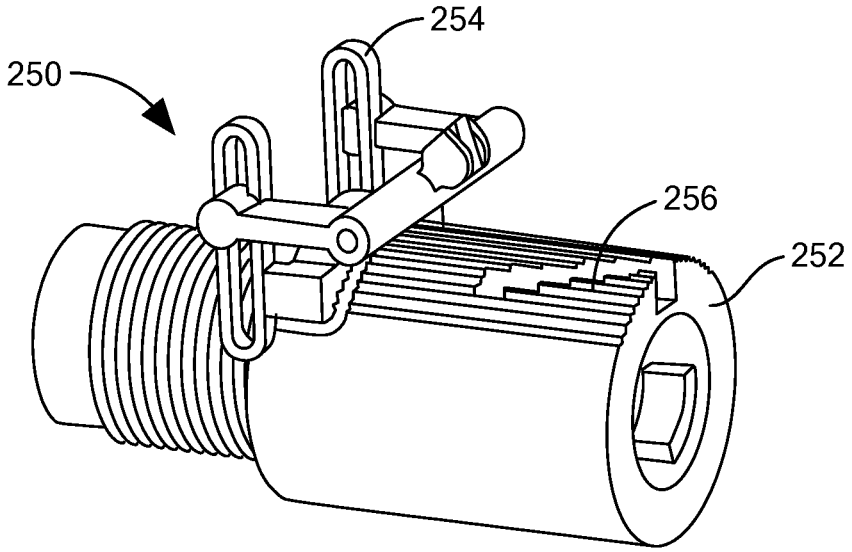
Figure 53:
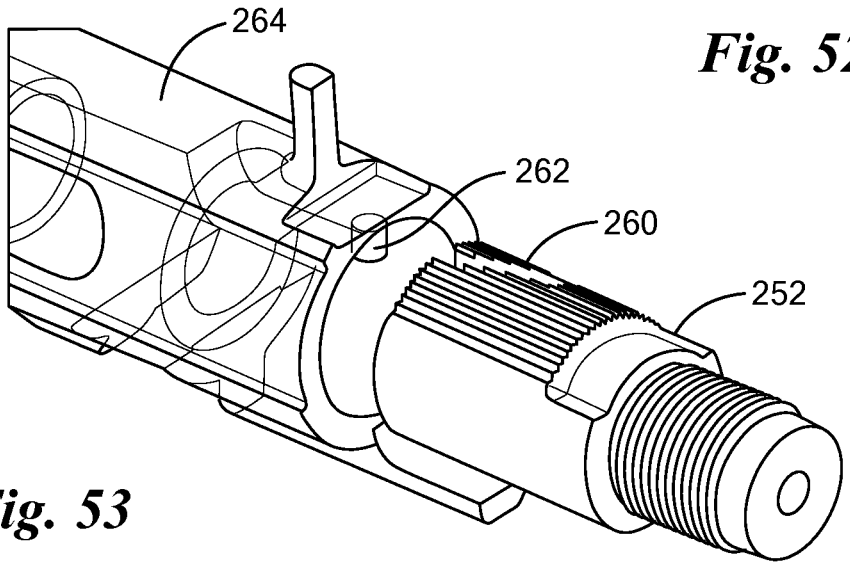
Figure 54:
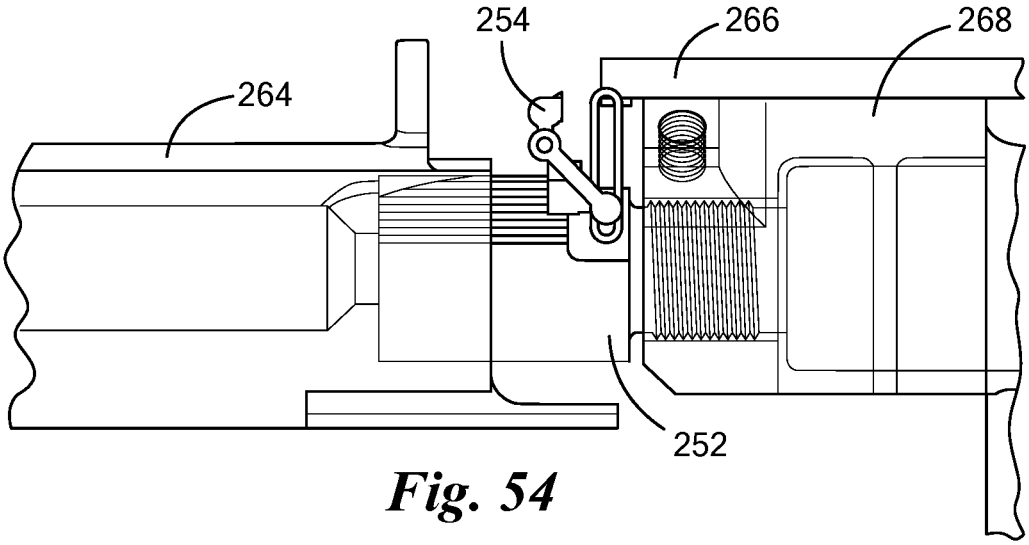

FIGS. 51-58 illustrate a second headspace reduction technique, which employs a ratchet mechanism 250 including a rotatable breech 252 and a latching clamp 254. As shown, the breech 252 includes outer teeth 256 that mate with corresponding teeth of the clamp 254. These teeth are mutually configured to permit clockwise rotation of the breech 252 (into the barrel extension) while preventing counter-clockwise rotation (out of the barrel extension), while the clamp 254 is closed and the teeth engaged. The clamp 254 pivots to open and close—FIG. 51 shows the closed position and FIG. 52 shows the open position. As shown in FIG. 53, the breech 252 has an arcuate groove 260 that mates with a corresponding inward-facing roller 262 on the carrier 264, forming a camming arrangement by which the breech 252 is rotated by linear movement of the carrier 264. It will be appreciated that FIGS. 51-52 show the ratchet mechanism 250 facing in the direction opposite that shown in FIGS. 53-58.

Figure 55:
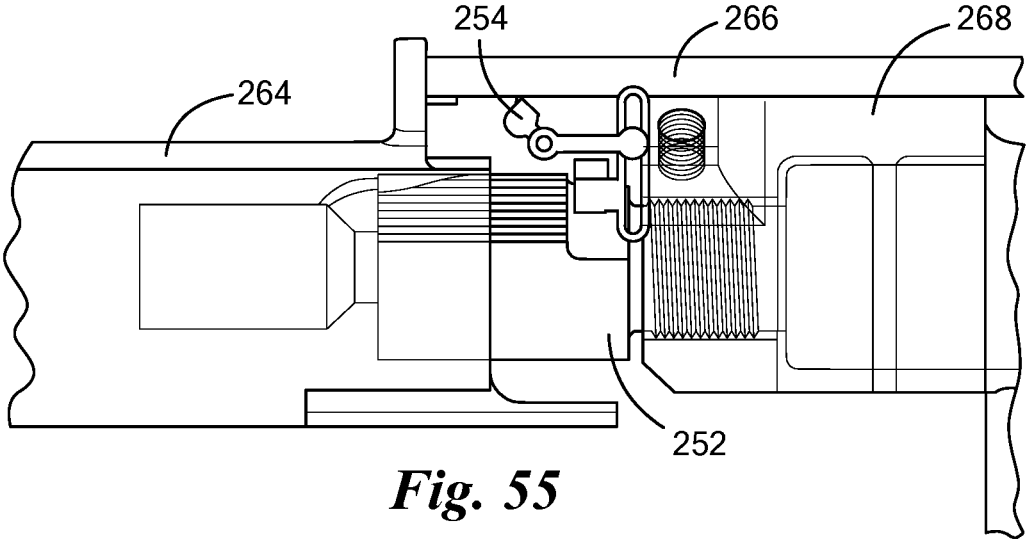
Figure 56:
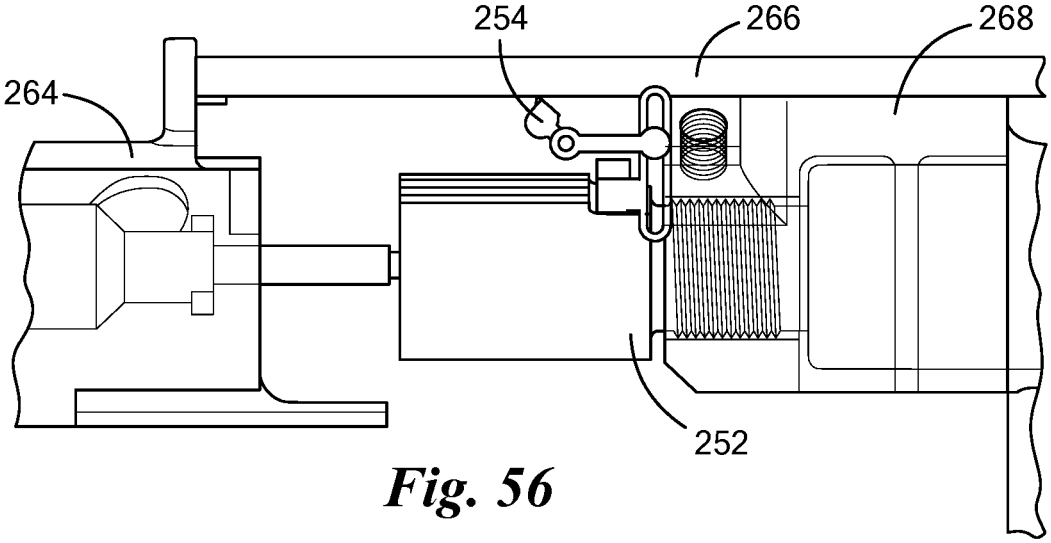
Figure 57:
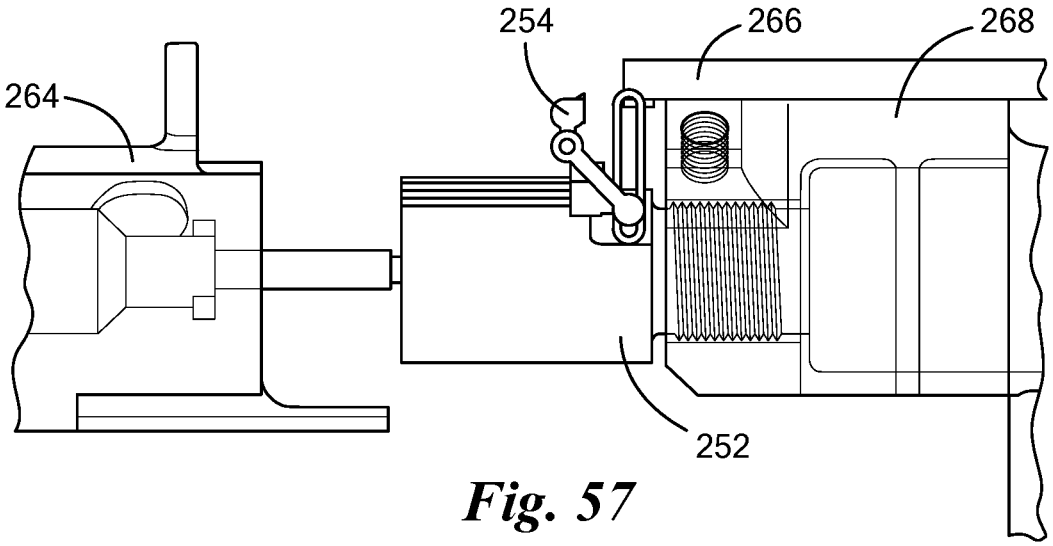
Figure 58:
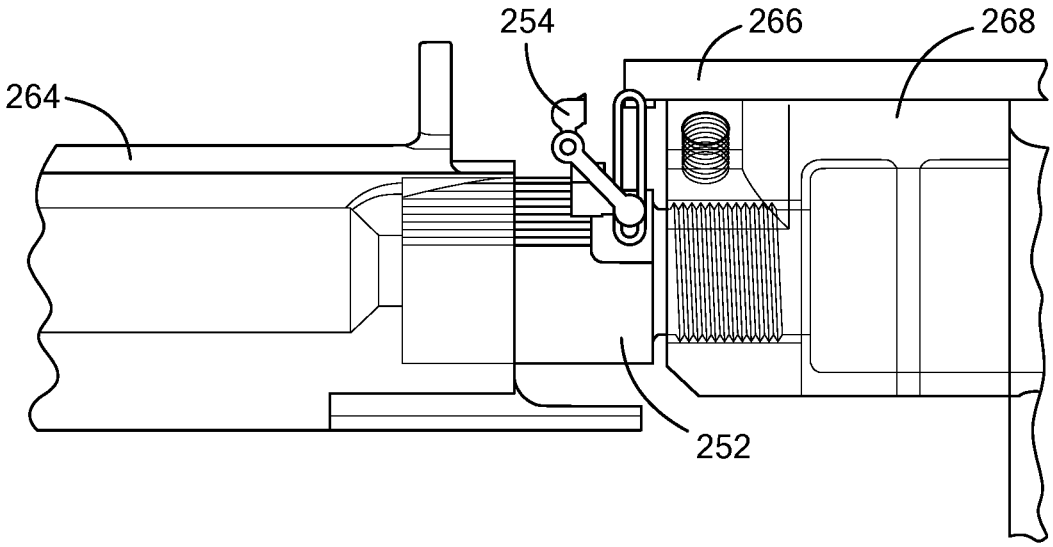
Figure 59:
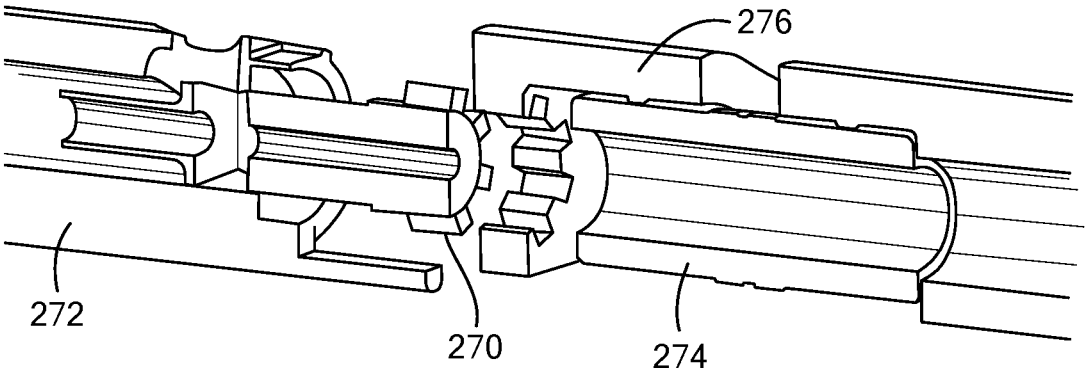
FIGS. 59-62 are views illustrating a third headspace reduction technique.
Figure 60:
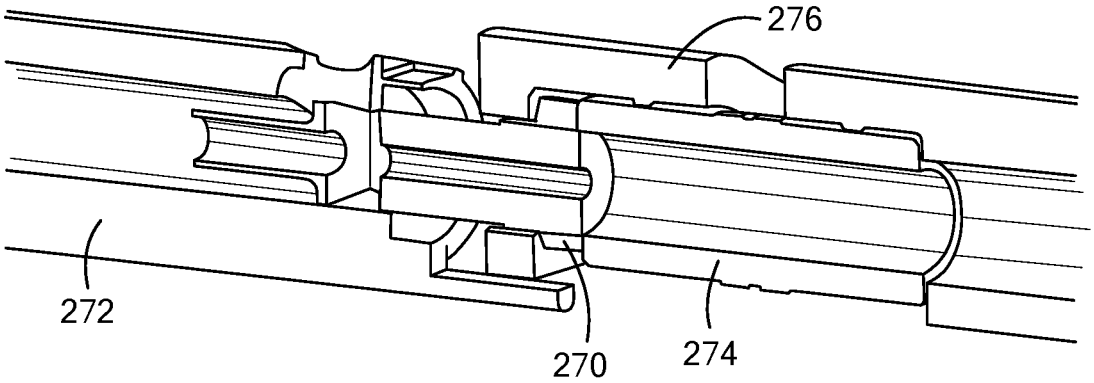

FIGS. 54-58 show operation, beginning with the carrier 264 in the battery position and the clamp 254 set, preventing the breech 252 from rotating CCW. FIGS. 55-56 illustrate recoil, in which the gas piston 266 slides across the upper part of the clamp 254, causing it to open by lifting its toothed portion away from the breech 252 as shown. FIG. 56 shows the end of recoil, in which the rearward movement of the carrier 264 has caused the breech 252 to rotate counter-clockwise (CCW) slightly out of the barrel extension 268. FIGS. 57-58 illustrate counter-recoil, which begins with both the gas piston 266 and clamp 254 being reset into the illustrated positions, re-setting the clamp 252 so that the teeth of the clamp 254 and breech 252 re-engage with each other. FIG. 58 shows the end of counter-recoil, in which the breech 252 has been rotated slightly CW into the barrel extension 268, closing up headspace around the chambered cartridge.

Figure 61:
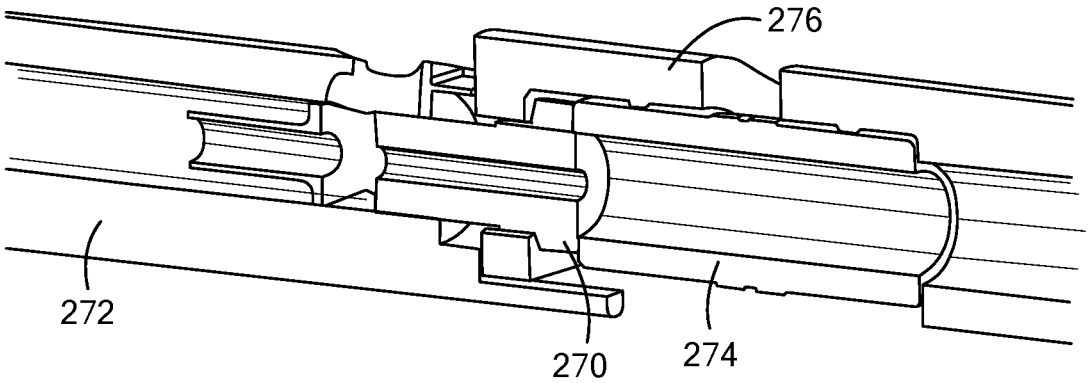
Figure 62:
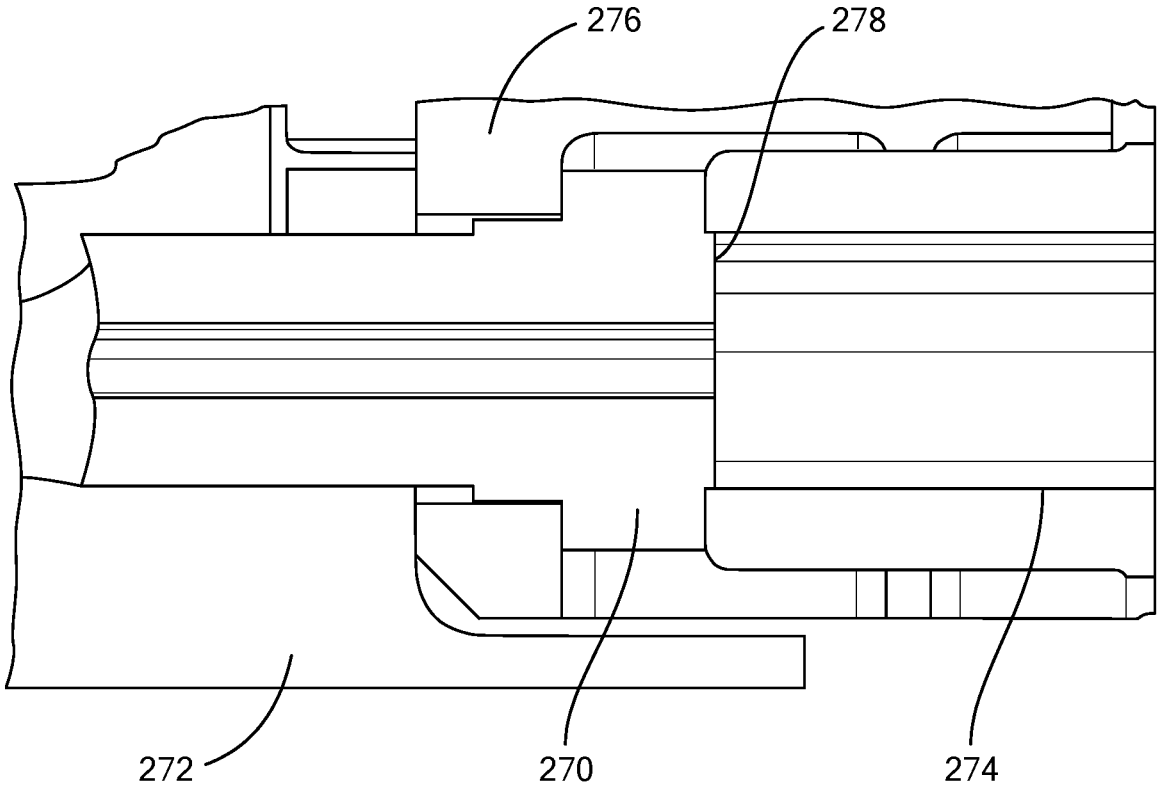
Figure 63R:
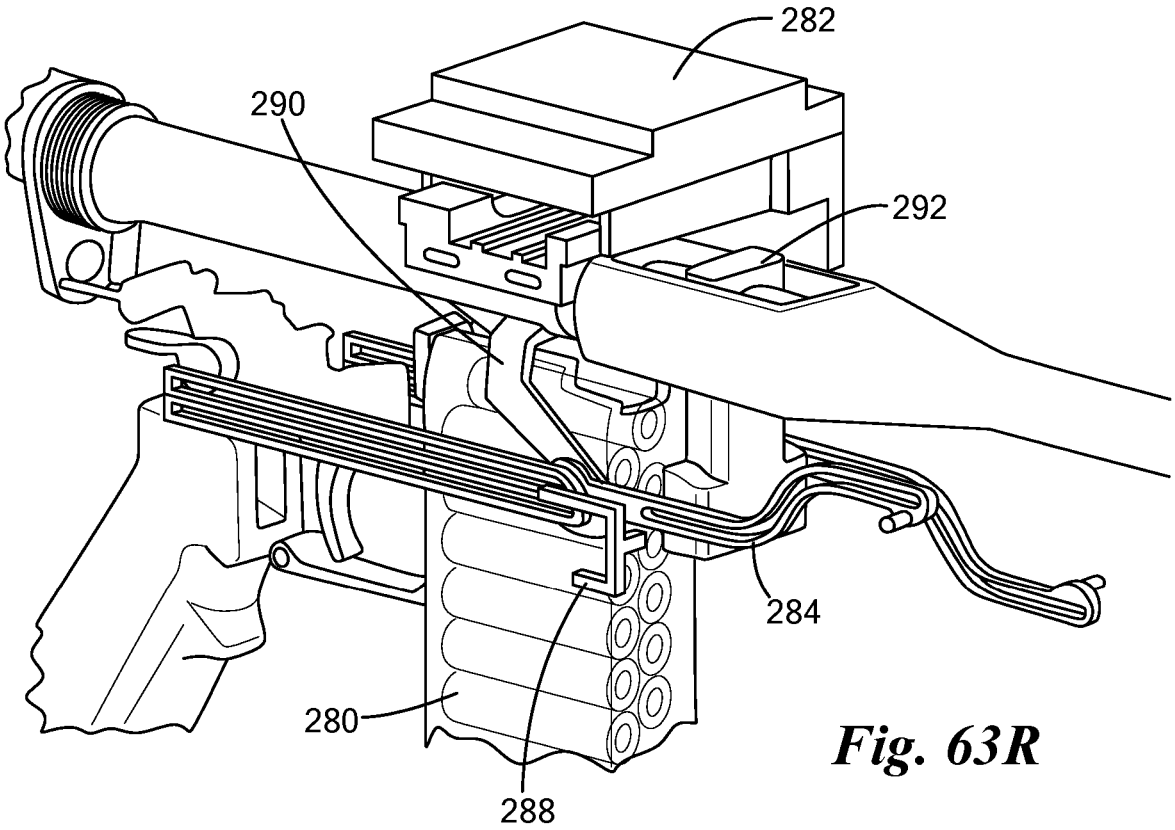
FIGS. 63R-68L are views illustrating a first dual feed mechanism.
Figure 63L:
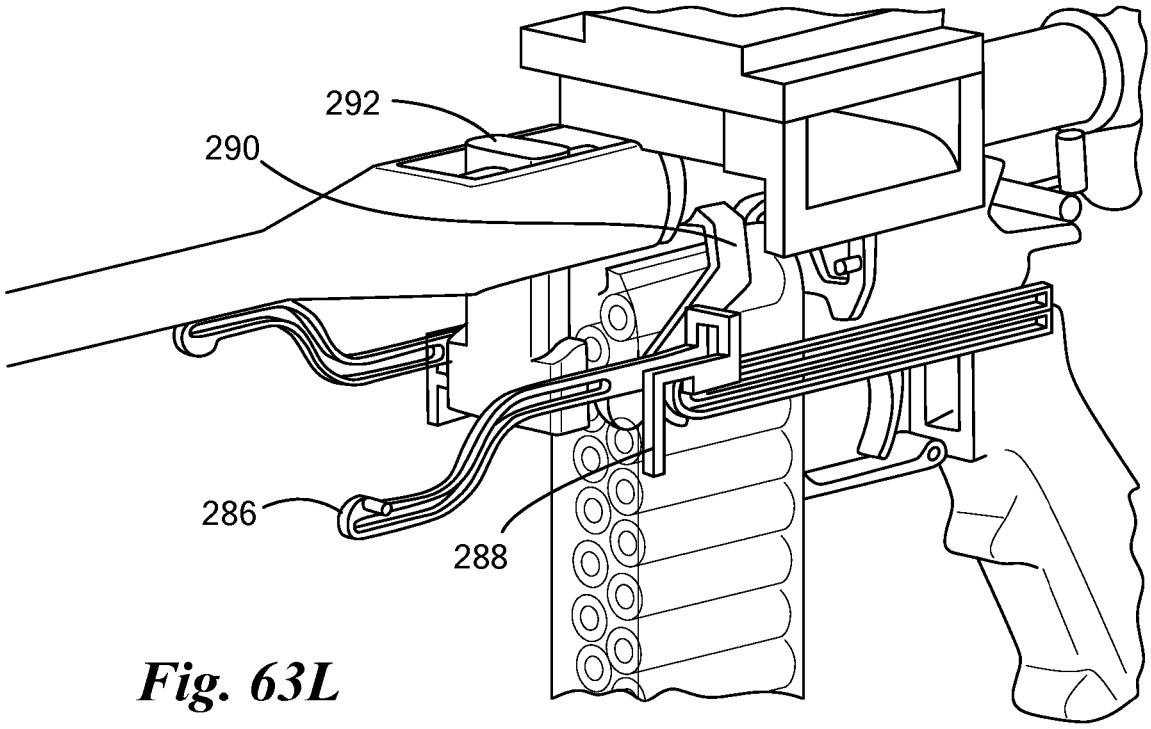
Figure 64R:
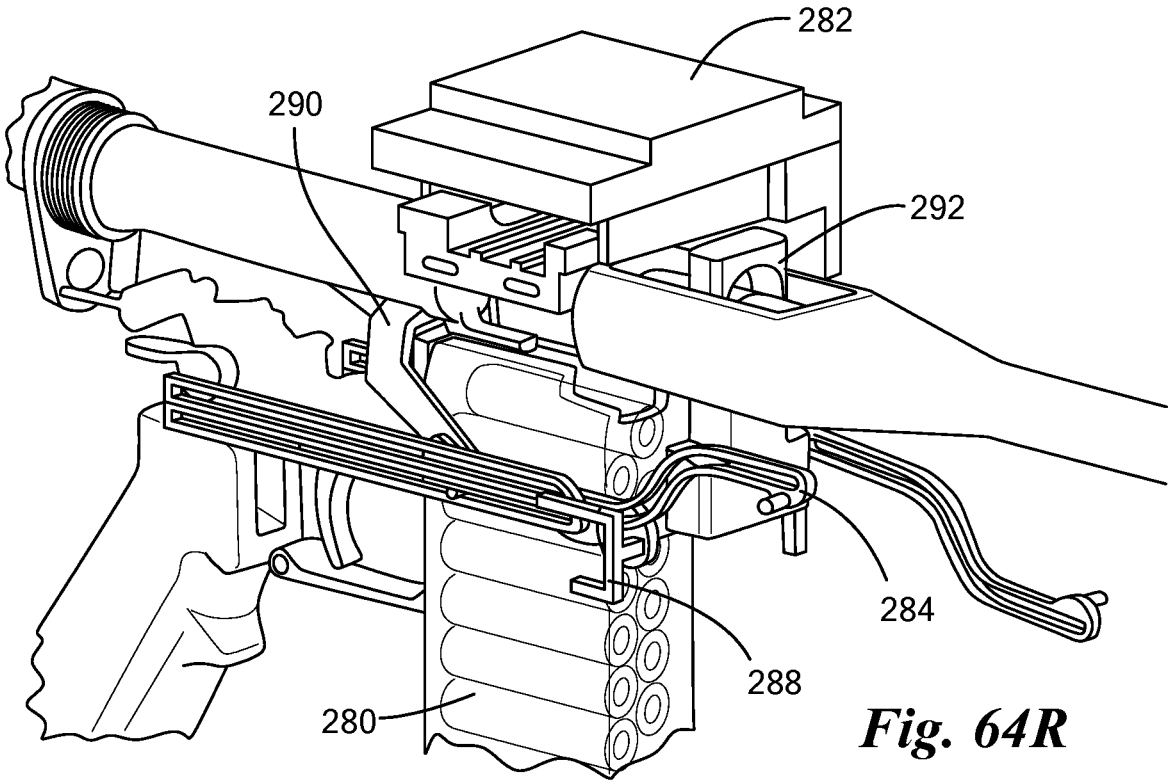
Figure 64L:
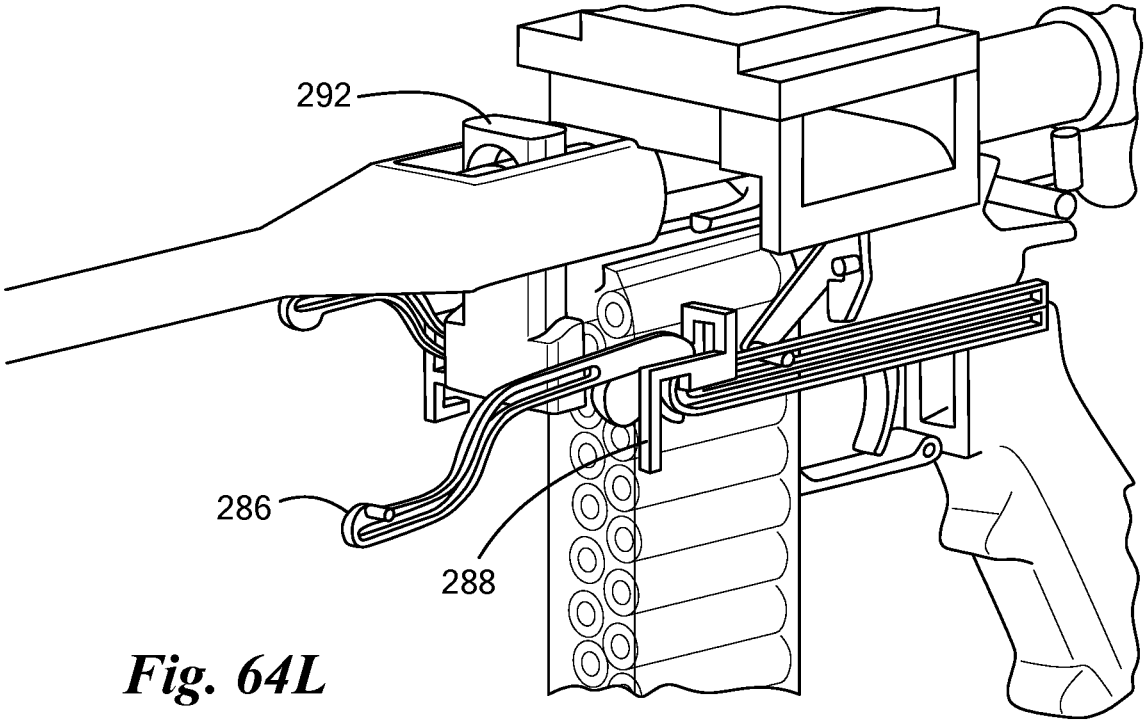
Figure 65R:
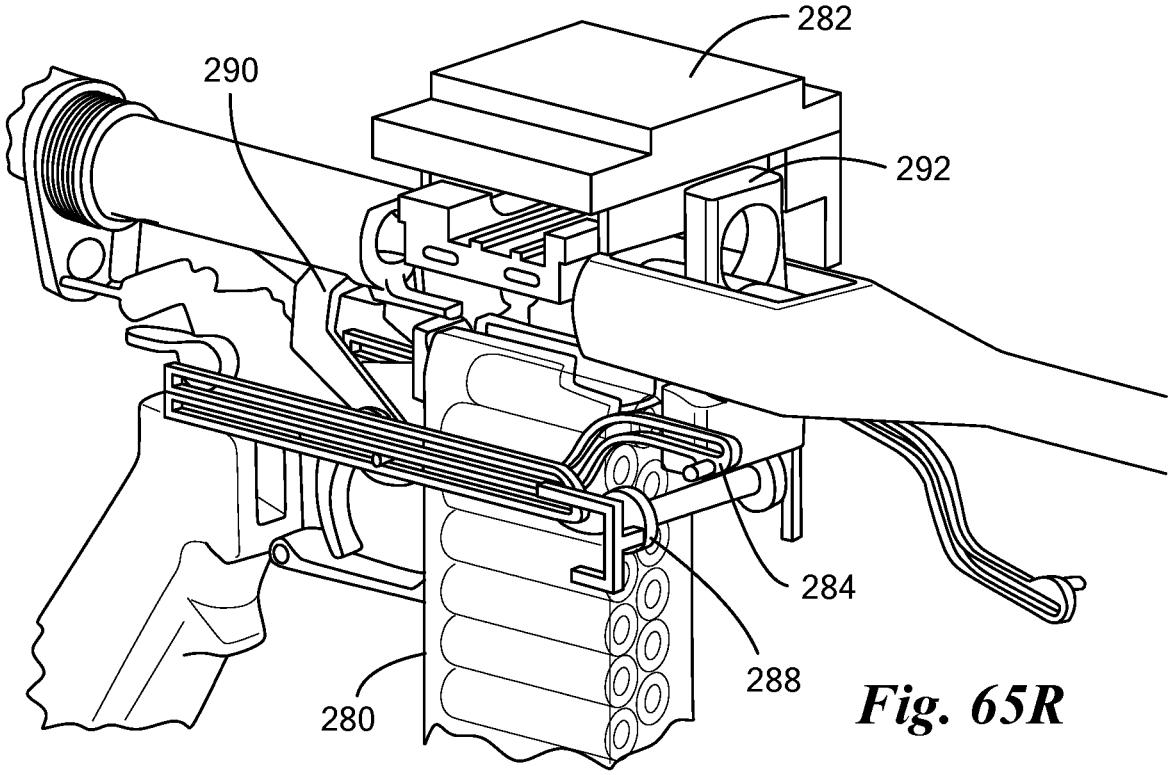
Figure 65L:
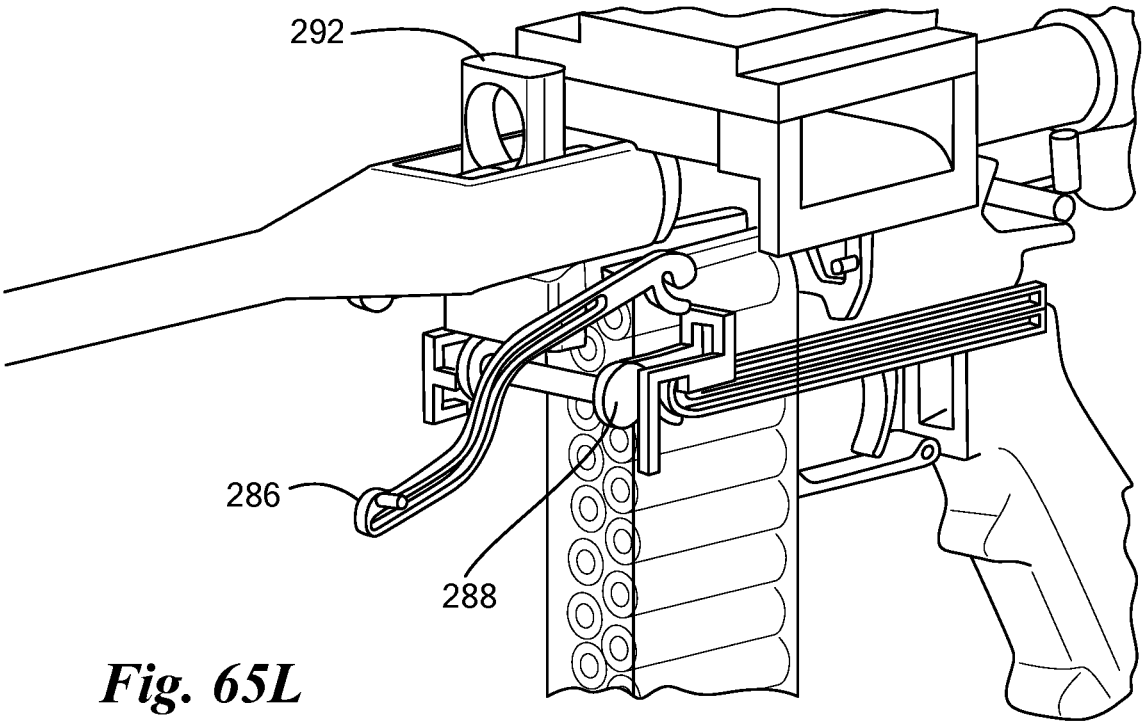
Figure 66:
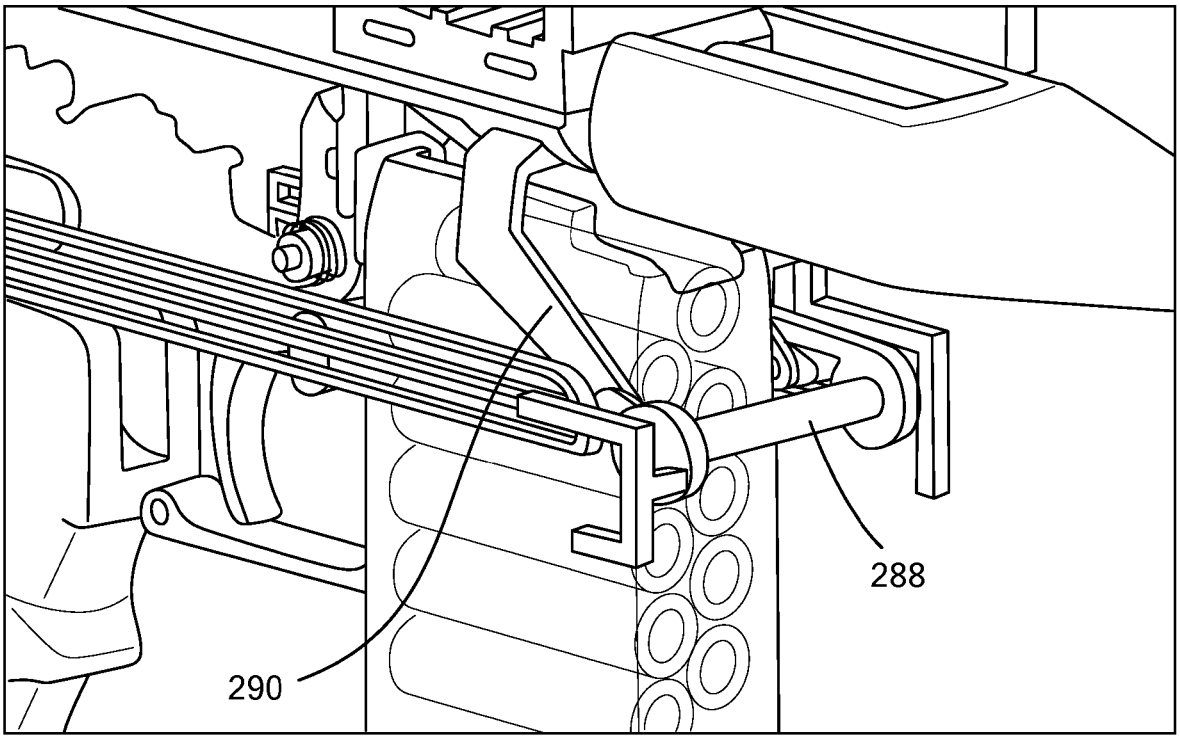
Figure 67R:
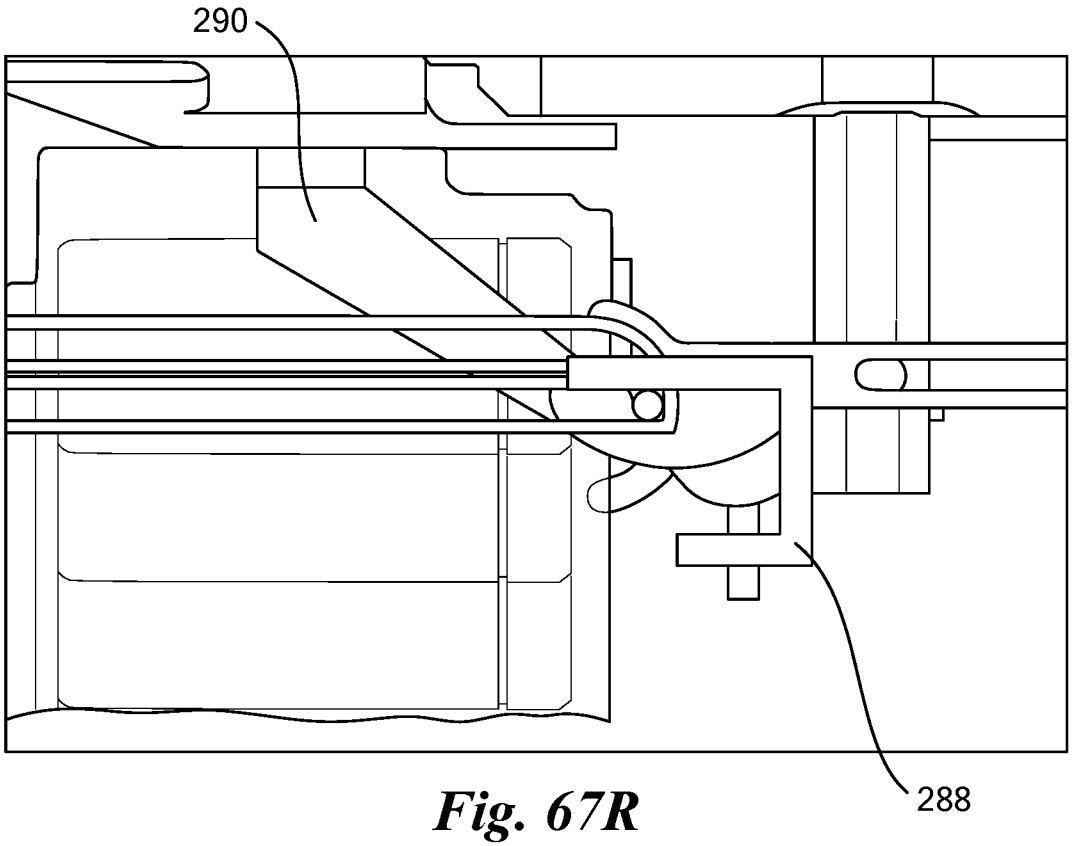
Figure 67L:
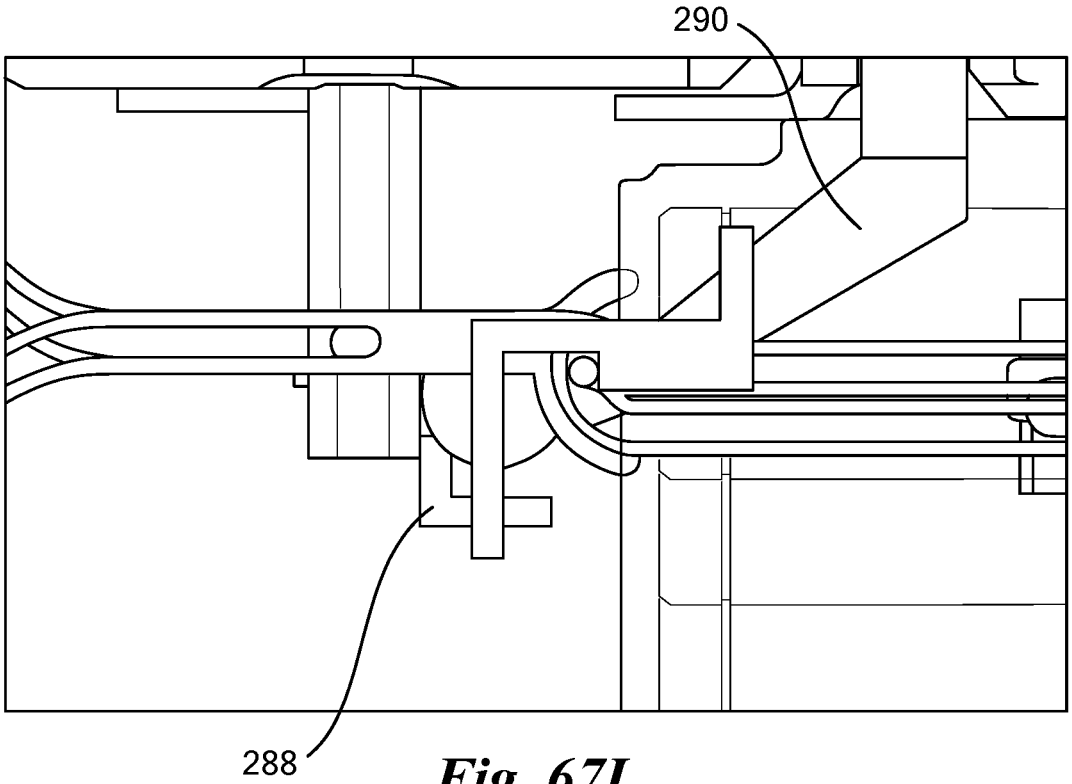

FIGS. 59-62 shows a third headspace reduction technique. A bolt 270 carried by a carrier 272 is moving forward within the firearm towards a chamber 274 during automatic loading of a CT cartridge (not shown) into the chamber 274. The bolt 270 moves forward such that its bolt lugs come into engagement with chamber lugs of the barrel extension 276. FIG. 61 shows the bolt 270 moved further into the barrel extension 276 and rotated such that bolt 270 is locked, e.g. at a time a CT cartridge (not shown) loaded in the chamber 274 is fired. FIG. 62 is a cross-sectional side view showing the locked bolt 270 and an example of a compression distance which is an amount that the bolt face 278 extends within the chamber 274 to compress a CT cartridge (not shown) that is located in the chamber 274, prior to firing the CT cartridge, in order to reduce and/or eliminate headspace.

Figure 68R:
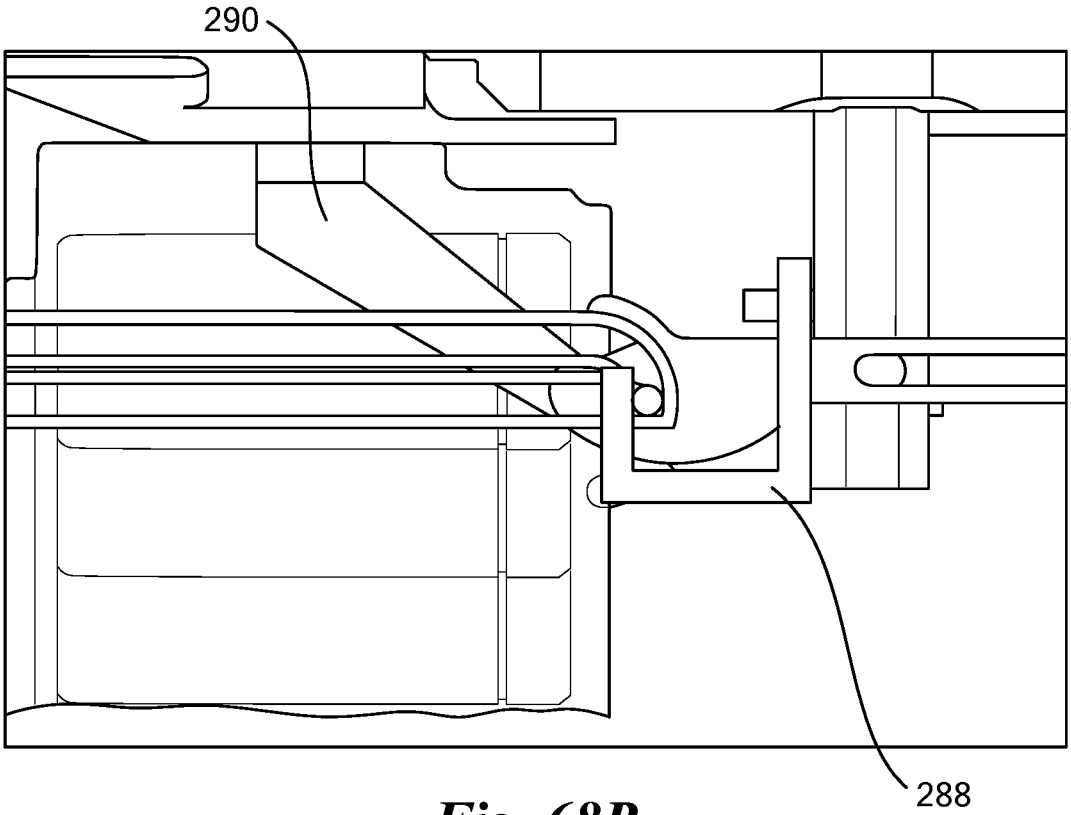
Figure 68L:
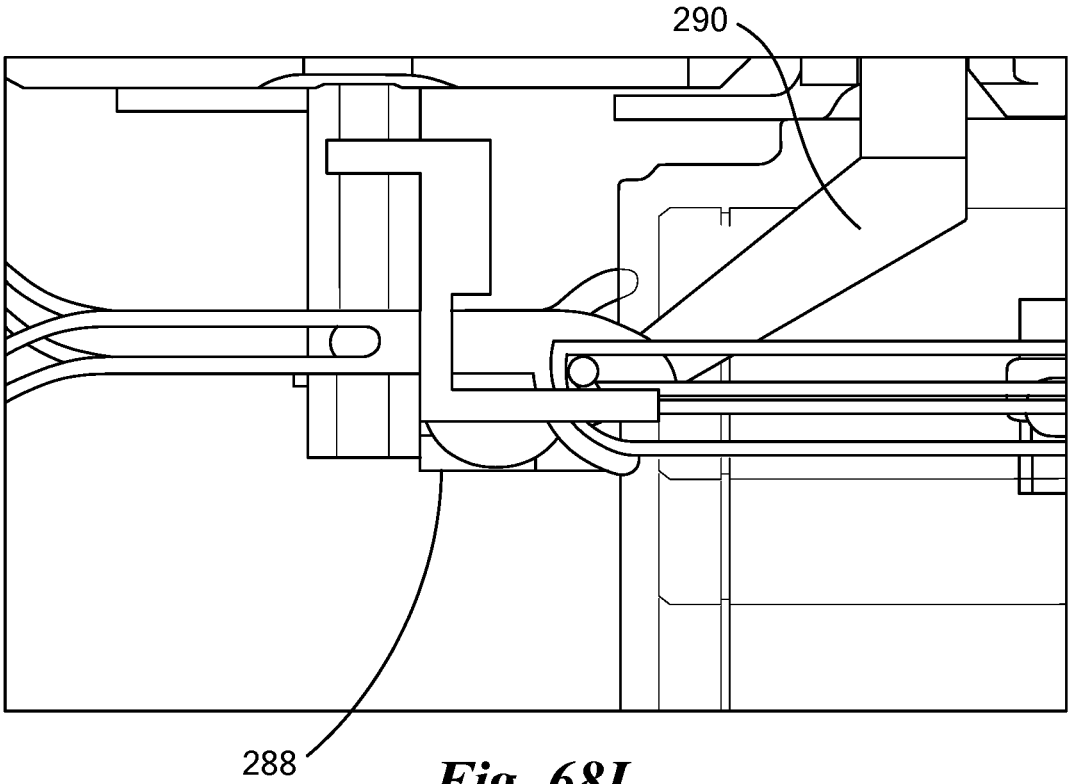

FIGS. 63R-68L illustrate a dual-feed technique enabling a weapon to be fed with ammunition either from a magazine 280 or from a belt via a belt feed tray 282. Structure includes a belt feed cam 284, a magazine feed cam 286, and feed mode lock 288. FIGS. 63R, 64R, 65R, 67R, and 68R depict the structure on the shooter's right side of the weapon, while FIGS. 63L, 64L, 65L, 67L, and 68L depict the structure on the shooter's left side of the weapon. In magazine feed mode the magazine feed cam 286 is engaged with the slide 290 and moves the chamber carrier 292 downward from the firing position (FIGS. 63R-63) to the ejection/loading position, similar to the operation described above. In the illustrated belt feed mode, the belt feed cam 284 is engaged with the slide 290 to move chamber carrier 292 upward to the ejection/loading position (FIGS. 65R-65L). The feed mode lock 288 is rotated 90 degrees for mode selection, causing the slide 290 to engage either the belt feed cam 284 or the magazine feed cam 286. FIGS. 67R-67L shows belt feed mode locked, and FIGS. 68R-68L show magazine feed mode locked.

Figure 69:
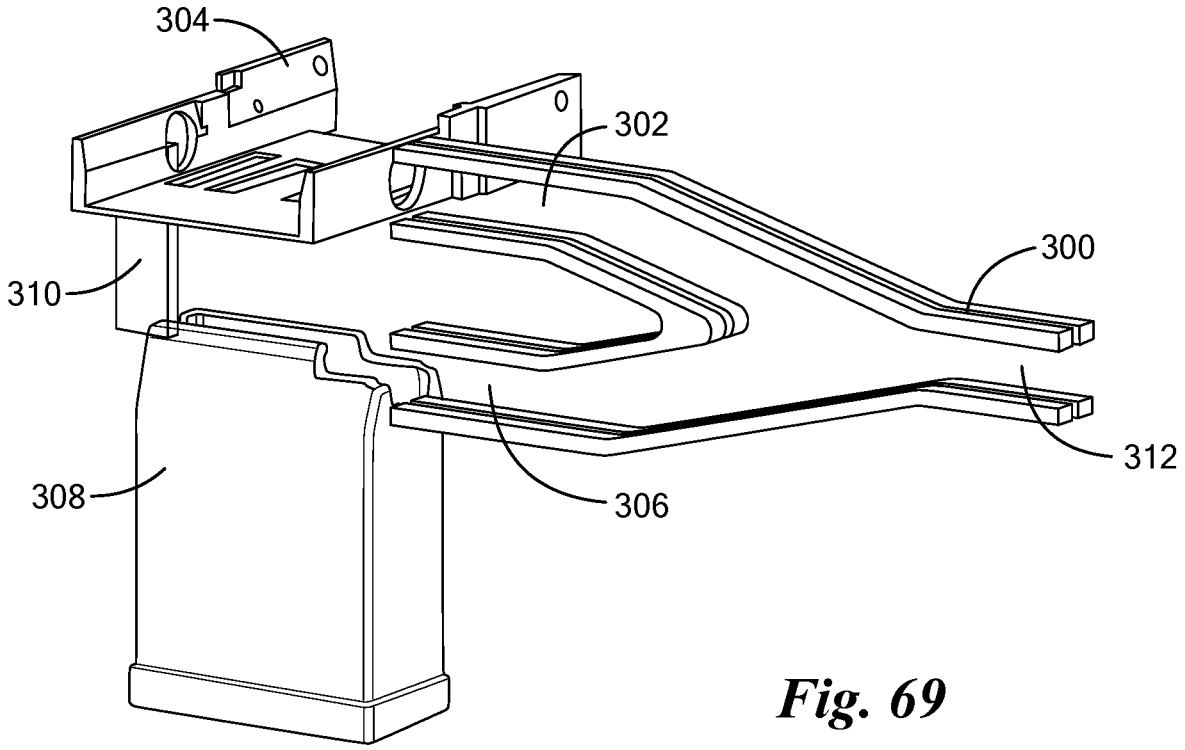
FIGS. 69-71 are views illustrating a second dual feed mechanism.
Figure 70:
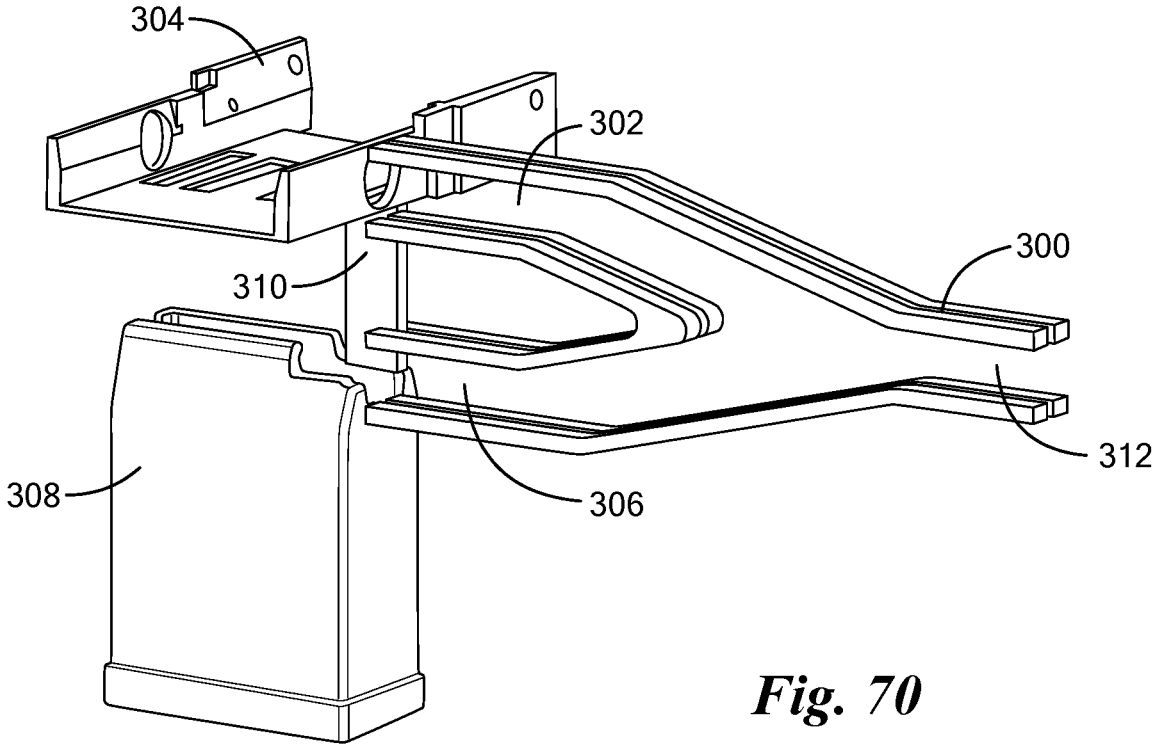
Figure 71:
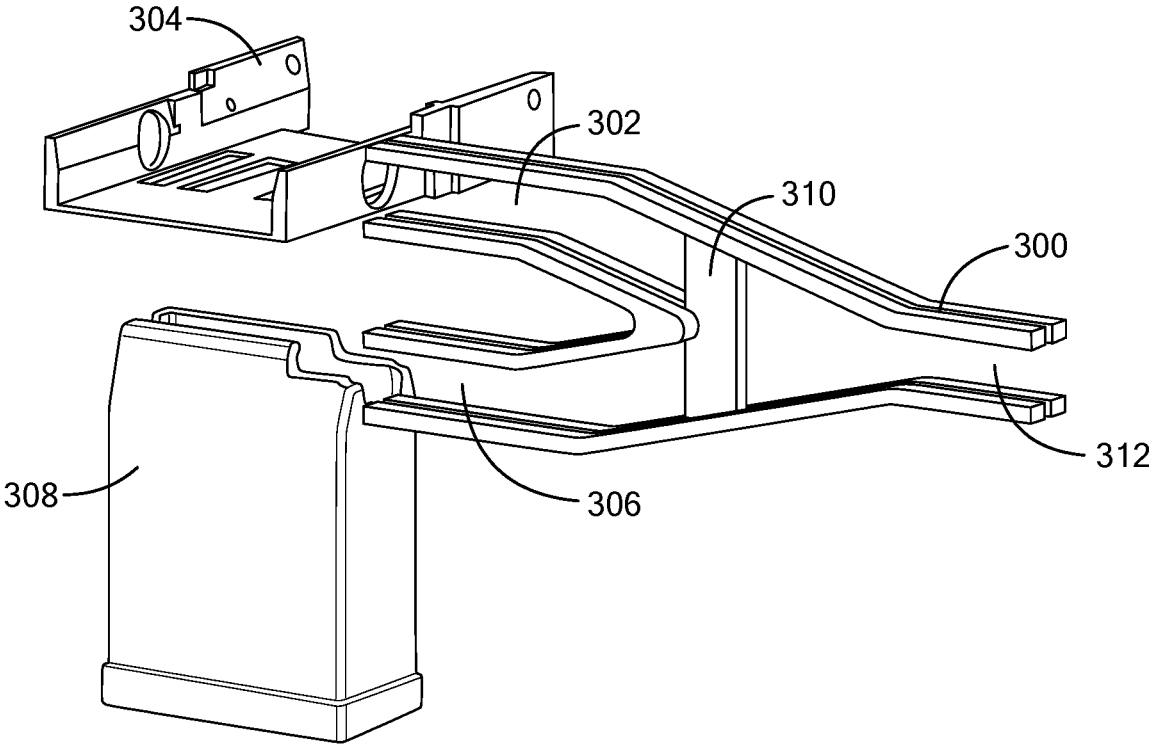

FIGS. 69-71 illustrate an alternative dual feed technique employing a Y-shaped ramp member 300. An upper ramp channel 302 is adjacent a belt feeder 304, and a lower ramp channel 306 is adjacent a feed area of a magazine 308. In operation, a vertical ramming member 310 moves forward during counter-recoil, for example by action of a carrier (not shown), pushing a cartridge (not shown) from either the magazine 308 or a belt (not shown), whichever is loaded, along a corresponding ramp channel 306 or 302. As the round is pushed forward, it travels a respective sloped area and then into the single exit channel 312 of the ramp member 310, into a chamber (not shown).

Figure 72:
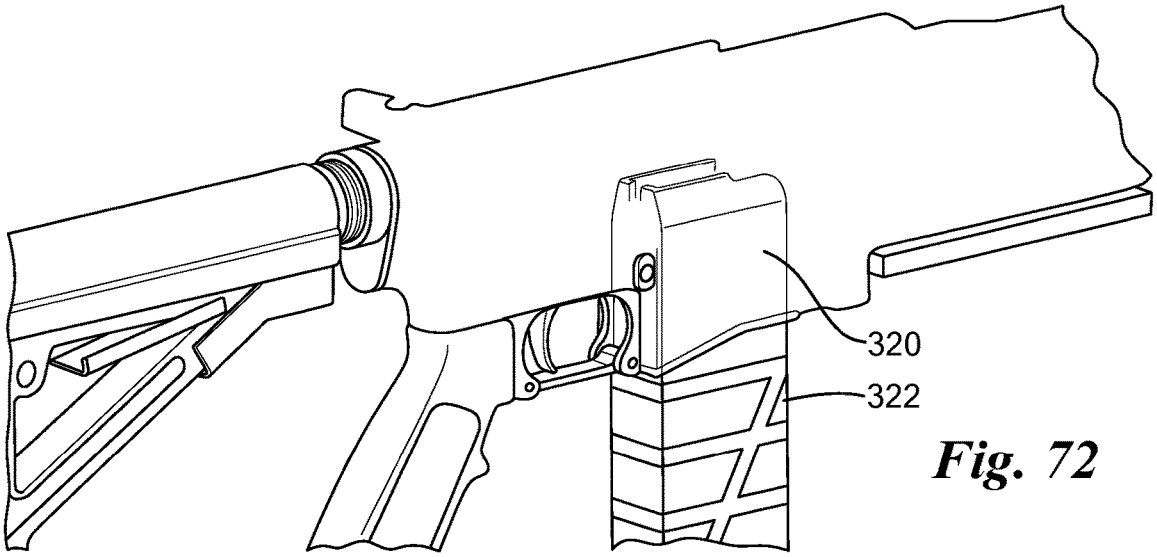
FIGS. 72-74 are views illustrating a third dual feed mechanism.
Figure 73:
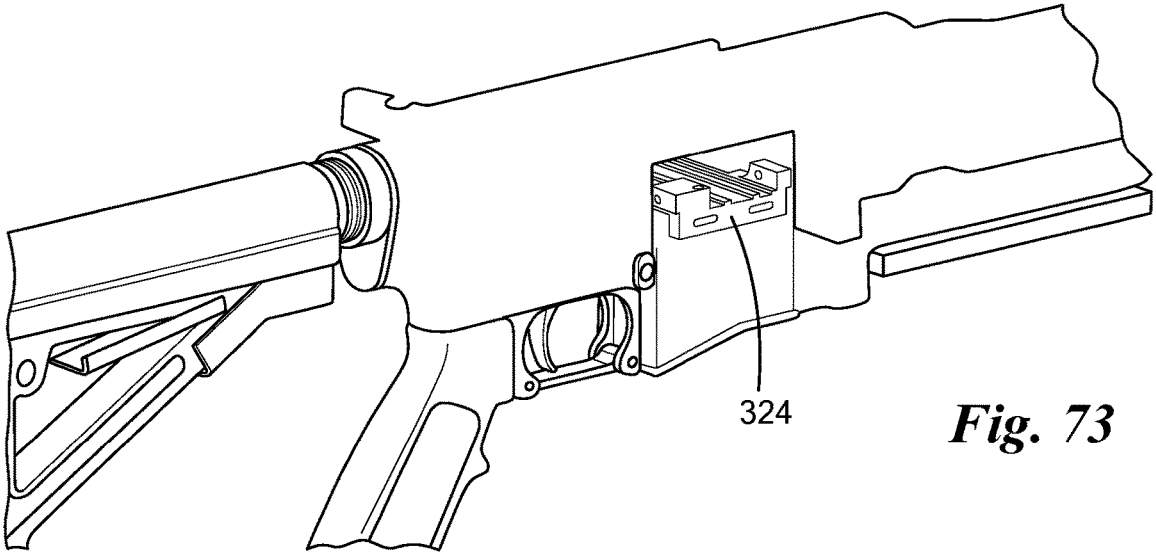
Figure 74:
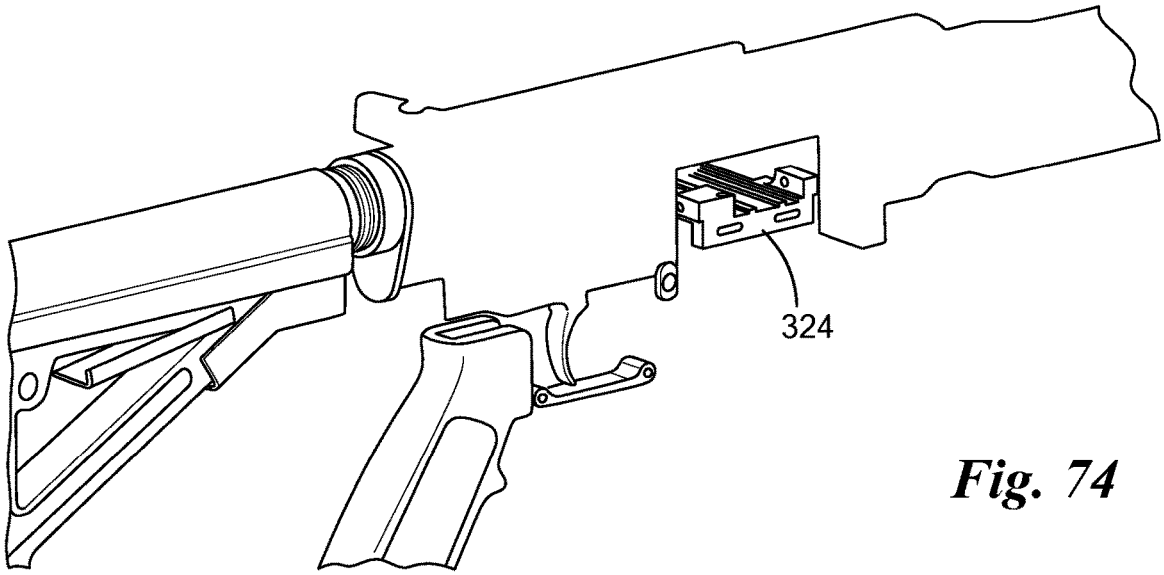

FIGS. 72-74 show an alternative dual feed technique in which the magazine well 320 is configured to receive either a magazine 322 (FIG. 72) or a belt feeder 324 (FIGS. 73-74). In FIG. 74 the lower receiver is made invisible to reveal detail of the belt feeder 324.

Figure 75S:
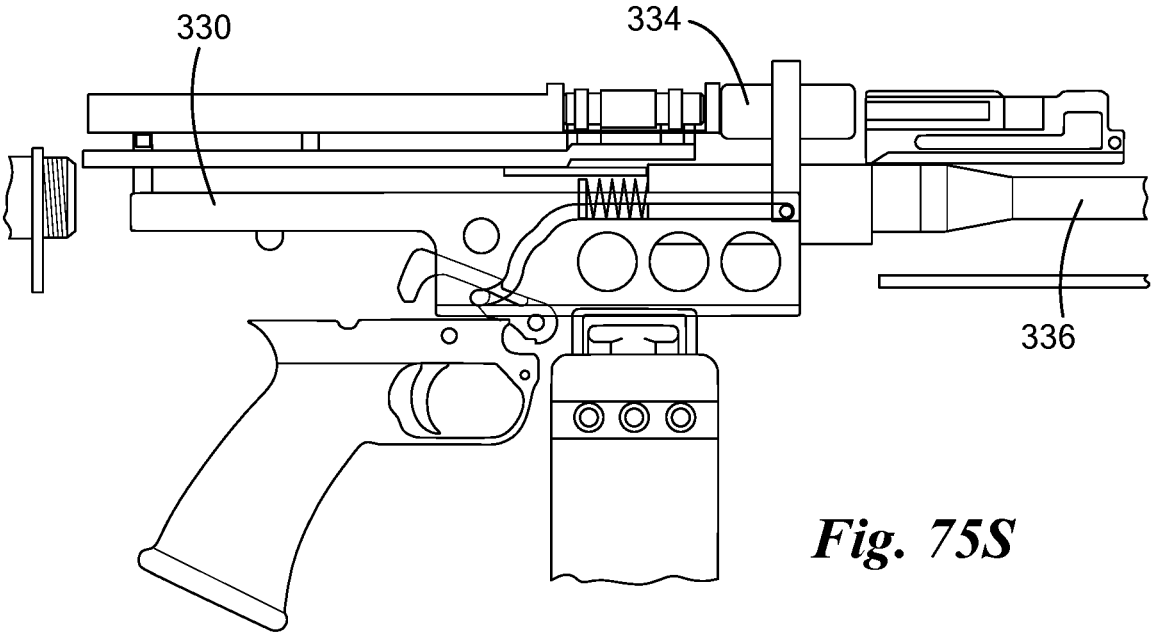
FIGS. 75S-82T are views illustrating a carbine with belt feed.
Figure 75T:
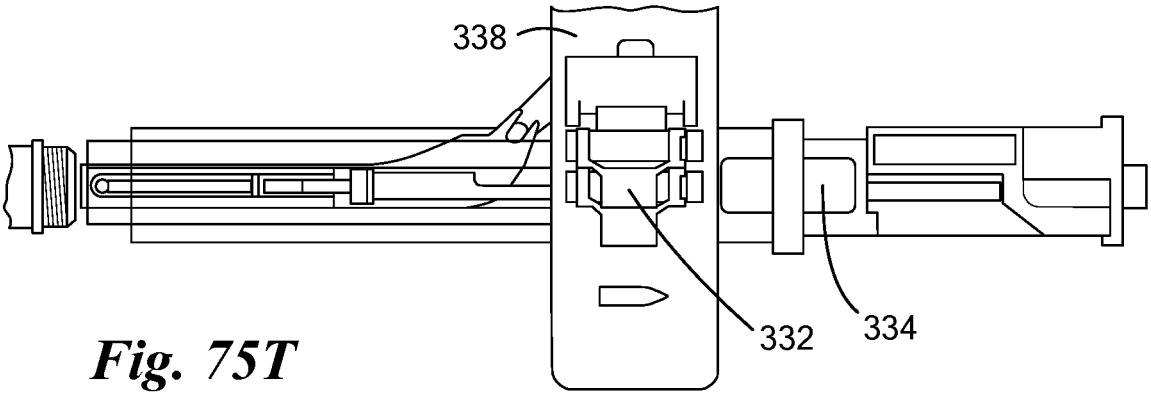
Figure 76S:
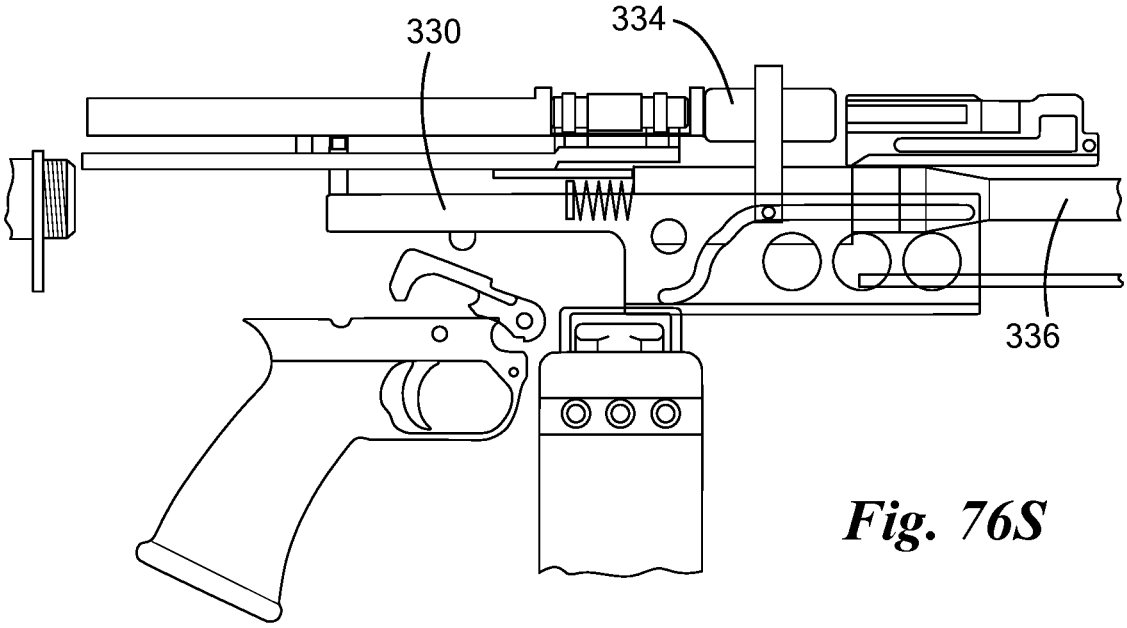
Figure 76T:
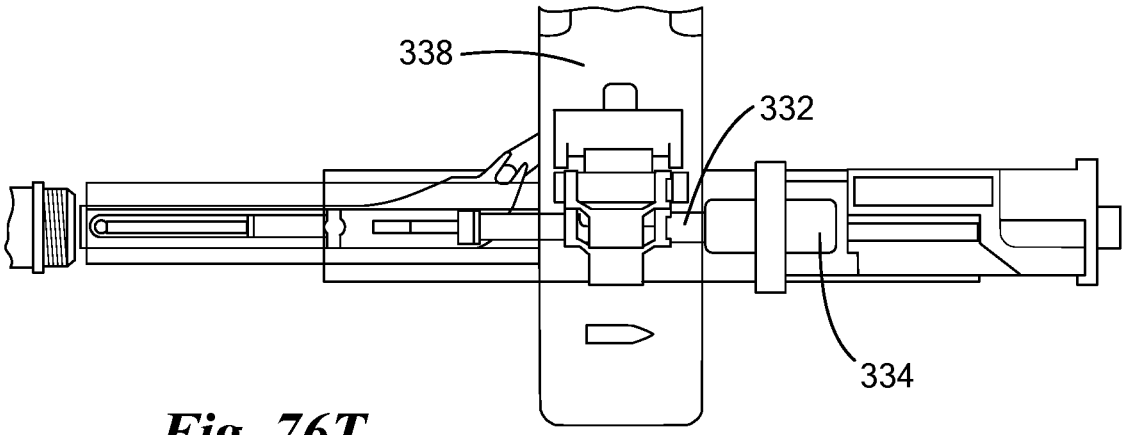
Figure 77S:
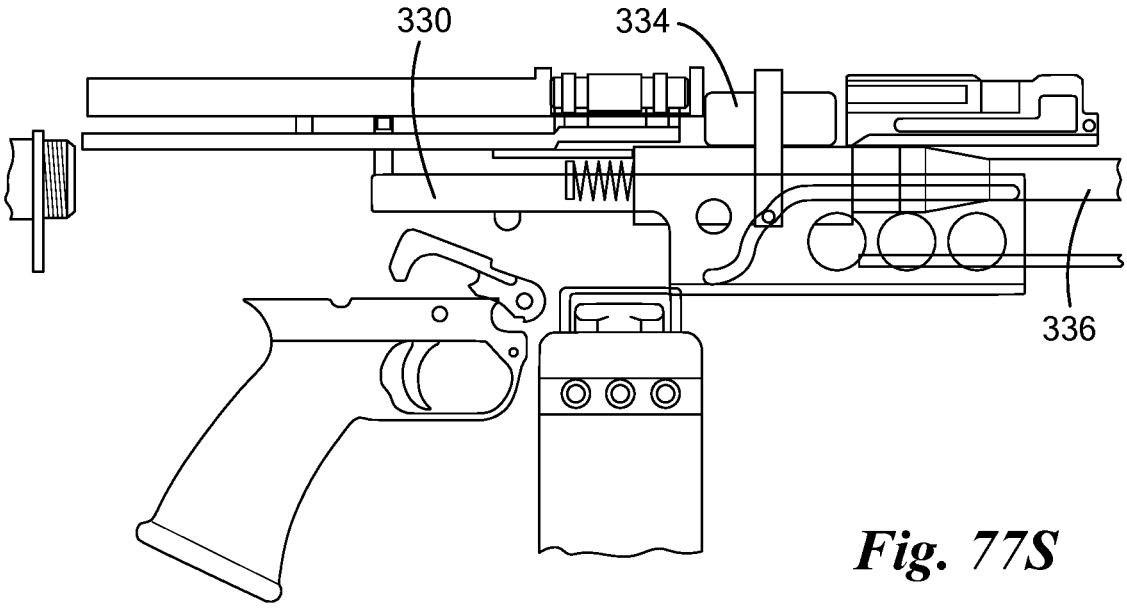
Figure 77T:
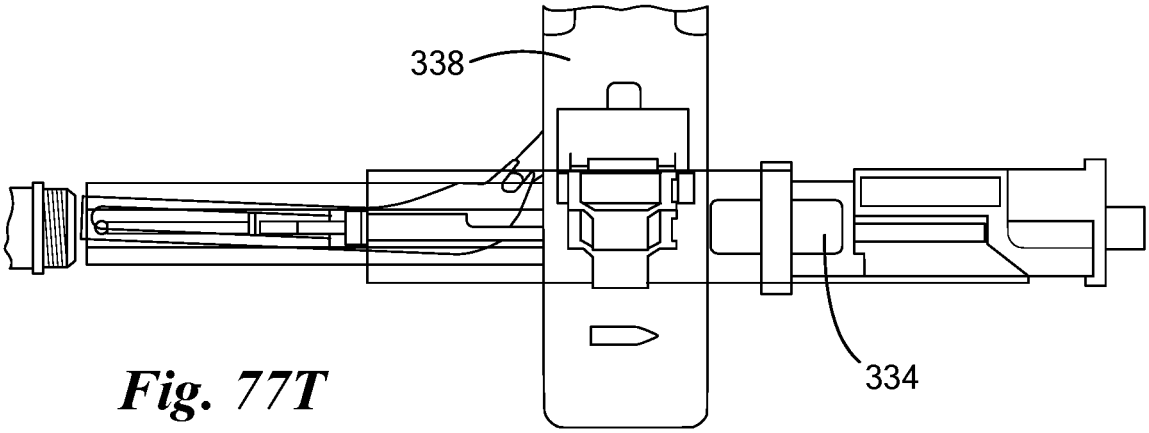
Figure 78S:
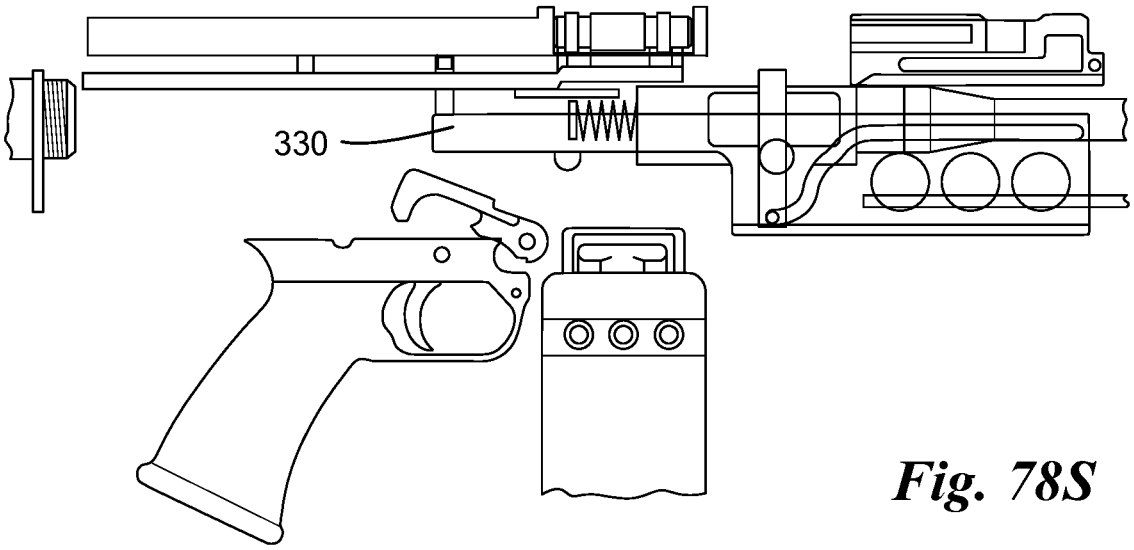
Figure 78T:
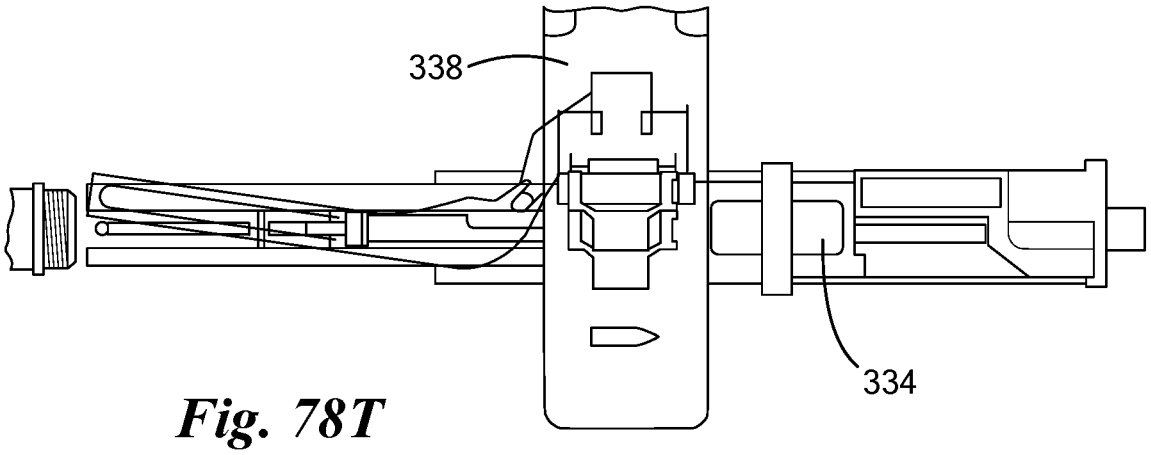
Figure 79S:
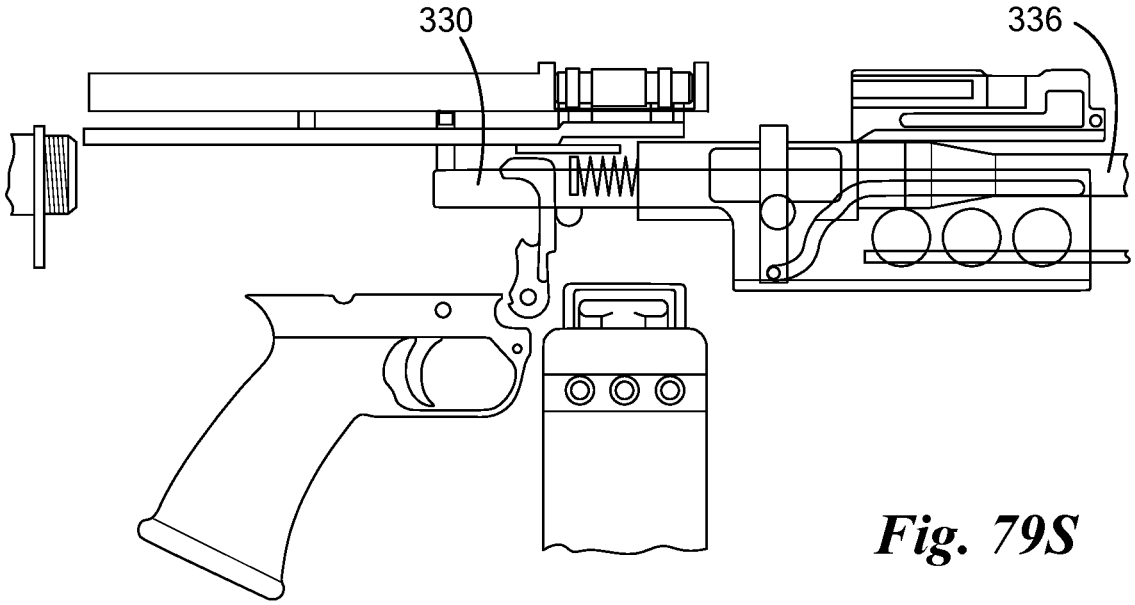
Figure 79T:
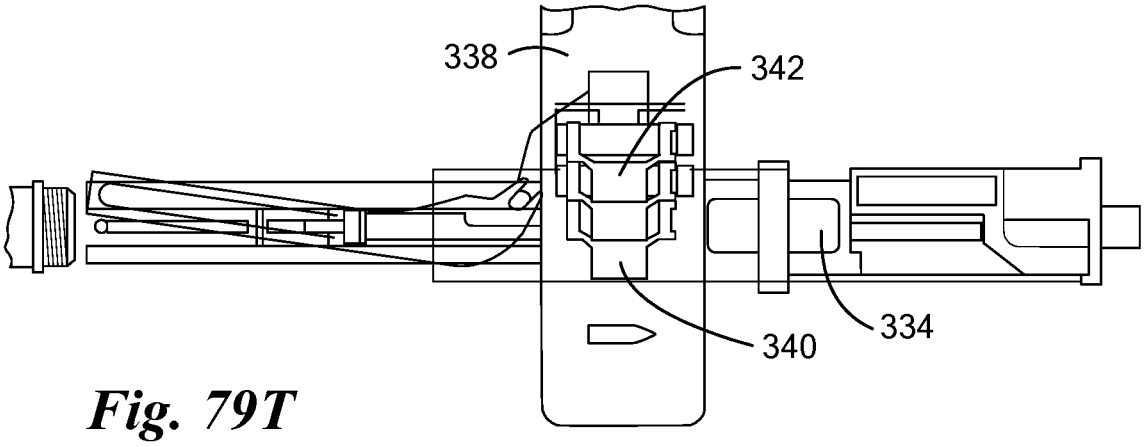
Figure 80S:
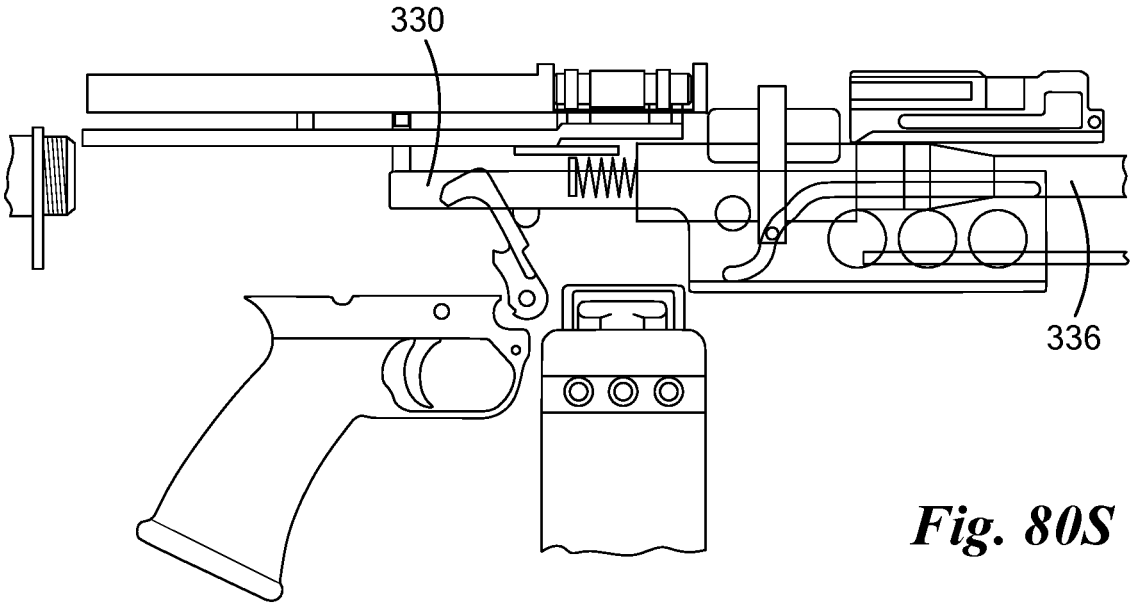
Figure 80T:
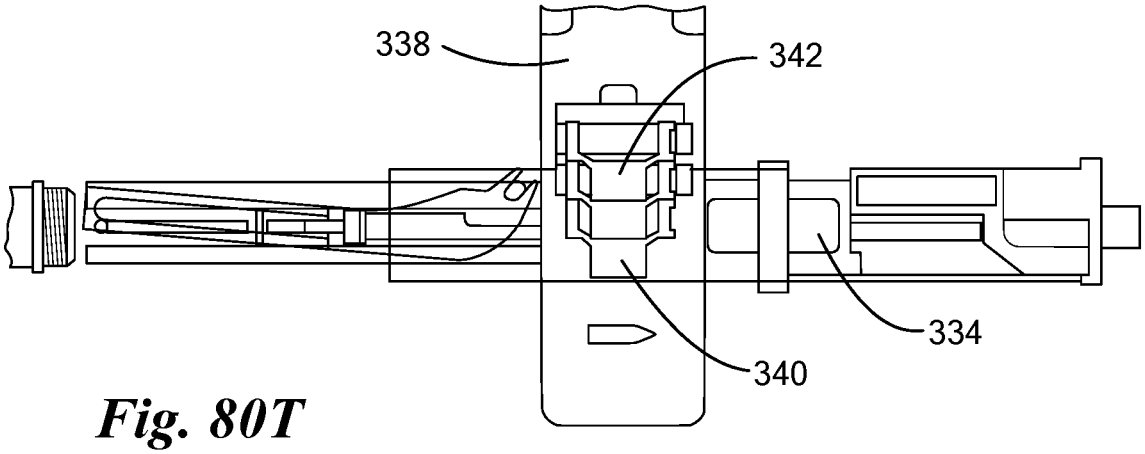
Figure 81S:
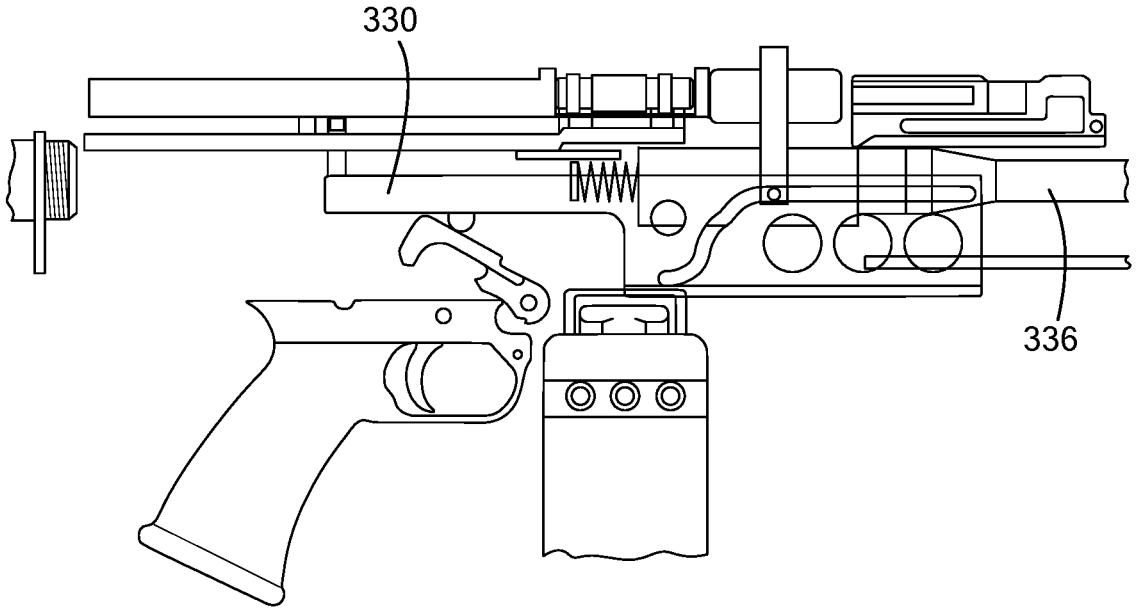
Figure 81T:
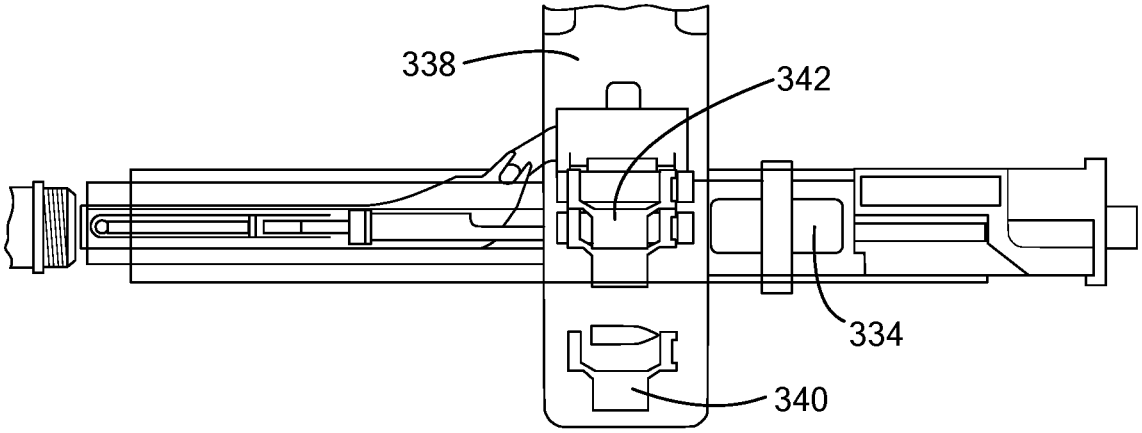
Figure 82S:
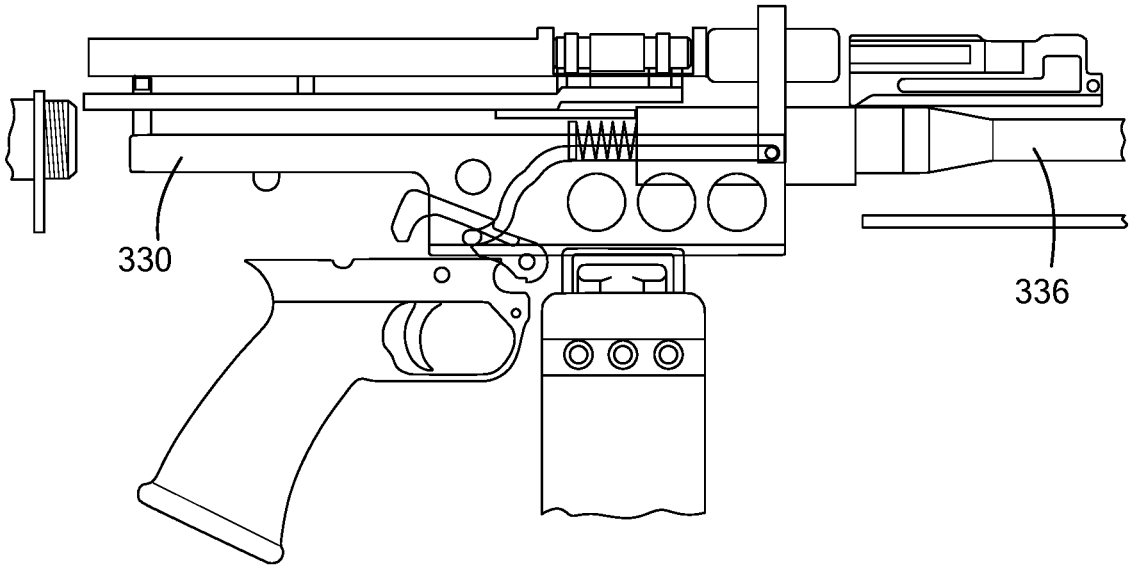
Figure 82T:
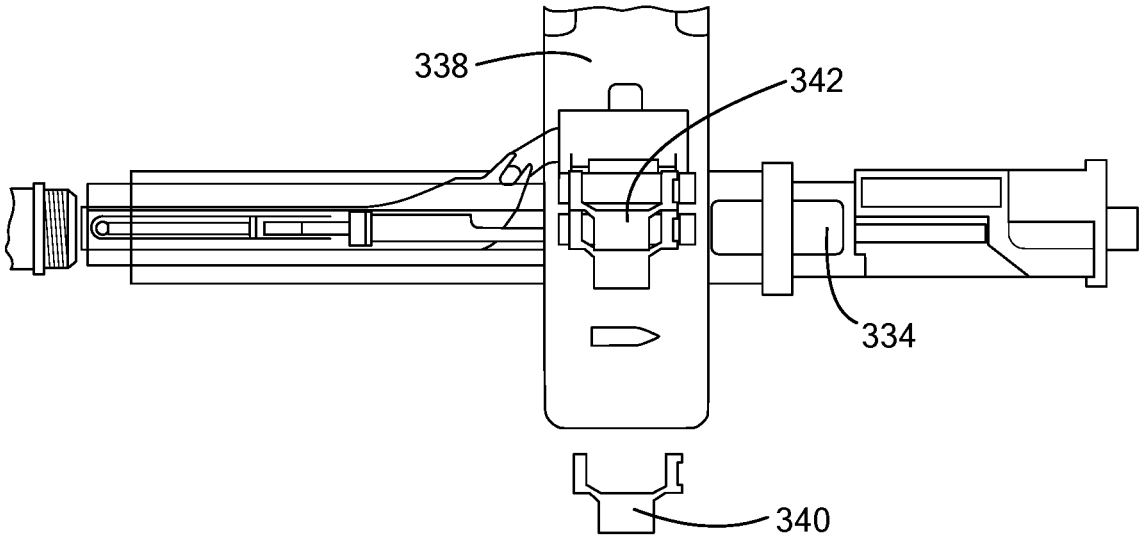

FIGS. 75S-82T illustrate structure and functionality for a belt-fed carbine. Those Figures whose numbers end in "S" are side views, while those ending in "T" are corresponding top views, each at the same time as the corresponding "S" figure. Thus FIGS. 75S and 75T depict the same instant in time, etc. FIGS. 75S-78T depict feeding during counter-recoil, during which a slide 330 moves forward, ramming a cartridge 332 into a chamber of a chamber member 334 and then lowering the chamber member 334 into a firing position aligned with the barrel 336. FIGS. 79S-82T depict recoil, during which the slide 330 moves rearward, indexing the belt feeder 338 to eject a spent link 340 and move a next cartridge 342 into the ramming position for ramming in the subsequent counter-recoil movement. The rammer is a disconnecting rammer, locked in to the bolt on counter recoil. A latch is cammed up after a cartridge is fed, allowing the rammer to be pulled rearward by a spring.

FIGS. 83-105 show several alternative carbines having respective mechanical/functional arrangements. Generally, these all include rearward feed, also referred to as "aft feed", which contributes to reducing weapon length. Specific aspects and advantages of each variation are described.

Figure 83:
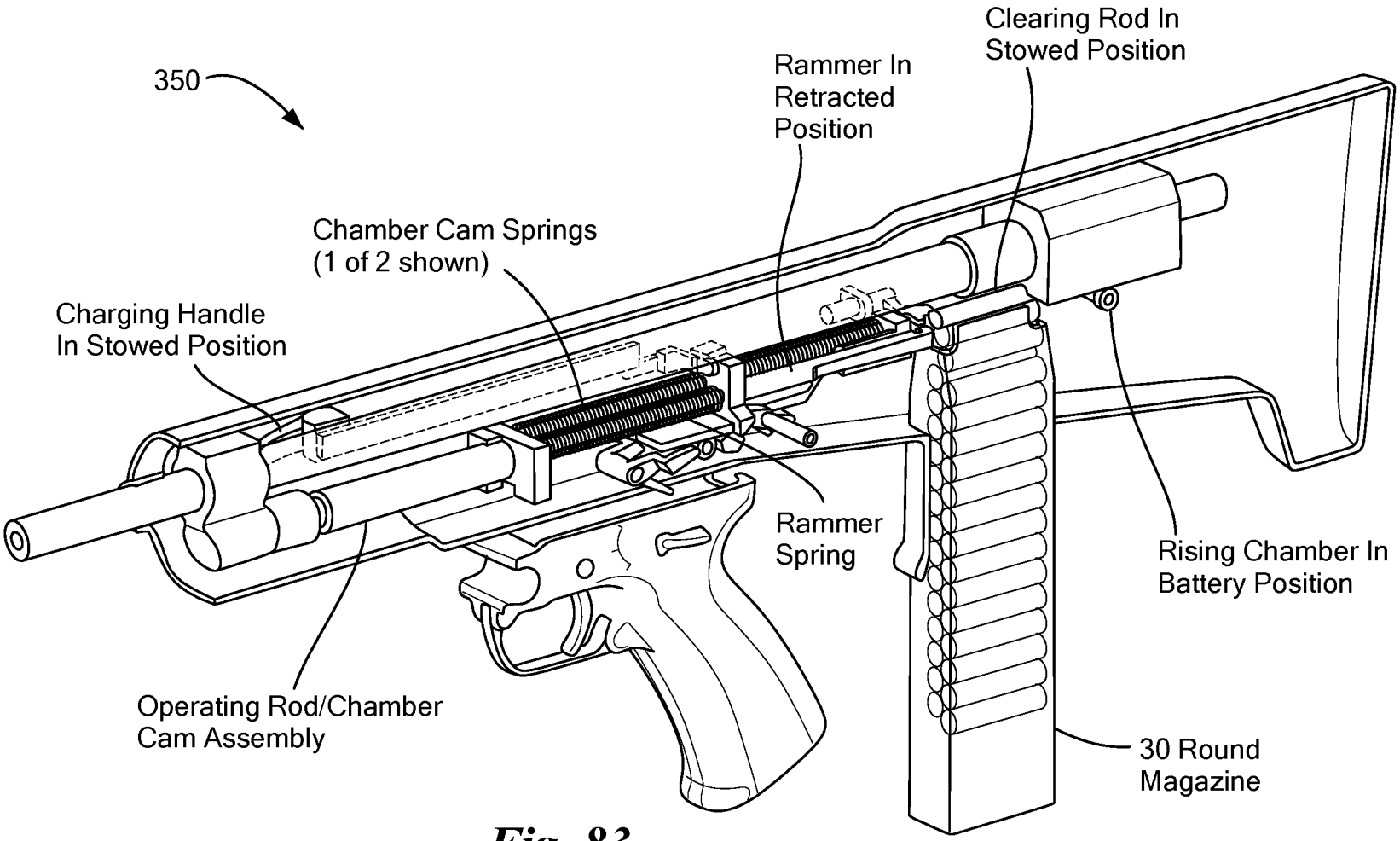
FIGS. 83-105 are views illustrating alternative carbine layouts generally involving rearward (aft) feed and other variations.
Figure 84:
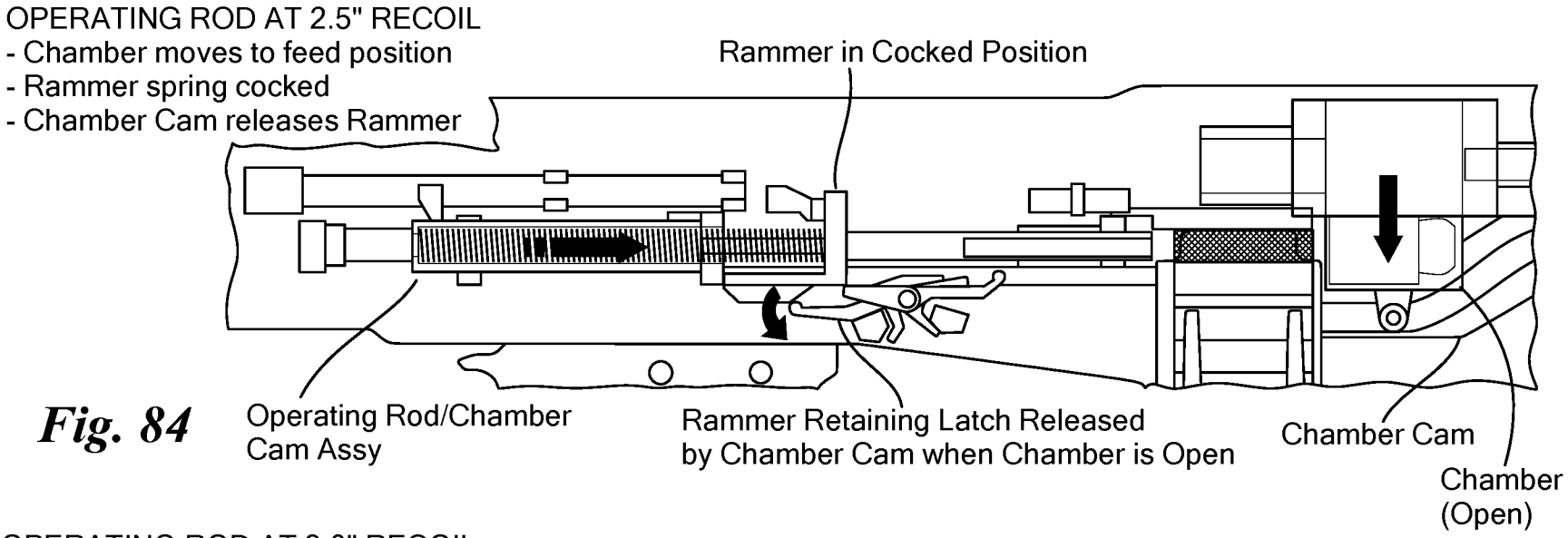
Figure 85:
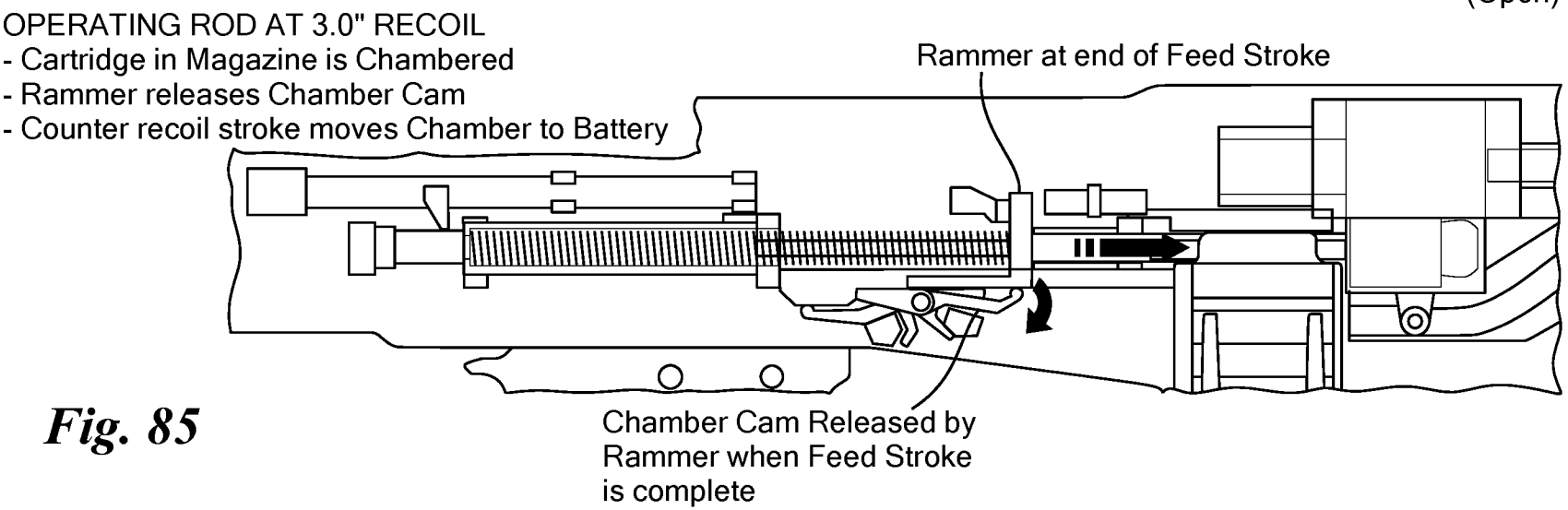
Figure 86:
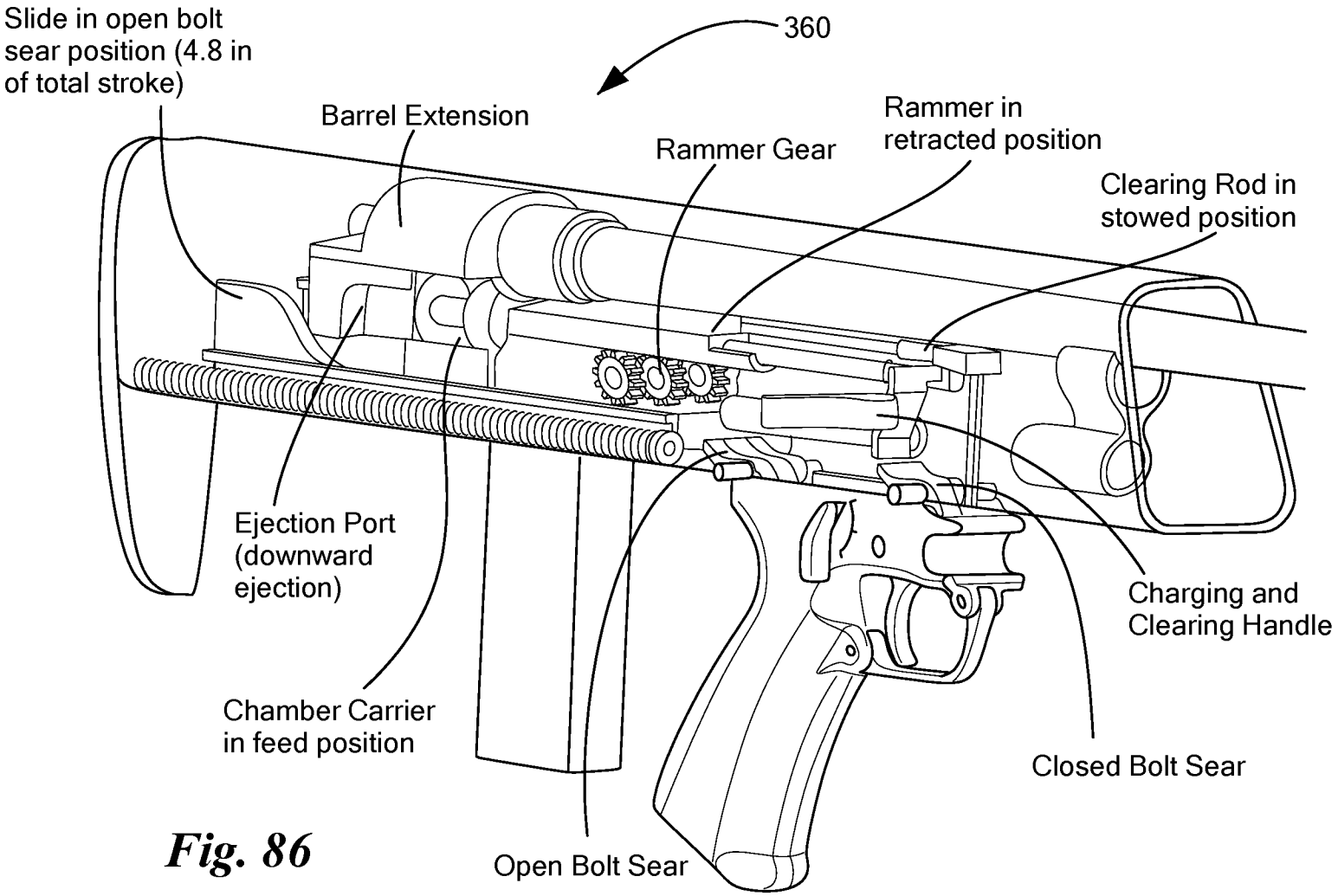
Figure 87:
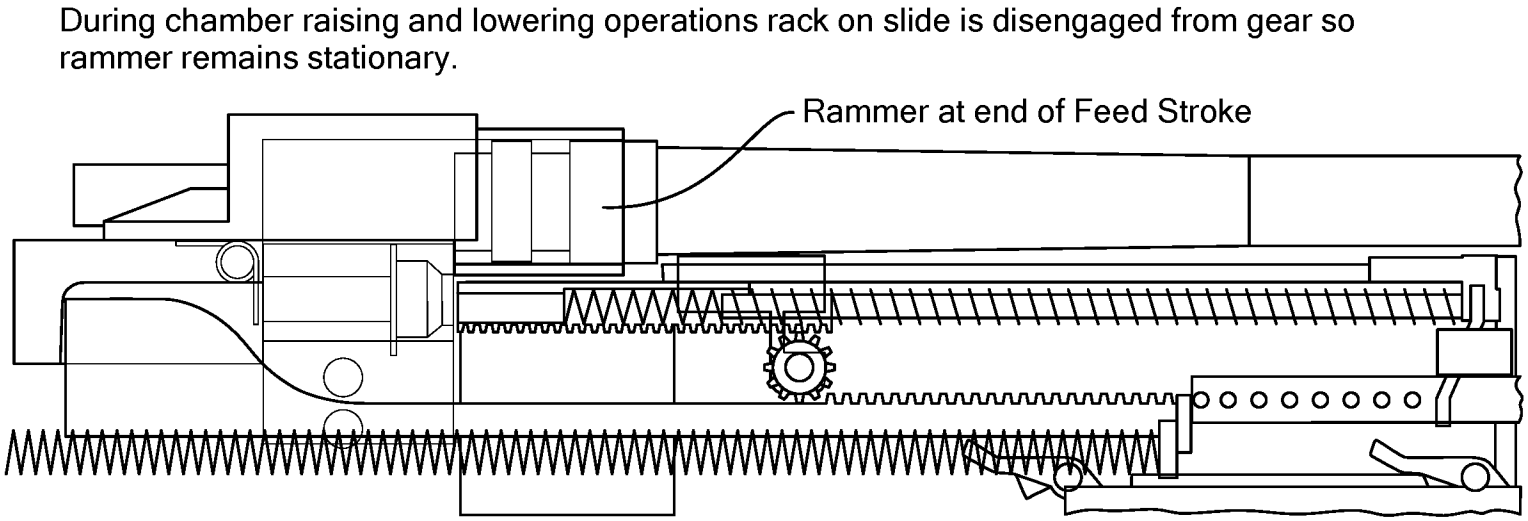
Figure 88:
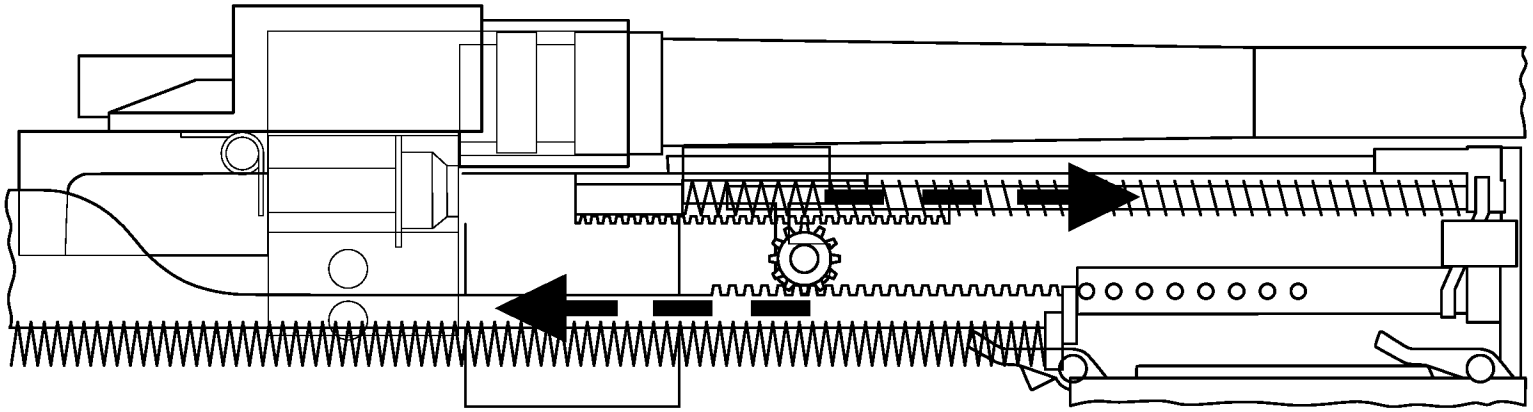
Figure 89:
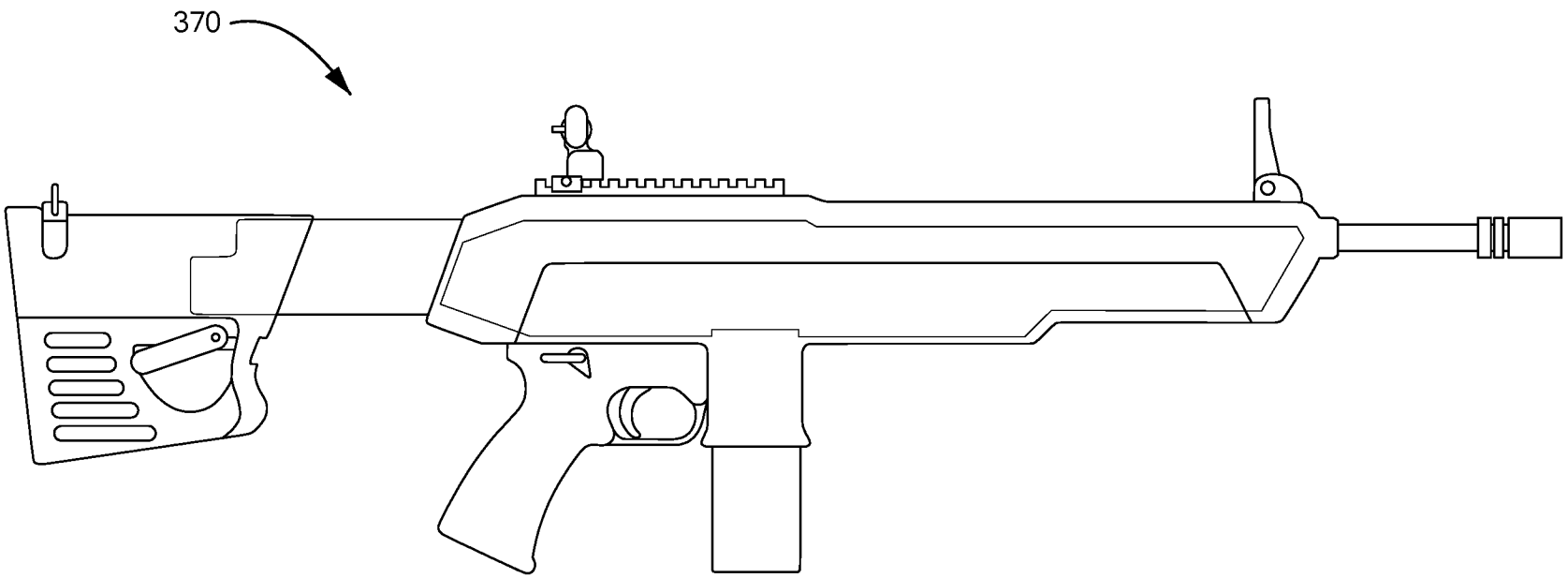
Figure 90:
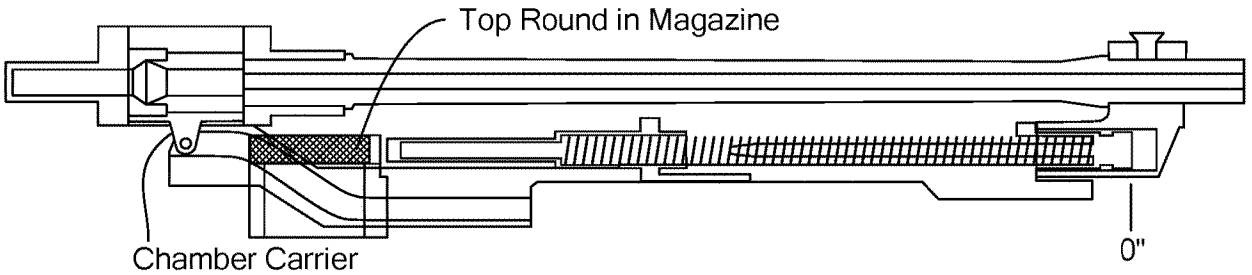
Figure 91:
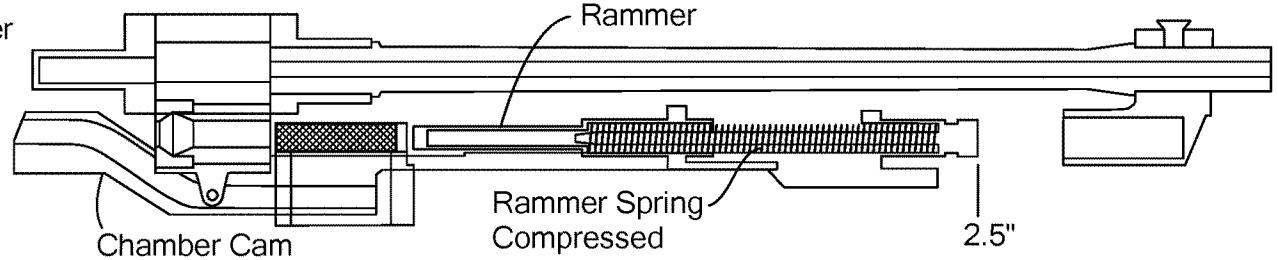
Figure 92:
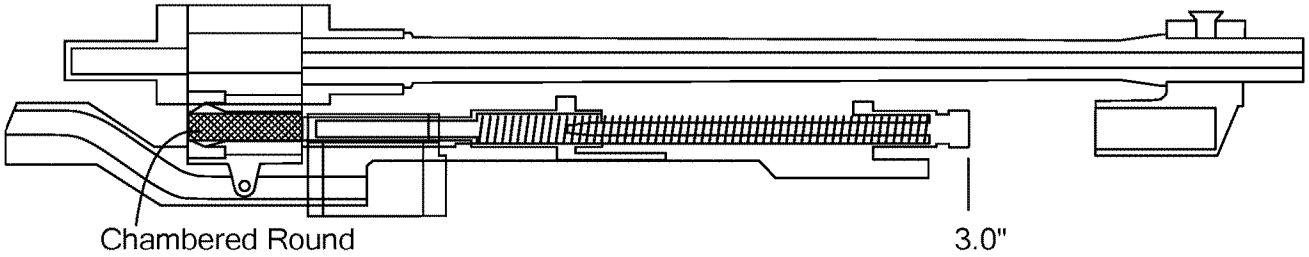
Figure 93:
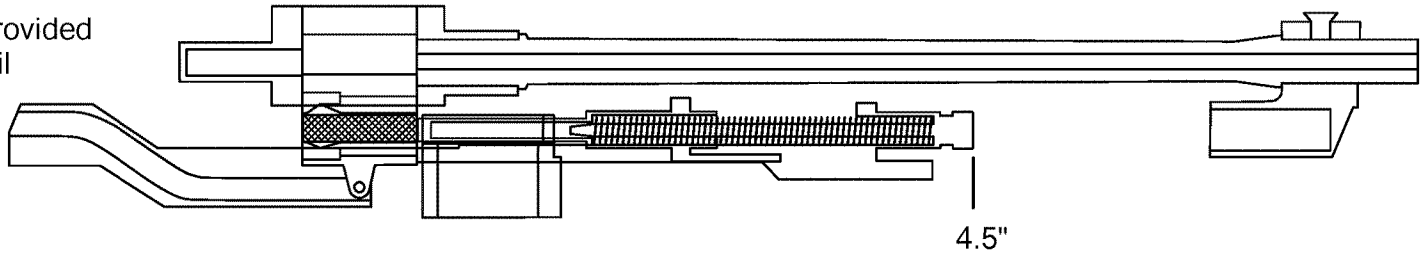
Figure 94:
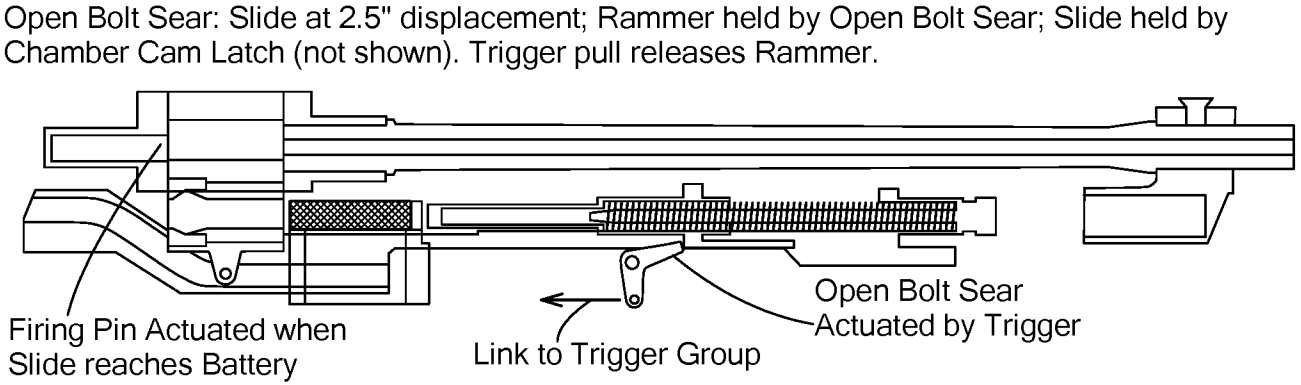
Figure 95:
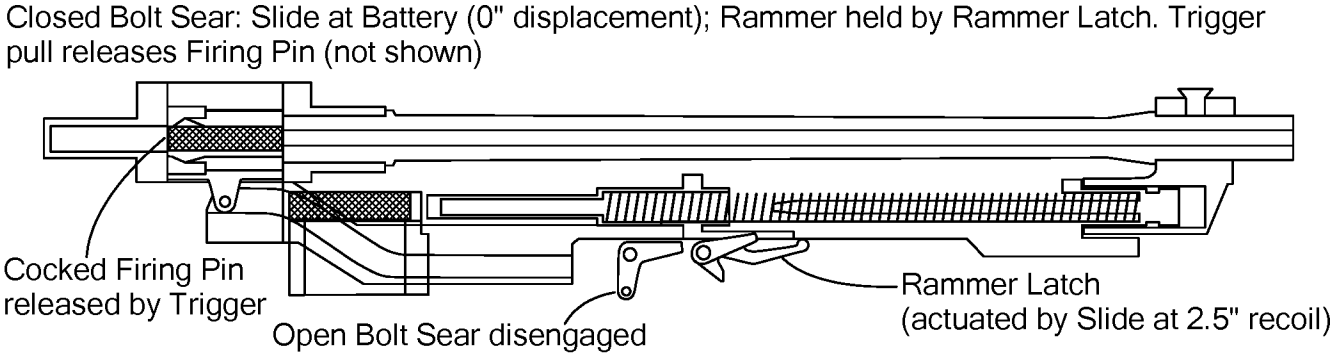
Figure 96:
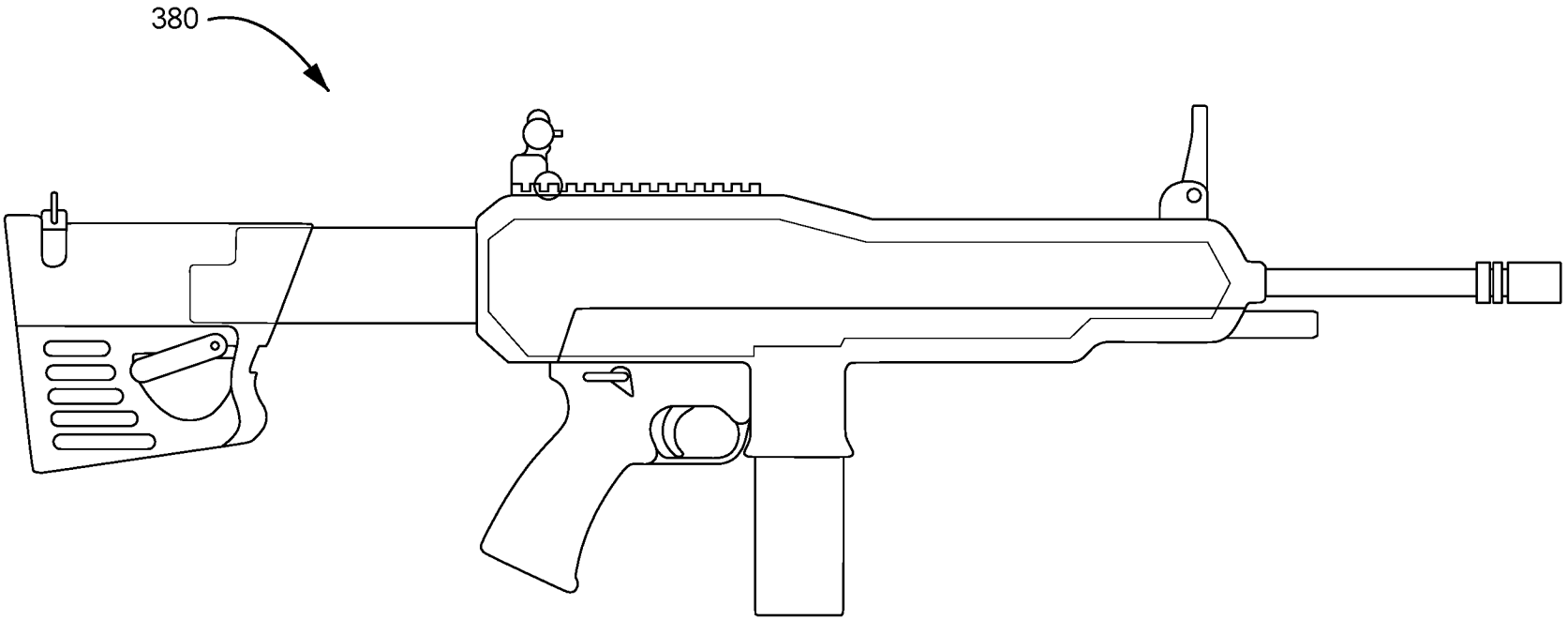
Figure 97:
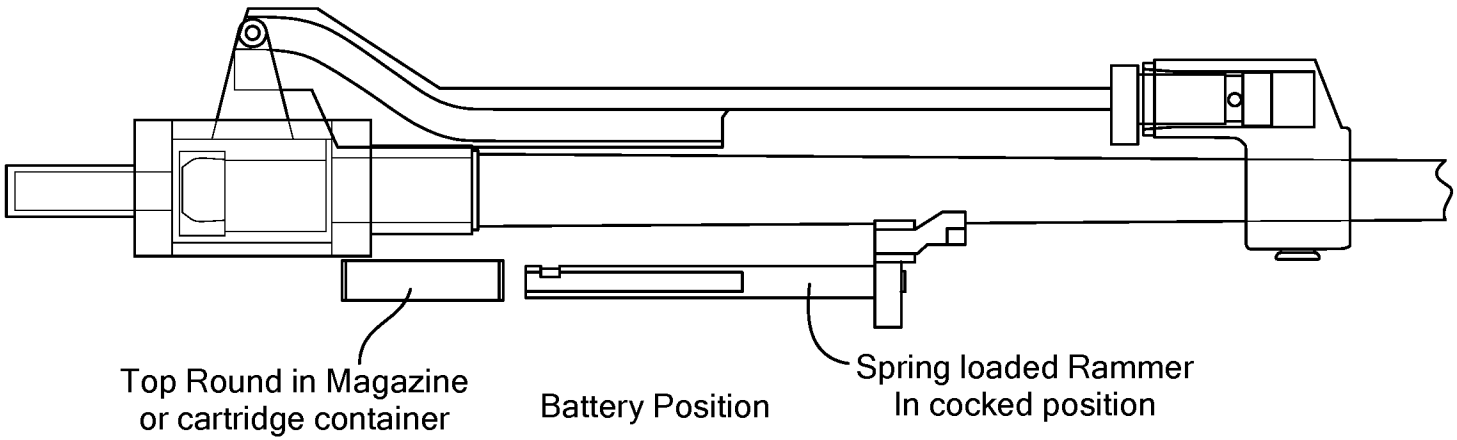
Figure 98:
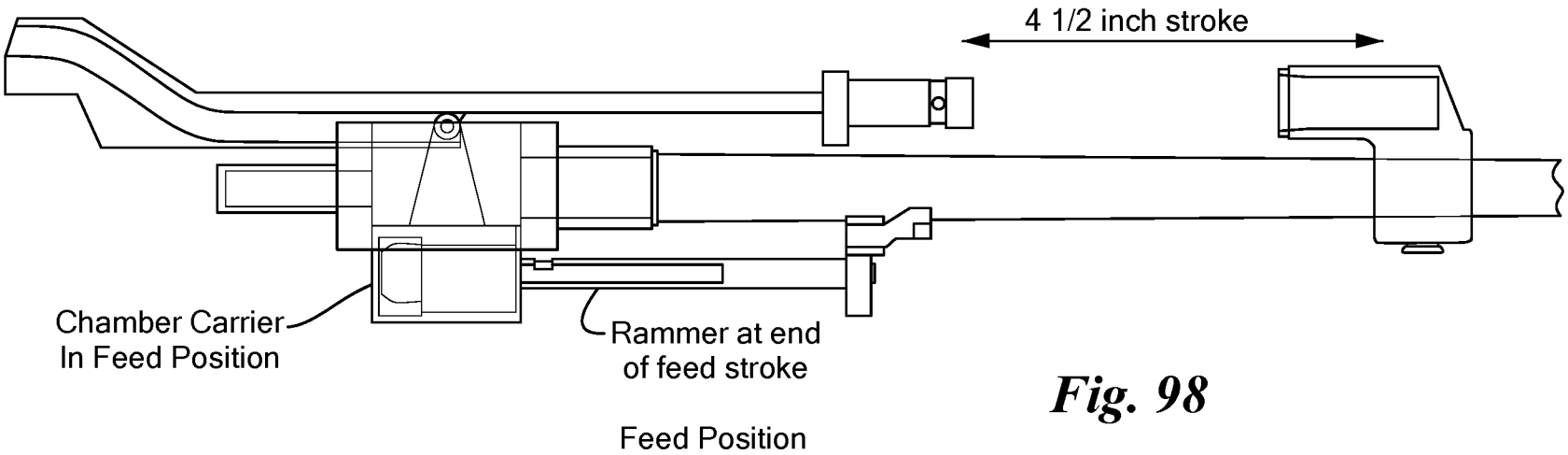
Figures 99, 100:
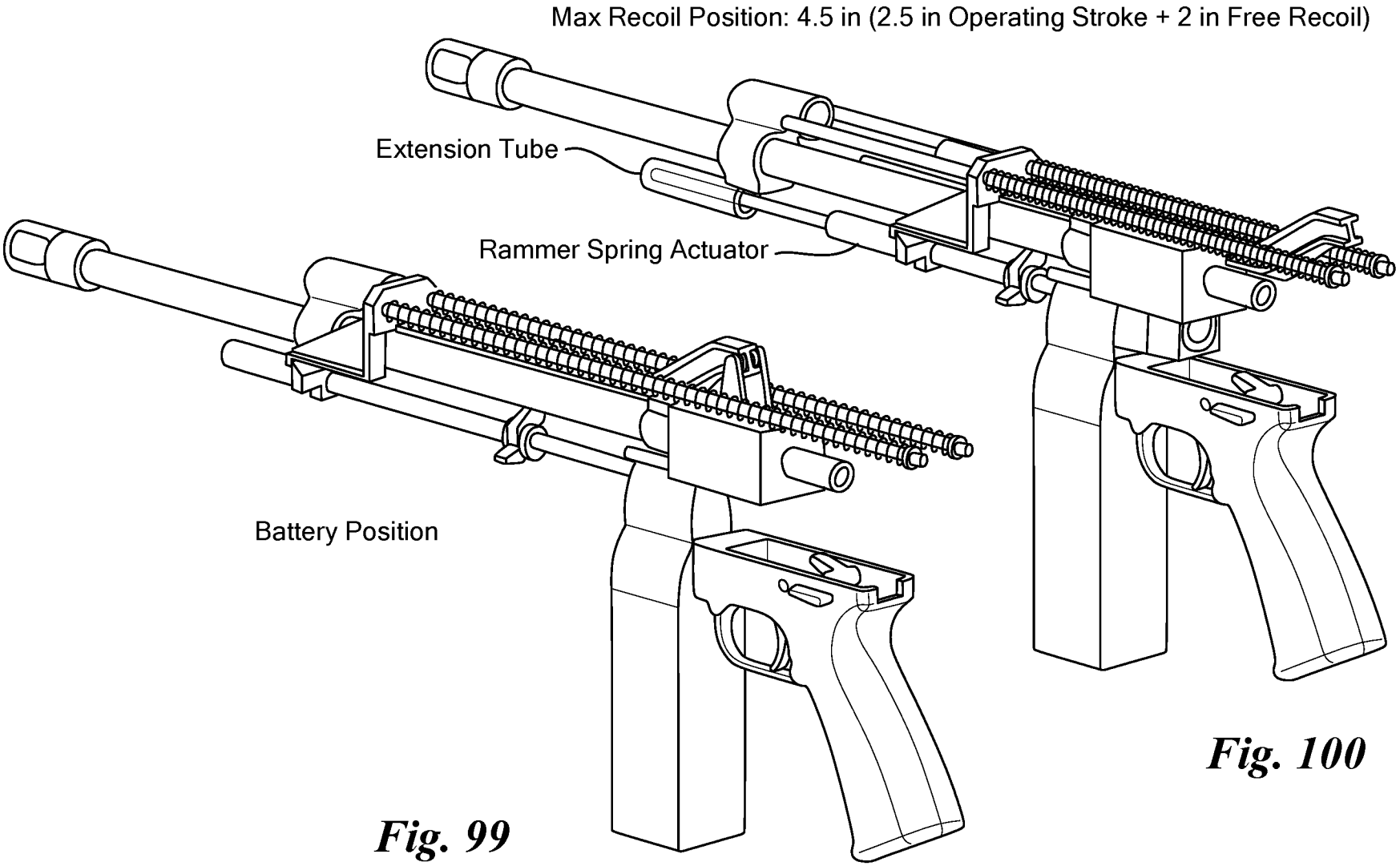
Figure 101:
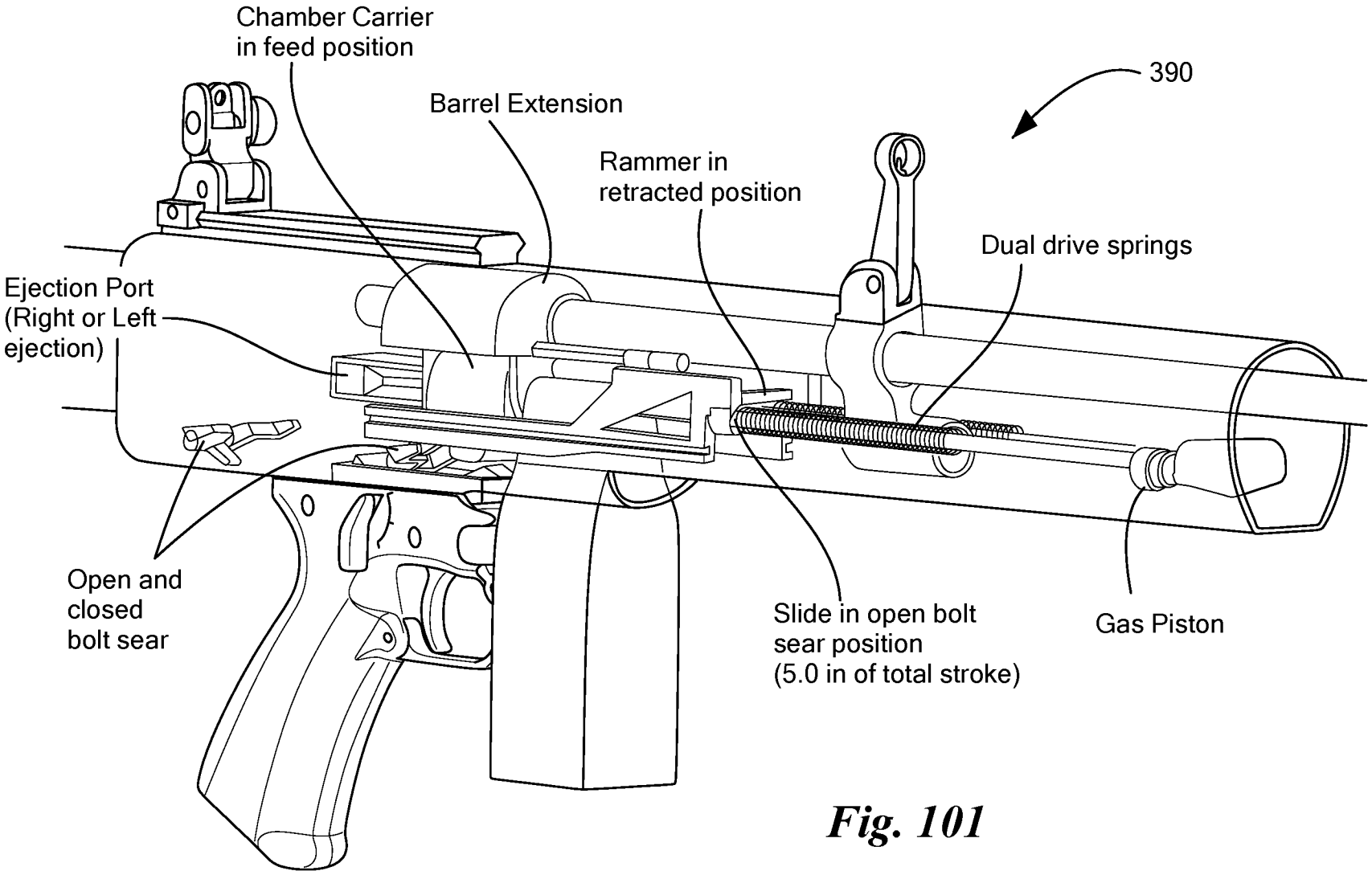
Figure 102:
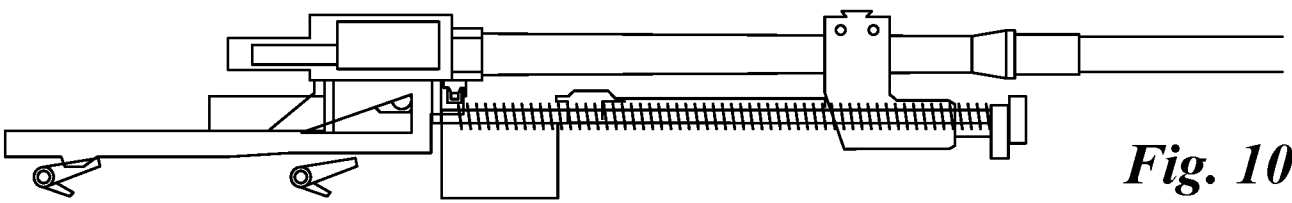
Figure 103:
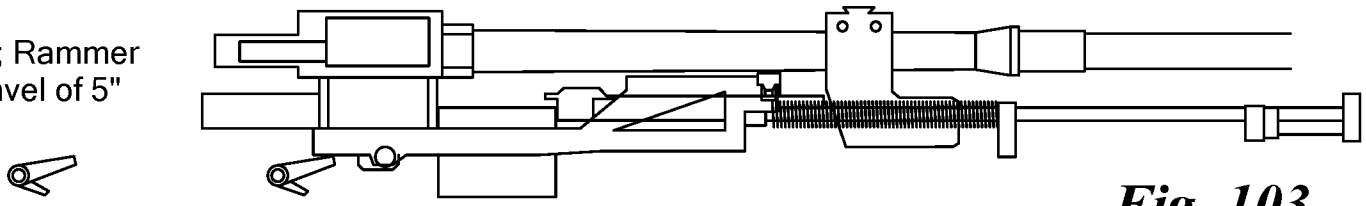
Figure 104:
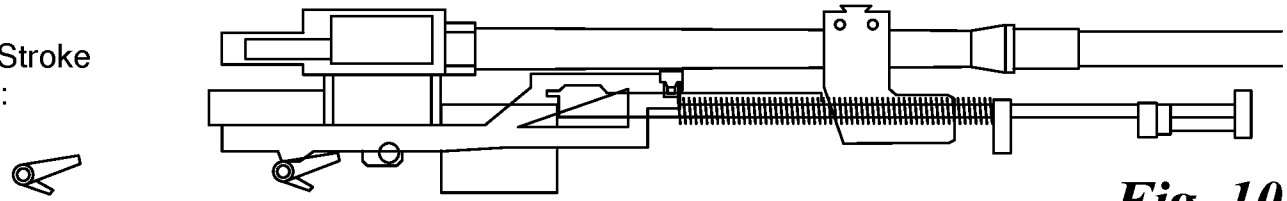
Figure 105:
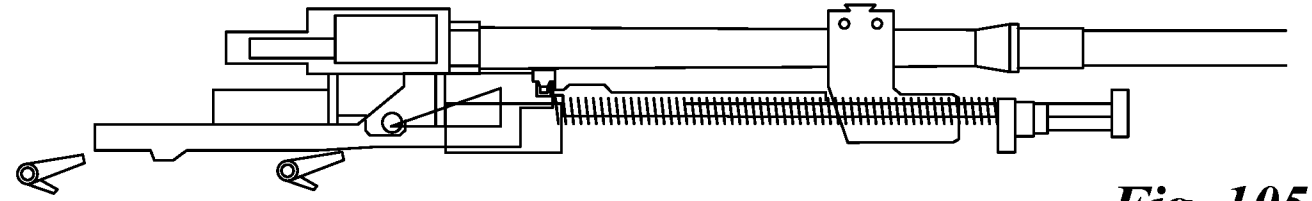

FIGS. 83-85 show a first alternative carbine 350 with the following characteristics:

Translating Chamber
Gas Cylinder Below Barrel
Chamber Index Cam Below Barrel
Separate Rammer Operation
Magazine Position Forward of Chamber
Pistol Grip Forward of Magazine
The carbine 350 has the following advantages:
Reduced Overall Weapon Length
Entire operating stroke used to index chamber
Feed Jam can be cleared by pulling charging handle FIGS. 86-88 show a second alternative carbine 360 with the following characteristics:

Reverse Feed
Trigger group ahead of magazine
Rising chamber
Dual drive springs
Guided rammer
Downward Ejection
The carbine 360 has the following advantages:
Short weapon length while including full-length barrel
Clearing of weapon done in same action as charging FIGS. 89-95 a third alternative carbine 370 with the following characteristics:

Aft feed, operating rod under barrel
Translating Chamber
Gas Cylinder Below Barrel
Chamber Index Cam Below Barrel
Spring Loaded Rammer The carbine 370 has the following advantages, which also apply to fourth and fifth carbines 380, 390 described further below:

Aft feeding allows for length savings over traditional forward feeding weapons
Gas piston above barrel allows room for large capacity ammo container
Clearing can be performed on pull stroke of charging handle FIGS. 94-95 show open & closed bolt sear for the carbine 370.

Figure 106:
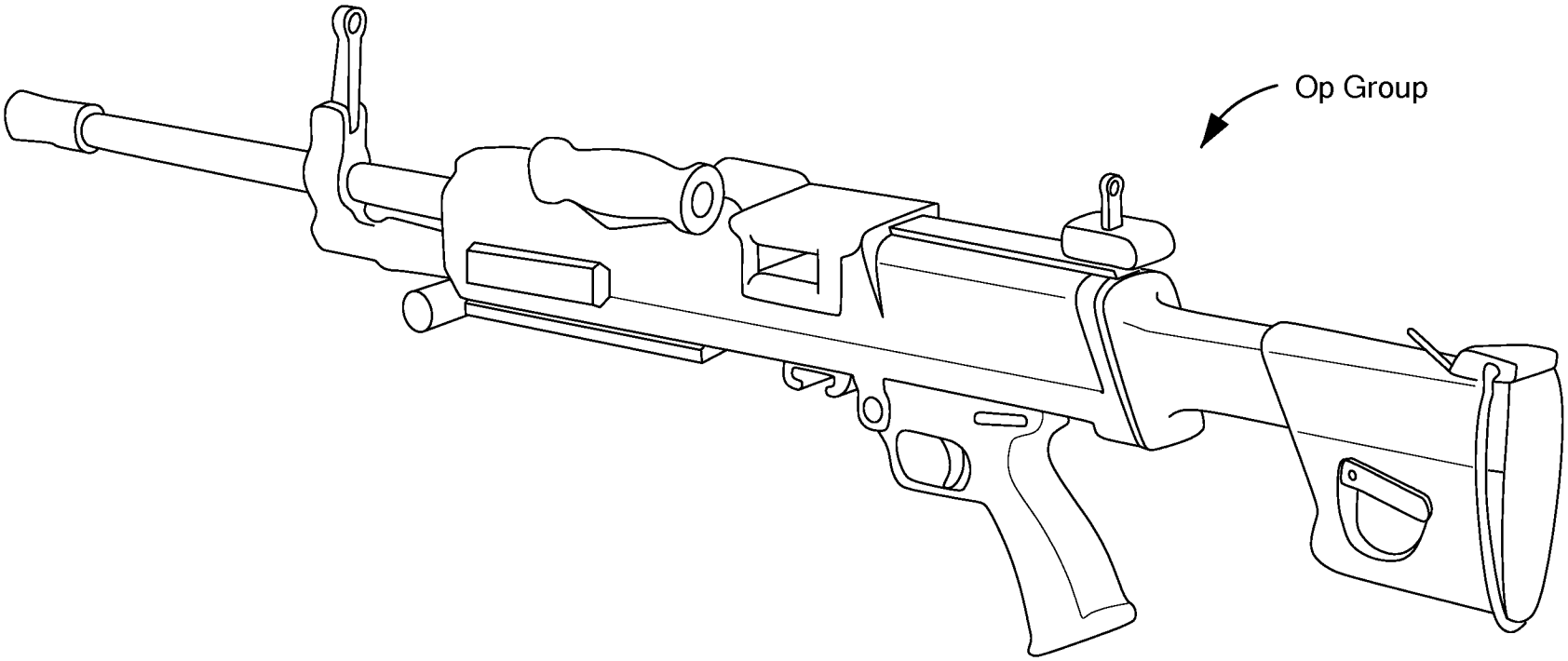
FIGS. 106-107 are perspective views of a CT ammunition machine gun, fully assembled and exploded respectively.
Figure 107:
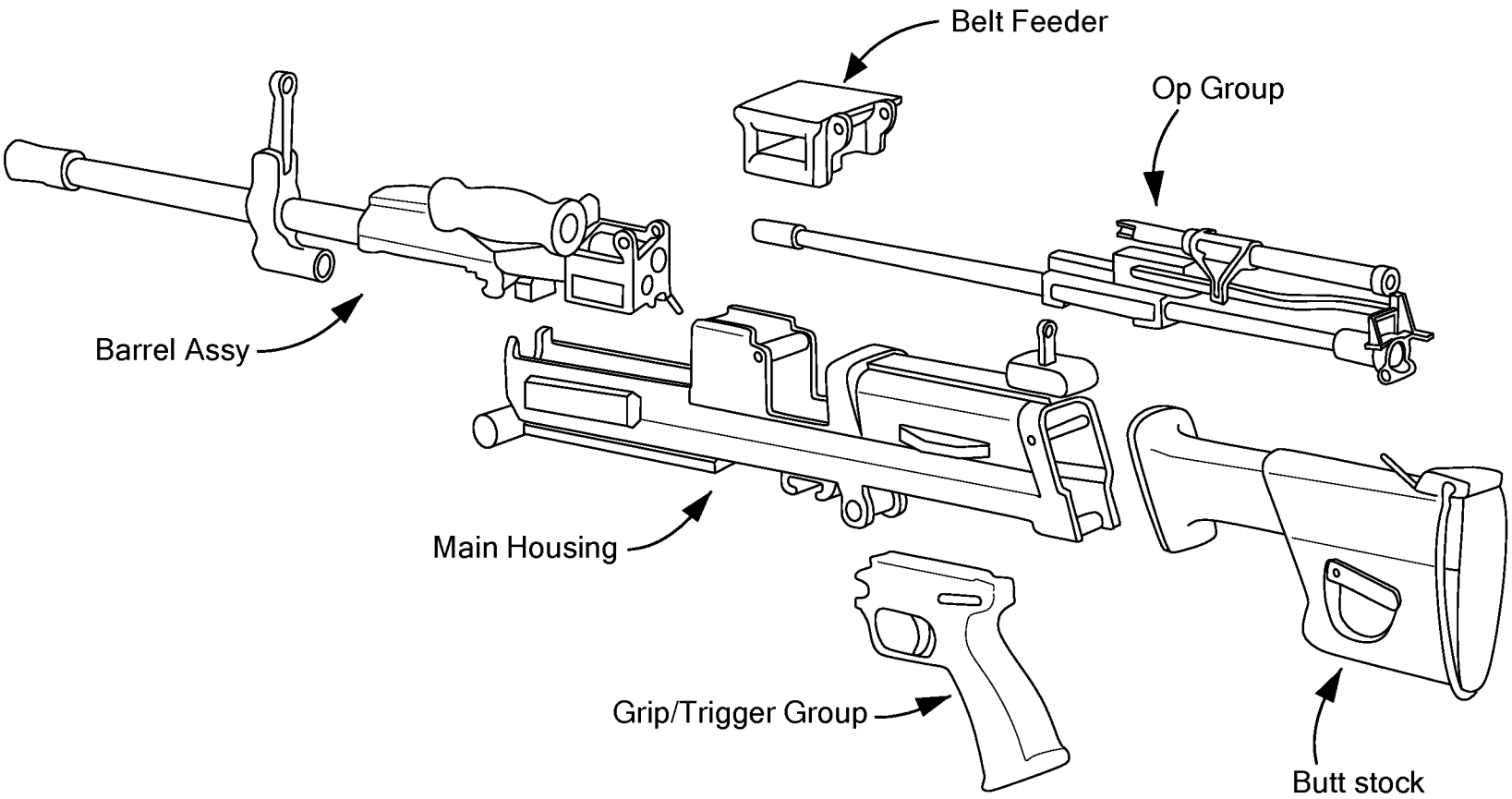

FIGS. 96-100 show a fourth alternative carbine 380 with the following characteristics:

Aft feed, operating rod above barrel
Translating Chamber
Gas Cylinder Above Barrel
Chamber Index Cam Above Barrel
Spring Loaded Rammer
The carbine 380 has the following advantages:
Chamber Cam above Chamber allows room for large capacity magazine or belt feeder mechanism
Gas Block can be located farther aft which allows use of M4 barrel without other modifications FIGS. 101-105 show a fifth alternative carbine 390 with the following characteristics:

Aft feed, linked rammer, forward-acting gas piston
Translating Chamber
Gas Cylinder Below Barrel
Chamber Index Cam Below Barrel
Linked Rammer Operation
Magazine Position Forward of Chamber
Pistol Grip Behind Magazine
The carbine 390 has the following advantages:
Aft feed via slide driven rammer without need to reverse actuation direction
Buffer contact forces will counteract recoil FIGS. 106 and 107 show a firearm 410, in assembled form in FIG. 106 and in exploded view in FIG. 107. The firearm 410 includes the following major components:

Main housing 412
Barrel assembly 414
Belt feeder 416
Operating group 418
Buttstock 420
Grip and trigger group 422

All components attach to the main housing 412 to form the fully assembled firearm 410 as shown in FIG. 106.

While various embodiments of the invention have been particularly shown and described, it will be understood by those skilled in the art that various changes in form and details may be made therein without departing from the scope of the invention as defined by the appended claims.

What is claimed is:

1. A weapon for firing cased telescoped (CT) ammunition rounds in quick succession, comprising:

a barrel;

a chamber member that defines a chamber configured to hold a CT round for firing from the weapon, the chamber member moving between a firing position in which the chamber member is aligned with the barrel for firing the CT round and an ejection/loading position in which the chamber member is not aligned with the barrel for ejecting a spent CT round and receiving a next CT round, the chamber member being biased toward the firing position; and a carrier assembly coupled with the barrel and the chamber member, the carrier assembly being configured and operative in a single trigger-initiated firing cycle to (1) perform a recoil in which a carrier and fixed rammer of the carrier assembly move rearward from a battery position to bring the next CT round into a ramming position and to move the chamber member from the firing position to the ejection/loading position in line with the next CT round, and (2) perform a subsequent counter-recoil in which a firing pin of the carrier assembly is returned to the battery position and the fixed rammer pushes the next CT round into the chamber as the chamber member is held in the ejection/loading position, the counter-recoil ending with release of the chamber member for biased return to the firing position for a next trigger-initiated firing cycle, wherein the chamber member is retained in chamber carrier of a chamber carrier assembly, the chamber carrier assembly including springs coupled between the chamber carrier and a receiver member of the weapon to provide the biasing of the chamber member, and wherein the carrier assembly is coupled to the chamber carrier by a camming arrangement causing the chamber carrier to be moved against the biasing of the springs to the ejection/loading position, the camming arrangement enabling return of the carrier assembly to the firing position without corresponding movement of the chamber carrier.

2. The weapon of claim 1, wherein the chamber carrier travels vertically between the firing position and the ejection/loading position.

3. The weapon of claim 2, wherein the ejection/loading position is below the firing position, such that the biased return of the chamber member is an upward motion within the weapon.

4. The weapon of claim 1, further including a spring-loaded chamber carrier catch disposed between the chamber carrier and a slide member of the carrier assembly, the chamber carrier catch configured to engage a corresponding feature of the chamber carrier to retain the chamber carrier in the ejection/loading position until the carrier assembly reaches a battery position and the slide member opens the chamber carrier catch to release the chamber carrier for the biased return to the firing position.

5. The weapon of claim 1, wherein the fixed rammer is a foot-like protrusion of the carrier assembly, aligned with the next CT round in the ramming position.

6. The weapon of claim 1, further including a barrel extension coupled at an aft end of the barrel, the barrel extension having a chamber cavity aligned with the barrel and configured to (1) define the firing position and retain the chamber member in the firing position, and (2) permit movement of the chamber member between the firing position and the ejection/loading position.

7. The weapon of claim 6, wherein the barrel extension includes machined ribs arranged at an inner surface bounding the chamber cavity, the machined ribs contacting the chamber member to define the firing position and retain the chamber member in the firing position.

8. The weapon of claim 1, further including an ejector assembly adjacent to the chamber member in the ejection/loading position, the ejector assembly including an ejector configured and operative to receive and eject a spent cartridge pushed through the chamber member when the next CT round is being pushed into the chamber.

9. The weapon of claim 8, wherein the ejector includes a spring-loaded pivoting bar configured for (1) a first movement forward and sideways in response to the spent cartridge exiting the chamber member, and (2) a subsequent second movement sideways and rearward that kicks the spent cartridge sideways out of the weapon and returns the pivoting bar to a rearward position for a next ejection cycle.

10. The weapon of claim 9, wherein the pivoting bar in the rearward position partially blocks a forward opening of the chamber when the chamber member is in the ejection/loading position, thereby forming a first round stop preventing a newly loaded cartridge from being pushed through the chamber member when no spent cartridge occupies the chamber when the newly loaded cartridge is loaded.

11. The weapon of claim 8, wherein the chamber carrier includes a front round stop configured to prevent the spent cartridge in the ejector from backing up into a path of the chamber member from the firing position to the ejection/loading position.

12. The weapon of claim 8, wherein the ejector assembly includes a clearing assembly being user-operated to clear a spent or unfired round from the chamber when the chamber member is in the ejection/loading position.

13. The weapon of claim 12, wherein the clearing assembly includes a clearing member having a rear-facing clearing rod, the clearing member being mounted via slanted openings on respective cams whereby the clearing rod is moved (1) initially in a transverse direction to align the clearing rod with the chamber, and (2) subsequently in a longitudinal direction through the chamber to clear the spent or unfired round from the chamber.

* * * * *